US006872059B2

(12) United States Patent
Takahashi et al.

(10) Patent No.: US 6,872,059 B2
(45) Date of Patent: Mar. 29, 2005

(54) LIQUID DISCHARGER AND APPARATUS INCLUDING THE LIQUID DISCHARGER

(75) Inventors: Osamu Takahashi, Nagano-ken (JP); Masatoshi Moteki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

(21) Appl. No.: 10/242,547

(22) Filed: Sep. 12, 2002

(65) Prior Publication Data

US 2003/0071072 A1 Apr. 17, 2003

(30) Foreign Application Priority Data

Sep. 12, 2001 (JP) ..... 2001-277105
Feb. 7, 2002 (JP) ..... 2002-031092
Jun. 7, 2002 (JP) ..... 2002-167766

(51) Int. Cl.[7] ..... F04B 43/08
(52) U.S. Cl. ..... 417/477.3; 417/477.7; 417/477.9
(58) Field of Search ..... 417/477.1, 477.3, 417/477.6, 477.7, 477.8, 477.9, 477.11

(56) References Cited

U.S. PATENT DOCUMENTS 2,920,815 A * 1/1960 Schaurte ..... 417/475
3,440,966 A * 4/1969 Lagonegro ..... 417/477.7
4,417,856 A * 11/1983 Minissian ..... 417/477.7
5,840,069 A * 11/1998 Robinson ..... 604/131

FOREIGN PATENT DOCUMENTS

| | | |
|---|---|---|
| JP | 53-80005 | 7/1978 |
| JP | 5-321846 | 12/1993 |
| JP | 7-46786 | 10/1995 |
| JP | 9-42160 | 2/1997 |
| JP | 2001-65469 | 3/2001 |
| JP | 2001-158112 | 6/2001 |
| JP | 2002-155873 | 5/2002 |

* cited by examiner

*Primary Examiner*—Charles G. Freay
(74) *Attorney, Agent, or Firm*—Rosalio Haro

(57) ABSTRACT

A liquid discharger 1A has a base 2A where a resilient tube 100 is disposed in a tube guide groove 211A. A retainer 4A is rotatably provided at the base 2A, with a plurality of balls 5 being mounted at the retainer 4A so that the balls can roll. The cross sectional shape of a surface 211 defining the tube guide groove 211A that contacts the tube 100 has an arc shape formed concentrically with the balls 5. The balls 5, which are held by the retainer 4A, roll on the tube 100 while pressing and squashing a portion of the tube 100 as a rotor 3A rotates in order to discharge liquid inside the tube 100.

18 Claims, 40 Drawing Sheets

LIQUID DISCHARGER AND APPARATUS INCLUDING THE LIQUID DISCHARGER

BACKGROUND OF THE INVENTION

1. Field of the Invention

The present invention relates to a liquid discharger for successively pushing out liquid inside a tube by successively pressing and squashing a portion of the tube, and an apparatus including the liquid discharger.

2. Description of the Related Art

A liquid discharger (tube pump) for discharging liquid inside a resilient tube by successively pressing and squashing the tube has been conventionally known.

For example, there is, as disclosed in Japanese Unexamined Patent Application Publication No. 2000-110712, a liquid discharger for sending fluid into a tube by pushing out a plurality of tube pusher members disposed along the tube by a cam shaft and successively squashing the tube. The cam shaft of the liquid discharger is driven by a spring through a train of wheels.

In addition, there is, as disclosed in Japanese Unexamined Patent Application Publication No. 5-69558, a liquid discharger of a type that successively squashes a tube by biasing a pressure roller by a compressing spring.

Further, there is a liquid discharger having a structure in which a tube is disposed in the form of an arc or a semicircle and the top surface of the tube is pressed and squashed by a circular cylindrical roller.

Such related liquid dischargers have the following problems.

In the liquid discharger in which a plurality of tube pusher members are pushed out by a cam shaft, friction is produced between the cam shaft and the tube pusher members, so that energy loss becomes large, and the cam shaft and the tube pusher members are worn by the friction, thereby giving rise to the problem that durability cannot be increased. In particular, in this liquid discharger, rotational motion of the cam shaft is converted into advancing and retreating movement of the tube pusher members with respect to the tube, and a large force needs to be exerted to squash the tube by the tube pusher members. Therefore, friction is produced between the cam shaft and the tube pusher members, so that there is a problem in that the cam shaft and the tube pusher members are worn.

At least three tube pusher members are required. In order to achieve smoother discharging of liquid, many tubes of the order of eight tubes are required. Since friction is produced between the many tube pusher members and the cam shaft, a large force is required to drive the cam shaft and to squash the tube using the tube pusher members. Therefore, for example, a large motor must be provided, thereby making it difficult to reduce the size of the liquid discharger.

Even in the liquid discharger using a pressure roller, the area of contact between the pressure roller and the tube is large, so that a large force is required to squash the tube. Therefore, a large motor is required to drive the pressure roller, thereby making it impossible to reduce the size of the liquid discharger. In order to rotatably mount the presser roller, a subassembly for, for example, previously securing a roller bearing or the like to a guide roller is required. Therefore, there are problems in that the size of the liquid discharger is increased and that costs are increased. Further, since a large friction is produced due to a large area of contact between the pressure roller and the tube, when the liquid discharger is used for a long period of time, wearing due to friction occurs, thereby making it impossible to increase durability of the liquid discharger.

Further, even in the liquid discharger in which the tube is pressed and squashed by a circular cylindrical roller, since the area of contact between the roller and the tube is large, a large motor is required for driving the roller. In addition, since slipping occurs due to a difference between the speeds of movement of the inside surface (surface closer to the center of the arc or semicircle formed by the tube) and outside surface of the roller, friction loss occurs. To overcome this problem, the roller may be formed with a conical shape.

When the conical roller is used, it is necessary to consider the direction in which the conical roller is set. For example, when the tube is disposed in a circular form, it is necessary to dispose the axis of rotation of the conical roller so as to face the center of the circular form of the tube. Also, when the conical roller is used, in order to sufficiently press and squash the tube, it is necessary to set the surface where the tube is provided and the surface where the roller presses and squashes the tube parallel to each other. When variations occur in, for example, an assembly operation, it becomes difficult to maintain these surfaces parallel to each other, so that the pressing and squashing operation becomes unstable. Therefore, when the conical roller is used, the assembly operation must be precisely performed by considering the setting direction, thereby making the assembly operation troublesome to carry out.

As described above, these related liquid dischargers have a first problem in that it is difficult to increase durability, to reduce size, and to make it easy to perform an assembly operation.

A liquid discharger which successively presses and squashes a tube is such that, even while it is not operating, at least a portion of the tube is pressed and squashed all the time. In particular, during the period of time from the time after the assembly of the liquid discharger at a plant is completed to the time the user starts to use the liquid discharger, a force is exerted only on a portion of the tube for a long period of time. As a result, the tube undergoes plastic deformation, so that its capacity is changed. Therefore, even if the user starts to use the liquid discharger, an error in the discharge rate from the liquid discharger may occur, thereby giving rise to a second problem in that it is difficult to reduce errors in the discharge rate.

When the tube is rubbed and pulled by a ball (that is, when the ball moves on the tube while it presses and squashes the tube), the tube is stretched or its resiliency is reduced, so that variations in discharge rate may occur. In particular, at the initial stage immediately after the user starts using the liquid discharger, the tube with a length close to its natural length is pulled when it is rubbed and pulled, so that the inside diameter of the tube changes, as a result of which errors in the rate of discharge tend to be large. Therefore, when the rate of discharge is to be precisely controlled, it is necessary to perform a test run, thereby giving rise to a third problem in that it is difficult to increase work efficiency.

OBJECT OF THE INVENTION

It is a first object of the present invention to provide a liquid discharger which can be made more durable and smaller in size, and which can be easily assembled.

It is a second object of the present invention to provide a liquid discharger which can achieve the first object and which makes it possible to reduce errors in the rate of discharge.

It is a third object of the present invention to provide a liquid discharger which makes it possible to increase work efficiency.

It is a fourth object of the present invention to provide an apparatus which comprises any one of these liquid dischargers.

SUMMARY OF THE INVENTION

A liquid discharger of the present invention including a base for placing a resilient tube thereat comprises a ball which rolls on the tube while pressing and squashing a portion of the tube, and a driving mechanism for rolling the ball.

Here, "the ball rolls on the tube" means that the ball rotates and moves along the tube while contacting the tube, so that it does not necessarily mean that the ball rolls on the top surface of the tube. Accordingly, it encompasses the general conceptions of the ball rolling on a side surface and the bottom surface of the tube.

One ball or a plurality of balls may be provided.

The liquid discharger may include a retainer for rotatably holding the ball.

In the invention having this structure, a portion of the tube is pressed and squashed by a ball. Accordingly, since the area of contact between the ball and the tube is small, a large friction is not produced compared to the case where a pressure roller, tube pusher members, or a roller is used. In addition, since the ball itself moves along the tube while rolling, friction is not easily produced compared to the case where the ball itself does not rotate. Therefore, deterioration of the ball and the tube by friction that is produced between the ball and the tube does not easily occur, thereby making it possible to make the liquid discharger more durable. Further, since a large friction is not produced, a motor for driving the ball, or the like, can be reduced in size, so that the liquid discharger can be reduced in size.

In the related liquid discharger using a conical roller, it is necessary to consider the direction in which the conical roller is disposed. In contrast, in the liquid discharger using a ball in the present invention, it is not necessary to consider the direction in which the ball is disposed, thereby making it easier to carry out assembly.

In addition, in the case where a ball is used, when the size of the ball with respect to that of the tube and the position where the ball is set are properly set, it is possible to substantially completely press and squash the tube. For example, when the diameter of the ball is sufficiently larger than the diameter of the opening of the tube, it is possible to substantially completely press and squash the tube. When the ball is moved with center point of the ball aligned with the center of the diameter of the opening of the tube, the tube can be substantially completely pressed and squashed.

Therefore, the pressing-and-squashing operation on the tube does not become unstable due to variations in, for example, the assembly operation as it does when a conical roller is used, so that it is not necessary to precisely perform the assembly operation, thereby making it easier to perform the assembly operation.

For the ball used in the present invention, a conventionally available bearing ball or the like may be used, so that, compared to the case where a conical roller is manufactured, manufacturing costs are low.

Here, it is desirable that a tube guide groove for placing the tube therein be formed in the base, and a central portion of a cross-sectional shape of a tube-contacting surface defining the tube guide groove be recessed.

In the present invention, as shown in FIG. 40, a tube may be placed on a flat base and the tube may be pressed and squashed by a ball from the opposite side of the base with the tube being interposed therebetween. However, here, for example, when the diameter of the ball is too small compared to the diameter of the tube, or when the relationship between the wall thickness or resiliency of the tube and the force used to push the ball against the tube is not appropriate, or when the ball and the tube are not disposed at proper locations, a uniform pressing force cannot be exerted in the entire widthwise direction of the tube, which is in a direction orthogonal to the axial direction of the tube (longitudinal direction of the tube), as it is in the case where a pressure roller or tube pusher members are used. In other words, since the distance between the spherical surface of the ball and the base is not constant, the central axis portion of the tube which is aligned with the center of the ball in the widthwise direction is pressed the most, whereas both end portions of the tube are hardly pressed. Therefore, it is difficult to completely squash the opening of the tube. When the opening of the tube is not completely squashed, the exactness of the discharge rate from the liquid discharger is reduced. In addition, in order to completely squash the opening of the tube, a large force is required for pressing the tube, so that the load on the tube is increased. Therefore, it is necessary to adequately consider the relationship between the diameter of the ball and the diameter of the tube, and the position of the ball.

In contrast to this, when the central portion of a cross section of a tube-contacting surface defining the tube guide groove is recessed, compared to the case where the tube is placed on the flat base and the tube is pressed and squashed by the ball, variations in the distance between the spherical surface of the ball and the base are reduced, so that, when the tube is pressed, the tube is deformed along the shape of the tube guide groove, thereby making it possible to substantially uniformly press the whole tube. Therefore, even if the relationship between the diameter of the ball and the diameter of the tube is not adequately considered, both end portions of the tube can be pressed, so that the discharge rate from the liquid discharger is highly precise. In addition, if the center of the tube is dented at the depression of the tube guide groove, the position of the tube in a direction orthogonal to the direction of the center axis of the opening of the tube is automatically guided. For this reason, the movement of the ball can be guided along the center axis of the opening of the tube, so that the tube can be substantially completely pressed and squashed, thereby making it possible to make the discharge rate from the liquid discharge highly precise.

It is desirable that the cross-sectional shape of the tube-contacting surface defining the tube guide groove be an arc shape formed concentrically with the ball or be a shape which linearly approximates to the arc shape.

If the cross-sectional shape of the tube-contacting surface defining the tube guide groove is an arc shape formed concentrically with the ball, compared to the case where the central portion of the cross section of the tube-contacting surface defining the tube guide groove is merely recessed, the distance between the ball and the base on which the tube is placed becomes constant to a higher degree, so that, when the tube is pressed and squashed by the ball, the whole tube can be uniformly pressed. Therefore, it is possible to substantially completely squash the opening of the tube with a smaller force, so that the preciseness of the discharge rate from the liquid discharger can be increased.

Even if the cross-sectional shape of the tube-contacting surface defining the tube guide groove is a shape which linearly approximates to an arc shape, since the tube is resilient, the tube bends in the form of an arc when the tube is pressed and squashed by the ball, so that, as in the case where the cross-sectional shape of the tube-contacting surface defining the tube guide groove is an arc shape, the opening of the tube can be substantially completely squashed. In addition, if the cross-sectional shape of the tube-contacting surface defining the tube guide groove is a shape that linearly approximates to an arc shape, the tube guide groove is easily formed compared to the case where the cross-sectional shape is an arc shape.

Further, in the present invention, since a ball is used, and the cross-sectional shape of the tube-contacting surface defining the tube guide groove is an arc shape formed concentrically with the ball or a shape that linearly approximates to an arc shape, even if a tube having variations in the wall thickness is used, it is possible to substantially completely squash the tube, so that the discharge rate can be made precise.

Here, when the radius of the arc shape is R, the radius of the ball is r, and the thickness of the tube is T, it is desirable that the following Numeral Expression 2 be satisfied:

$$R-2T \leqq r.$$

It is particularly desirable that the following Numeral Expression 3 be satisfied:

$$R-2T \leqq r < R-T.$$

When the radius r of the ball is less than R−2T, it is difficult to substantially completely press and squash the tube. On the other hand, when the radius r of the ball is greater that R−T, it becomes difficult to squash the portion near the center of the opening of the tube. In order to also squash the portion near the center of the opening, a larger force is required to deform the tube. Therefore, when the ball rolls on the tube, a large load is exerted on the tube. In the present invention, since the radius r of the ball is equal to or greater than R−2T, and is less than R−T, such a problem does not arise. A specific radius r of the ball is set depending on, in addition to condition $R-2T \leqq r < R-T$, the elastic deformation of the tube, the material of the tube, etc.

Further, it is desirable the coefficient of friction between the ball and the tube be less than the coefficient of friction between the tube guide groove and the tube.

When the coefficient of friction between the ball and the tube is greater than the coefficient of friction between the tube guide groove and the tube, as the ball rolls, the tube may move in the tube guide groove. However, in the present invention, since the coefficient of friction between the ball and the tube is less than the coefficient of friction between the tube guide groove and the tube, such a problem does not arise. Therefore, it is possible to roll the ball while maintaining the tube at its predetermined position.

Further, it is desirable that the liquid discharger be constructed so as to comprise a pusher member disposed opposite to the tube with the ball being disposed between the tube and the pusher member, and so that, by causing the ball to roll while it contacts the pusher member, the ball is pressed by the pusher member in order to press and squash a portion of the tube.

Here, for the pusher member, a disk-shaped rotor, a ring plate shaped member, or the like, may be used.

When such a pusher member is provided, the resilient force exerted on the ball from the tube is received by the pusher member, so that liquid can be discharged by reliably pressing and squashing the tube by the ball.

Here, it is desirable that the liquid discharger comprise a retainer that is movable along the tube and that a ball holding section for holding the ball so that the ball can rotate be formed at the retainer.

By holding the ball by the retainer, when the ball rolls, it is no longer displaced from its predetermined position, so that a discharging operation is performed with higher precision. When a plurality of balls are provided, it is possible to keep the balls separated at equal distances from each other, so that the discharge rate can be made constant.

Further, it is desirable that the liquid discharger of the present invention be constructed so that, by exerting external force on the retainer, the location of the retainer and the location where the ball mounted to the retainer is set move in order to cancel the pressing-and-squashing operation of the ball on the tube.

When the liquid discharger is constructed so that, when external force is exerted on the retainer, the location where the ball is set is moved in order to cancel the pressing-and-squashing operation of the ball on the tube, the liquid discharger may have a track-shaped (elliptical) hole formed in the center of the retainer or, as shown in FIG. 41, may have the inner peripheral side of the retainer punched out and the center of the retainer and the inner periphery coupled with a spring so that, when a force is exerted in a direction orthogonal to the rotational axis of the retainer, the retainer is displaced in order for the ball to be displaced from the tube. When such a structure is used, it is possible to prevent the tube from getting deformed when the liquid discharger is not used for a long period of time or during the period of time until the user starts using the liquid discharger. By this, it is possible to reduce errors produced in the discharge rate, so that the second object of the present invention can be achieved.

Since the surface of the ball that comes into contact with the tube is spherical, even if the ball is not completely removed from the tube, the pressing-and-squashing operation on the tube can be cancelled even by only displacing the location of the center of the ball from the center of the tube. Therefore, compared to the case where a pressure roller or the like is used, the amount of movement of the ball by external force can be made very small, so that the pressing-and-squashing operation can be easily cancelled.

It is desirable that the liquid discharger be constructed so that the ball is disposed at an initial position which is situated at the base and which is displaced from the tube, and so as to comprise a ball holding section for holding the ball so that the ball can roll on the tube, leading means for leading the ball from the initial position thereof to the ball holding section, and leading-away means for returning the ball which has been led to the ball holding section to the initial position thereof.

When the liquid discharger comprises a plurality of balls, all of the balls may be disposed at the initial position, or at least one of the plurality of balls may be disposed at the initial position.

When the liquid discharger comprises, for example, a retainer, the ball holding section may be formed at the retainer, or when the liquid discharger comprises, for example, a pusher member, the ball holding section may be formed at the pusher member.

The ball is disposed at the initial position which is displaced from the tube, and, by the leading means, the ball is led to the ball holding section. Accordingly, since, in the initial state, the tube is not pressed and squashed, the tube does not easily undergo plastic deformation, so that errors in the discharge rate can be reduced, thereby making it possible to achieve the second object of the present invention.

Since the liquid discharger comprises leading-away means, after use, the ball is returned to its initial position from the ball holding section, so that the ball can be removed from the tube. Accordingly, even after use, it is possible to prevent plastic deformation of the tube, so that errors in the discharge rate can be reduced.

The liquid discharger may be constructed so as to comprise two or more of balls including at least a first ball and a second ball, and at least either one of a pusher member and a retainer, the pusher member being rotatably disposed with respect to the base for pushing each of the balls towards the tube and the retainer being rotatably provided with respect to the base. In the liquid discharger, at least either one of a tube-side surface of the pusher member and the retainer includes a ball mounting section for mounting the first ball thereto so that the first ball can roll and a ball guide groove for movably disposing the second ball thereat. When the second ball is at a forward-rotation-direction front-side end defining the ball guide groove, the forward-rotation-direction front-side end defining the ball guide groove is disposed close to the ball mounting section so that the second ball can be disposed at an initial position thereof along with the first ball disposed at the ball mounting section. A forward-rotation-direction back-side end defining the ball guide groove is the ball holding section.

Here, the liquid discharger may comprise only a pusher member so that it does not comprise a retainer, or it may comprise only a retainer. Alternatively, the liquid discharger may comprise both a pusher member and a retainer. When it comprises both a retainer and a pusher member, the ball mounting portion or the ball guide groove does not need to be provided at the pusher member.

In the invention having this structure, when the pusher member or the retainer rotates forwardly, the first ball held by the ball mounting section is led onto the tube to roll on the tube. The second ball moves in the ball guide groove, and comes into contact with the forward-rotation-direction back-end of the ball guide groove serving as the ball holding section. This means that the second ball is rollably held by the forward-rotation-direction back-end and is led onto the tube to roll on the tube.

After use, the pusher member or the retainer is rotated in the reverse direction. This causes the first ball held by the ball mounting section to return to its initial position. The second ball moves away from the forward-rotation-direction back-end of the ball guide groove serving as the ball holding section, moves in the ball guide groove, and is held by the forward-rotation-direction front-end, so that it returns to its initial position. Therefore, the ball guide groove serves as leading means for leading the ball to the ball holding section from its initial position, and as leading-away means for returning the ball to its initial position from the ball holding section.

According to the present invention having such a structure, in the initial states, at least the first and second balls are not on the tube, so that it is possible to prevent plastic deformation of the tube. After use, the balls can be returned to their initial positions by rotating the pusher member or the retainer in the reverse direction. Therefore, it is possible to prevent plastic deformation of the tube not only during the period of time from the time after the assembly of the liquid discharger at a plant has been completed to the time the user starts to use the liquid discharger, but also after the user once starts using the liquid discharger. Consequently, since it is possible to prevent such plastic deformation, errors occurring in the discharge rate can be reduced, as a result of which the second object of the present invention can be achieved.

When the liquid discharger comprises a retainer, it is possible to precisely maintain the distance between the first and second balls when they roll on the tube. Since the balls are held by the retainer, even if, for example, shock is applied during use of the liquid discharger, the balls are not displaced from the tube.

The liquid discharger of the present invention may be constructed so as to comprise a retainer including a ball holding section for holding a ball so that the ball can roll on the tube, a pusher member for pushing the ball against the tube in order to press and squash a portion of the tube, and a driving mechanism for moving the pusher member along the tube. In the liquid discharger, the initial position is misaligned with a path of the ball holding section. At least one of the balls is a lead-in ball disposed at the initial position. The leading means leads the lead-in ball from the initial position to the ball holding section.

The ball led to the ball holding section by the leading means is, along with the movement of the retainer, guided onto the tube to roll on the tube.

Since at least one of the balls is disposed as a lead-in ball at its initial position which is misaligned with a path of the ball holding section of the retainer, and is led to the ball holding section from its initial position, the lead-in ball does not press and squash the tube disposed at its initial state. Therefore, it is possible to prevent the tube from tending to get deformed, so that errors occurring in the discharge rate can be reduced. By this, the second object of the present invention can be achieved. In particular, since the period of time from the time after manufacturing of the liquid discharger to the time the user starts to use the liquid discharger tends to be long, such a structure is effective.

When two or more balls are used, if balls other than the lead-in ball are initially disposed at locations where they do not press and squash the tube above the path of the ball holding section and are assembled, it is possible to prevent the entire length of the tube from tending to get deformed.

It is desirable that the liquid discharger further comprise leading-away means for returning the lead-in ball to the initial position from the ball holding section. In the liquid discharger, the retainer is a flat plate member which is provided substantially parallel to the base and has an outer peripheral edge which extends between the tube and the initial position of the lead-in ball in plan view. The ball holding section is formed by cutting away a portion of the retainer from the outer peripheral edge to a location above the tube. The lead-in ball at the initial position is led to the ball holding section from a direction crossing a direction of movement of the retainer and the lead-in ball that has been led to the ball holding section is held by the ball holding section in the direction of movement of the retainer. The leading-away means, formed at the ball holding section, has an initial position guide surface for guiding the lead-in ball to the initial position thereof when the retainer moves in a reverse direction.

According to this invention, since the ball holding section has an initial position guide surface, the lead-in ball can be displaced from the tube by simply moving the retainer in the reverse direction after the user has finished using the liquid discharger, so that it is possible to prevent the tube from tending to get deformed even after use, and, thus, to reduce errors occurring in the discharge rate.

It is desirable that a ball lead-in groove for guiding the lead-in ball disposed at the initial position to a location above the tube disposed in the tube guide groove be formed in the base, and a central portion of a cross section of a bottom surface defining the ball lead-in groove protrude towards the pusher member.

Here, the bottom surface defining the ball lead-in groove refers to the surface along which the lead-in ball rolls.

By forming the bottom surface defining the ball lead-in groove with a shape so that its central portion protrudes towards the pusher member, when the user starts to use the liquid discharger, the lead-in ball led to the ball holding section moves to the back side of the ball lead-in groove (the side opposite to the initial position of the lead-in groove with the cross-sectional central portion defining the ball lead-in groove being disposed therebetween) and roll on the back-side surface defining the ball lead-in groove.

On the other hand, after use, when the retainer is moved in the reverse direction, the lead-in ball is guided by the initial position guide surface of the ball holding section, passes by the outer-side surface defining the ball lead-in groove, and returns to its initial position.

Therefore, in this way, the cross-sectional central portion of the ball lead-in groove is made to protrude towards the pusher member, so that, when the lead-in ball is led, the lead-in ball is made to roll on the back-side surface defining the ball lead-in groove, and so that, when the lead-in ball is returned to its initial position, the ball is made to roll on the outer-side surface defining the ball lead-in groove. By this structure, it is possible to precisely lead the lead-in ball and to return it to its initial position.

The liquid discharger may be constructed so that the retainer is a flat plate member which is provided substantially parallel to the base and has an outer peripheral edge which extends between the tube and the initial position of the lead-in ball in plan view. In the liquid discharger, the ball holding section is formed by cutting away a portion of the retainer from the outer peripheral edge to a location above the tube. The lead-in ball at the initial position is led to the ball holding section from a direction crossing a direction of movement of the retainer and the lead-in ball that has been led to the ball holding section is held by the ball holding section in the direction of movement of the retainer. The leading means comprises urging means, disposed at the base, for biasing the lead-in ball at the initial position towards the outer peripheral edge of the retainer.

According to this invention, until the ball holding section reaches the initial position of the lead-in ball, the lead-in ball is retained on the outer peripheral edge of the retainer by the urging means. When the ball holding section reaches the initial position of the ball, the lead-in ball is pushed into the ball holding section by the urging means, and moves on the tube while it is held by the ball holding section. Therefore, the lead-in ball can be easily led to the ball holding section.

Here, it is desirable that the liquid discharger comprise leading-away means for returning the lead-in ball to its initial position from the ball holding section, that the leading-away means be provided at the ball holding section of the retainer, and that the liquid discharger also comprise outer-peripheral-direction urging means for biasing the lead-in ball in the direction of the outer periphery of the retainer.

Here, "the direction of the outer periphery of the retainer" means a direction opposite to the direction in which the lead-in ball is led to the ball holding section.

It is desirable that the outer-peripheral-direction urging means have a weaker biasing force than the urging means.

In the case where the tube guide groove is formed deep, even if the outer-peripheral-direction urging means is provided, the lead-in ball that has been led to the ball holding section is pushed against a side surface defining the tube guide groove, so that it is not displaced from the tube guide groove. In addition, since urging means is provided at the initial position, the lead-in ball is retained by the urging means, so that it does not return to its initial position during use of the liquid discharger.

When the retainer moves in the reverse direction after use of the liquid discharger, and when, after the retainer has returned to its predetermined position, the biasing operation of the urging means is cancelled, the lead-in ball can be reliably returned to its initial position from the ball holding section by the biasing force of the outer-peripheral-direction urging means. Therefore, even after use, it is possible to prevent the tube from tending to get deformed.

Further, it is desirable that the leading means have a slope which allows the lead-in balls provided at the base to move along it from its initial position to the height of a path of the ball holding section.

According to this invention, when the lead-in ball is pushed into the ball holding section by the urging means, it is possible to smoothly move the lead-in ball to the height of the path of the ball holding section from its initial position. In particular, this structure is effective for the case where a difference in level is produced between the initial position of the lead-in ball and the top portion of the tube.

Further, here, it is desirable that the leading means comprise guiding means for setting a distance from the pusher member to the top portion of the tube larger than the height of the lead-in ball within a range in which the lead-in ball is led to the ball holding section of the retainer.

According to this invention, since the lead-in ball does not contact the pusher member when the lead-in ball are led to the ball holding section of the retainer, not only is a force not exerted by the pusher member, but also the difference in level measured from the initial position of the lead-in ball to the top portion of the tube can be made small, so that the lead-in ball can be smoothly led.

As a result, since the biasing force exerted on the lead-in ball by the urging means can be set small, even if the urging means, after pushing the lead-in ball into the ball holding section, comes into contact with the outer peripheral edge of the retainer, it is possible to reduce the load exerted with respect to the movement of the retainer.

Further, when the guiding means is formed by the tube guide groove which is provided in the base and used to place the tube therein, the distance from the pusher member to the top portion of the tube can be easily adjusted by only adjusting the depth of the tube guide groove.

Further, it is desirable that the urging means be a plate spring for biasing the lead-in ball by an end side thereof, and that the liquid discharger comprise detecting means comprising the plate spring, shape change portions provided at predetermined intervals at the outer peripheral edge of the retainer, and a detecting section for detecting a swinging movement of the end side of the plate spring which occurs when the end side of the plate spring comes into contact with the shape change portions of the retainer.

According to this invention, by detecting a swinging movement which occurs when the end side of the plate spring comes into contact with the shape change portions disposed at predetermined intervals at the retainer, the distance of movement of the retainer can be easily computed.

For example, if the detecting section is formed so that it can come into electrical connection with the plate spring with a range in which the end of the plate spring swings, the distance of movement of the retainer can be easily computed by only detecting the state of electrical connection of the detecting section.

Since the plate spring is used both for the urging means and the detecting means, the number of parts, costs, and number of manhours required for assembly of the liquid discharger can be reduced.

It is desirable that the tube be disposed in a substantially arc form, the retainer and the pusher member be formed with disc shapes and be rotatably provided with respect to the base, and the urging means be provided at the outer peripheral side of the retainer.

According to this invention, since a large space can be provided for disposing the urging means, it is possible to easily produce the liquid discharger.

In such a liquid discharger, it is desirable that the leading means protrude from the retainer on the side of the ball holding section opposite to the direction of movement of the retainer, and the liquid discharger further comprise transporting means for transporting the lead-in ball by catching the lead-in ball by passing the initial position of the lead-in ball as the retainer moves.

According to this invention, the lead-in ball at its initial positions is caught by the transporting means and led into the ball holding section, and moves along with the retainer. Therefore, it is possible to reliably lead the lead-in balls into the ball holding section.

Here, it is desirable that the leading means comprise guiding means which protrudes towards the retainer in a direction of movement of the ball holding section from the initial position of the lead-in ball on the base, and that the guiding means has a guide surface for guiding the lead-in ball towards the path of the ball holding section by the lead-in ball which moves on the base along with the retainer coming into contact with the guide surface.

According to this invention, when the lead-in ball comes into contact with the guide surface of the guiding means and is guided towards the path of the ball holding section, the lead-in ball moves towards the ball holding section. Therefore, the lead-in ball can be reliably led into the ball holding section.

Here, it is desirable that the liquid discharger comprise leading-away means for returning the lead-in ball to the initial position from the ball holding section, and that the leading-away means comprise an initial position guide surface, formed at a portion of the base opposite to the guide surface with the initial position of the lead-in ball being disposed therebetween, for guiding the lead-in ball to the initial position.

By forming an initial position guide surface at the base, after the user has finished using the liquid discharger, it is possible to smoothly return the lead-in ball to its initial position by moving the retainer in the reverse direction.

Here, it is desirable that the liquid discharger comprise a pusher member for pushing the ball against the tube in order to press and squash a portion of the tube, and that the driving mechanism transmit power to an outer peripheral edge of the pusher member.

According to this invention, when the driving mechanism is driven, the pusher member moves. Since the ball is pushed against the tube by the pusher member, the ball rolls on the tube by rotational force exerted thereupon by the movement of the pusher member, and moves while it presses and squashes a portion of the tube.

According to this invention, compared to the case where power is transmitted to the rotary shaft of the pusher member, the liquid discharger can be made thinner. Examples of the driving mechanism are a motor in which a worm gear is mounted, a driver such as an oscillating body including a piezoelectric device, and a wheel train for transmitting driving power to such a driver.

Further, it is desirable for the driving mechanism to, by applying voltage to the piezoelectric device while the oscillating body including the piezoelectric device is in contact with the pusher member, continuously drive the pusher member by oscillating the oscillating body.

According to this invention, it is possible to rotate the pusher member by oscillating the oscillating body simply by applying voltage to the piezoelectric device. Therefore, compared to the case where a motor or a worm gear is used, it is possible to operate the driving mechanism at a low speed.

The liquid discharger has been constructed in view of the third object, and is one including a base for disposing a resilient tube thereat. It comprises a pressing-and-squashing section for pressing and squashing a portion of the tube, and a pulling mechanism for applying tension to the tube or a compressing mechanism for applying a compression force to the tube.

By providing a pulling mechanism or a compressing mechanism, force exerted upon the tube can be made constant, so that it is possible to prevent changes in the inside diameter of the tube. Therefore, it becomes unnecessary to, for example, make a test run of the liquid discharger, so that work efficiency can be increased, thereby making it possible to achieve the third object of the present invention.

Here, it is desirable that the pulling mechanism or the compressing mechanism has a function of adjusting the force exerted upon the tube.

By providing a function of adjusting the force exerted upon the tube, the discharge rate can be finely adjusted by changing the inside diameter of the tube. Therefore, it is possible to correct variations in the discharge rate caused by variations in assembly precision or dimensions of the parts of the liquid discharger.

Further, it is desirable that the adjustment function be a function of adjusting the force exerted upon the tube according to temperature.

When the liquid discharger has a function of adjusting the force exerted upon the tube according to temperature, it is possible to prevent changes in the diameter of the tube caused by, for example, changes in temperature of the liquid inside the tube or changes in temperature of a room where the liquid discharger is installed. For this reason, it becomes unnecessary to adjust the diameter of the tube according to the use environment or the liquid used, so that it saves one the trouble of adjusting the diameter of the tube.

An apparatus of the present invention comprises any one of the above-described liquid dischargers.

Since the apparatus of the present invention comprises any one of the above-described liquid dischargers, it can provide the same operations/advantages as any one of the liquid dischargers.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, like reference symbols refer to like parts.

DESCRIPTION OF THE PREFERRED EMBODIMENTS

First Embodiment

Hereunder, a description of a first embodiment of the present invention will be given with reference to FIGS. 1 to 3.

Figure 1:
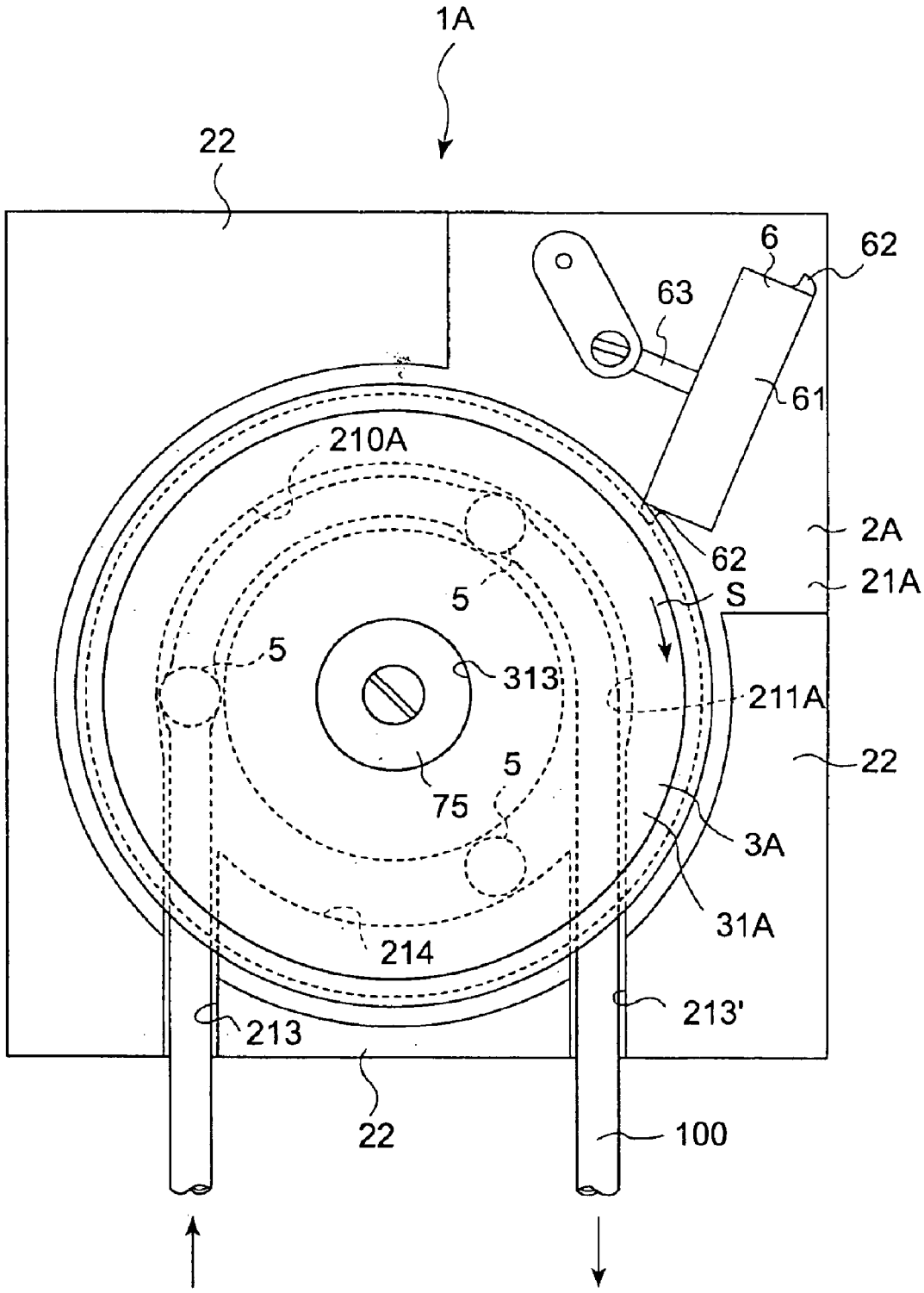
FIG. 1 is a plan view of a liquid discharger of a first embodiment of the present invention.
Figure 2:
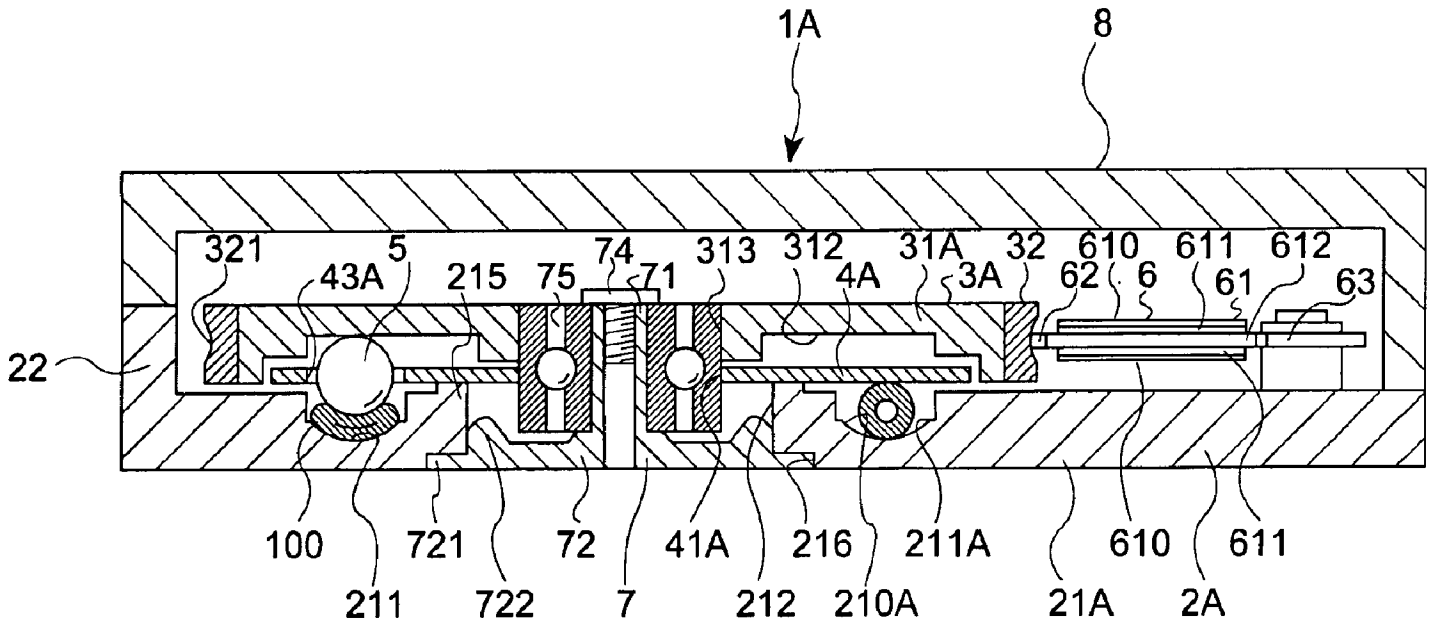
FIG. 2 is a sectional view of FIG. 1.
Figure 3:
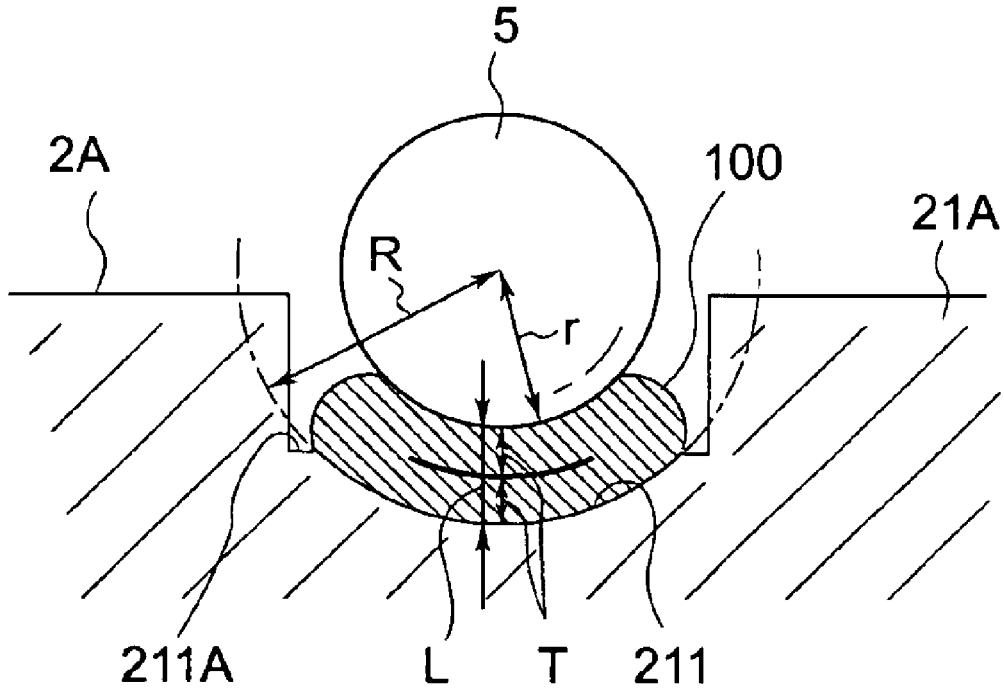
FIG. 3 is a sectional view of a tube guide groove and a tube in the liquid discharger.

FIG. 1 is a plan view of a liquid discharger 1A of the first embodiment of the present invention, FIG. 2 is a sectional view of FIG. 1, and FIG. 3 is a sectional view of a tube 100 and a tube guide groove 211A in the liquid discharger shown in FIGS. 1 and 2. In the description below, the top side in FIG. 2 refers to the "top side" of the liquid discharger 1A, and the bottom side in FIG. 2 refers to the "bottom side" of the liquid discharger 1A.

The liquid discharger 1A shown in FIGS. 1 and 2 comprises a base 2A for placing the tube 100 thereupon, a retainer 4A rotatably provided with respect to the base 2A and to which a ball 5 is mounted, a rotor 3A provided at the top portion of the retainer 4A and serving as a pusher member for pushing the ball 5 against the tube 100, and a driving mechanism 6 for rotationally driving the rotor 3A.

The tube 100 is formed of resilient resin, such as fluororesin including tetrafluoroethylene.

The base 2A comprises a base body 21A in which a tube guide groove 211A for placing the tube 100 is formed, and a wall 22 provided in a standing manner upward from the base body 21A. A cover 8 for covering the retainer 4A, the rotor 3A, etc., is provided at the top portion of the wall 22 of the base 2A; and a space for containing the retainer 4A, the rotor 3A, etc., is formed by the base 2A and the cover 8.

In the base body 21A are formed a planar circular groove 210A, and two parallel linear grooves 213 and 213' which connect to the circular groove 210A and to the outside of the base 2A. The grooves 213 and 213' connect to locations of the circular groove 210A at both sides of the rotary shaft of the retainer 4A (at opposite locations that are 180 degrees apart).

The tube 100 is not disposed within a semicircular portion of the planar circular groove 210A between parallel linear grooves 213 and 213'. This portion of the planar circular groove 210A where the tube 100 is not disposed forms a ball guide groove 214 for guiding the ball 5. The tube is mounted substantially in the form of a U shape along a semicircular portion of the planar circular groove 210A that is not situated at either side of parallel linear grooves 213 and 213'. In other words, an arc portion of the planar circular groove 210A, excluding the ball guide groove 214 and parallel linear grooves 213 and 213', forms the tube guide groove 211A.

As shown in FIG. 3, the cross-sectional shape of a contact surface 211 of the tube guide groove 211A which contacts the tube 100 (bottom surface defining the tube guide groove 211A) is an arc shape formed concentrically with the ball 5. When the radius of the arc shape of the contact surface 211 is R, the radius of the ball 5 is r, and the thickness of the tube 100 is T, it is desirable that the following Numeral Expression 4 be satisfied:

$$R-2T \leqq r.$$

It is more desirable that the following Numeral Expression 5 be satisfied:

$$R-2T \leqq r < R-T.$$

For example, the radius R of the arc shape of the contact surface 211 is equal to 1.3 mm, the radius r of the ball 5 is equal to 0.8 mm, and the thickness T of the tube 100 is equal to 0.25 mm (outside diameter=1.0 mm and inside diameter=0.5 mm).

The coefficient of friction between the ball 5 and the tube 100 is smaller than the coefficient of friction between the tube guide groove 211A and the tube 100. This is because the area of contact between the tube 100 and the ball 5 is small, and because the ball 5 produces rolling friction with respect to the tube 100.

Returning to FIGS. 1 and 2, a shaft hole 212 for installing a shaft section 7 is formed in the central portion of the base body 21A. A protrusion 215 which protrudes upward from the top surface of the base body 21A is formed at the top side of the shaft hole 212 provided in the base body 21A. In addition, a step 216 having an inside diameter that is larger than the shaft hole 212 is formed at the bottom end portion of the base body 21A at the side of the shaft hole 212.

The shaft section 7 comprises a cylindrical shaft section body 71, a circular flange 72 provided at the bottom end of the shaft section body 71, and a ball bearing 75 mounted to the outer peripheral surface of the shaft section body 71.

The inside of the shaft section body 71 is hollow, with the upper end being internally threaded. The ball bearing 75 is such that a bearing portion at the inner side thereof is secured to the shaft section body 71 with a screw 74 that is screwed to the top end of the shaft section body 71 and such that a journal at the outer side thereof is made rotatable with respect to the inner side portion with the center axis of the shaft section 7 serving as a center.

The flange 72 is formed by a large-diameter portion 721 and a small-diameter portion 722 which is formed above the large-diameter portion 721 and which has an inside diameter that is smaller than that of the large-diameter portion 721. An end of the large-diameter portion 721 of the flange 72 is fitted to the step 216 of the base body 21A. By this, the position of mounting the shaft section 7 with respect to the base 2A (in particular, height position) is determined.

A shaft hole 41A is formed in the central portion of the substantially disc-shaped retainer 4A. The shaft section body 71 of the shaft section 7 is inserted in the shaft hole 41A through the ball bearing 75. By this, the retainer 4A is rotatably mounted to the shaft section 7, that is, to the base 2A.

A ball holding section (ball mounting hole) 43A is formed in the retainer 4A, and three balls 5 which press and squash the tube 100 from thereabove are mounted to the ball holding section 43A so that they can rotate. The distances of these balls 5 from the shaft hole 41A are equal to each other, and adjacent balls 5 are spaced at equal intervals of, for example, 120 degrees. The balls 5 roll on the tube 100 while pressing and squashing the tube 100.

When the retainer 4A is disposed at the top portion of the base 2A, the retainer 4A contacts the protrusion 215 of the base 2A in order to determine the height of the retainer 4A from the base 2A.

The rotor 3A comprises a substantially disk-shaped rotor body 31A and a ring 32 affixed to the outer periphery of the rotor body 31A by, for example, press-fitting.

An annular recess 312 is formed in the bottom surface of the rotor body 31A. The recess 312 is formed at a location in correspondence with that of the ball holding section 43A of the retainer 4A. The top sides of the balls 5 are disposed in the recess 312 and are in contact with a portion defining the recess 312. By this, even if the balls 5 are biased upward (towards the rotor 3A) by a resilient force of the tube 100, this force is sustained by the rotor 3A through the balls 5. In other words, the balls 5 press the tube 100 by the rotor 3A. A shaft hole 313 similar to that of the retainer 4A is provided in the central portion of the rotor body 31A. The shaft section body 71 of the shaft section 7 is inserted in the shaft hole 313 through the ball bearing 75.

By screwing a screw into the threaded hole of the shaft section 7, the ball bearing 75 is secured to the shaft section 7. By this, the rotor 3A is mounted at a predetermined height from the base body 21A.

More specifically, the rotor 3A is provided so that a distance L between the balls 5 and the contact surface 211 is twice the thickness T of the tube 100, or is slightly smaller than this value. For example, the distance L may be $0.9\times 2T<L\leqq 2T$. When the distance L is equal to or less than $0.9\times 2T$, the tube 100 is pressed and squashed too much, so that excessive force is exerted upon the tube 100, causing a large friction to be produced between the tube 100 and the balls 5, which is not desirable. When the distance L becomes greater than 2T, the tube 100 cannot be substantially completely squashed, so that the discharge rate of the liquid discharger 1A becomes less precise. For this reason, the distance L is set substantially twice the thickness T.

A contact groove 321 which is arcuate in cross section along a peripheral direction is formed in the outer peripheral surface of the ring 32 of the rotor 3A. An oscillating body 61 of the driving mechanism 6 is in contact with the contact groove 321.

The driving mechanism 6 comprises the oscillating body 61 which includes a piezoelectric device and which is formed into a substantially rectangular planar shape, an arm 63 which supports the oscillating body 61, and an applying device (not shown) for oscillating the oscillating body 61 by applying alternating voltage of a predetermined frequency to the piezoelectric device of the oscillating body 61.

A threaded hole is formed in the arm 63. A set screw which is provided at the oscillating body 61 is inserted into the threaded hole, and is screwed into the base 2A. By this, the oscillating body 61 is mounted to the base 2A.

The oscillating body 61 is formed by stacking a rectangular plate-shaped electrode 610, a plate-shaped piezoelectric device 611, a reinforcing plate 612 which also functions as an electrode, another plate-shaped piezoelectric device 611, and another plate-shaped electrode 610 in that order. A protrusion 62 is integrally formed with an end of the reinforcing plate 612.

The oscillating body 61 is thinner than the rotor 3A.

By causing the piezoelectric devices 611 to stretch and contract in the longitudinal direction thereof by applying voltage thereto, the reinforcing plate 612 repeatedly vibrates. The materials used to form the piezoelectric devices 611 are not particularly limited, so that various materials, such as lead zirconate titanate (PZT), crystals, lithium niobate, barium titanate, lead titanate, lead metaniobate, polyvinylidene fluoride, zinc lead niobate, or scandium lead niobate, may be used.

When, with the protrusion 62 in contact with the ring 32, alternating voltage is applied to the piezoelectric devices 611 of the oscillating 61 in order to oscillate the oscillating body 61, the ring 32 is subjected to friction force (pushing force) from the protrusion 62 when the oscillating body 61 stretches. By repeatedly being subjected to this friction force (pushing force), the rotor 3A rotates in the direction of arrow S shown in FIG. 1.

The rotation of the rotor 3A causes the balls 5 to roll as they move. The movement of the balls 5 causes the retainer 4A to also rotate. As each ball 5 move onto the tube 100 from the ball guide groove 214 (where no part of tube 100 is situated), the ball 5 begins to press and squash the tube 100. The rotation of the rotor 3A causes the balls 5 to roll onto, and along the top of, the tube 100, each in succession causing a shifting pressing (and squashing) point along the tube 100. By this, the liquid inside the tube 100 is divided into traveling liquid capsules defined by tube segments of tube 100. The end points of a tube segment (and thereby its volume) is determined by the pressing points on tube 100 of two successive balls 5. As the two successive balls move along the top of tube 100, the tube segment they define also moves along the length of tube 100. Further, as the tube segment moves along the length of tube 100, the liquid it encapsulates moves inside the tube 100.

Since each of the balls 5 is held at an interval of 120 degrees by the retainer 4A, there are preferably always two balls 5 at any one time on the part of the tube 100 disposed in tube guide groove 211A, which preferably has an arched linear shape formed along a 180° range of planar circular groove 210A. By this, the encapsulated liquid is confined to a space defined by the tube segments (formed by pressing points on tube 100 by two successive balls 5) That is, the liquid is confined to a predetermined volume such that the volume ejected liquid may be accurately measured.

When a first balls 5 moving forwardly in the direction of rotation of the rotor 3A (indicated by arrow S in FIG. 1) is moved off of tube 100 onto ball guide groove 214, the pressing point caused by the first ball (i.e. the pressing-and-squashing operation on tube 100 by the first ball) is removed from tube 100 (i.e. canceled). The liquid previously confined by the tube segment defined between the first ball 5 and a preceding second ball 5 is discharged through the portion of the tube 100 that is disposed in groove 213'.

At this point, a third ball 5 moves from ball guild grove 214 onto the arcuate portion of tube guide groove 211A, and creates a new pressings point on tube 100, so that the liquid is transported while it is confined within the tube segment between the second ball 5 and the third ball 5. By repetition of these operations, the liquid is successively pushed out through the tube 100.

The discharge rate per unit time is set based on the diameter of the tube 100, the radius (length) of the arcuate portion of the tube 100 (within which ball guild grove 214 is constructed), the radius of the balls 5, and the rotational speed of the rotor 3A. In particular, since the rotational speed of the rotor 3A can be easily adjusted by controlling the supply of electrical power to the piezoelectric devices 611 of the oscillating body 61, adjustment of the discharge rate within a certain range is carried out by adjusting the oscillating speed of the oscillating body 61, that is, the rotational speed of the rotor 3A. Thus, precise and accurate rate control is achievable.

The first embodiment of the present invention can provide the following advantages.

(1-1) Since, in the liquid discharger 1A, a portion of the tube 100 is pressed and squashed by the balls 5, the area of contact between the balls 5 and the tube 100 is small, so that a large friction is not produced. In addition, since the balls 5 move on the tube 100 while they themselves substantially roll on the tube 100, friction is less easily produced than the case where the balls 5 themselves do not rotate. Therefore, deterioration of the balls 5 and the tube 100 due to friction between the balls 5 and the tube 100 does not easily occur, thereby making it possible to make the liquid discharger 1A more durable.

(1-2) In the related liquid discharger using a conical roller, it is necessary to consider the direction in which the roller is disposed. For example, when the tube is disposed in a circular form, the rotary shaft of the roller needs to be disposed facing the center of the circular form of the tube. In contrast to this, in the liquid discharger 1A of the embodiment using the balls 5, it is not necessary to consider the direction in which the balls 5 are disposed, so that the liquid discharger 1A can be easily assembled.

(1-3) In addition, when a conical roller is used, in order to reliably press and squash the tube, the roller must be disposed so that the surface of the roller that presses the tube and the surface where the tube is disposed are parallel to each other. Therefore, by variations in the assembly operation, the pressing-and-squashing operations are sometimes not stably performed, making it necessary to precisely assemble the liquid discharger so that variations in the assembly are not produced.

In contrast to this, in the embodiment, the balls 5 are used, and, of the portions of the tube guide groove 211A, the contact surface 211 that contacts the tube 100 is formed with an arc shape in cross section which is concentric with the balls 5. Therefore, when the tube 100 is pressed and squashed by the balls 5, the top surface of the tube 100 that is in contact with the balls 5 and the bottom surface of the tube 100 that is in contact with the contact surface 211 of the tube guide groove 211A are flexed in an arcuate form along the shapes of the balls 5, so that it is possible to reliably and uniformly squashing the opening of the tube 100. Therefore, the pressing-and-squashing operations do not become unstable due to variations in the assembly operation and the like, thereby making it possible to easily assemble the liquid discharger.

(1-4) Since the contact surface 211 of the tube guide groove 211A is formed with an arc shape in cross section which is concentric with the balls 5, the center of the tube 100 dents along the contact surface 211 of the tube guide groove 211A, so that the positions of the balls 5 in a direction orthogonal to the center axis direction of the opening of the tube 100 are automatically guided. Therefore, the balls 5 can roll along the central axis of the opening of the tube 100, thereby making it possible to reliably press and squash the tube 100. Consequently, the precision of the discharge rate of the liquid discharger 1A can be made high.

(1-5) Since, of the portions of the tube guide groove 211A, the contact surface 211 which contacts the tube 100 is formed with an arc shape in cross section which is concentric with the balls 5, even if the relationship between the diameter of the balls 5 and the diameter of the tube 100 is not strictly considered, the discharge rate of the liquid discharger 1A can be made constant, so that the liquid discharger 1A can be made highly precise.

(1-6) Further, for the balls 5, bearing balls or the like that have been conventionally used may be used. Therefore, production costs are lower than the production cost of a conical roller.

(1-7) When the radius r of each ball 5 is less than R−2T, it becomes difficult to more reliably press and squash the tube 100. On the other hand, if the radius r of each ball 5 is greater than R−T, the portion of the opening of the tube 100 near the center becomes difficult to squash. Therefore, in order to squash even the portion of the opening of the tube 100 near the center thereof, a larger force is required to deform the tube 100. Consequently, when the balls roll on the tube, a large load is exerted upon the tube. In the embodiment, since the radius r of each ball 5 is equal to or greater than R−2T and less than R−T, such a problem does not occur.

(1-8) When the coefficient of friction between the balls 5 and the tube 100 is greater than the coefficient of friction between the tube guide groove 211A and the tube 100, rolling of the balls 5 may cause the tube 100 to move in the tube guide grove 211A. In contrast to this, in the embodiment, the coefficient of friction between the balls 5 and the tube 100 is less than the coefficient of friction between the tube guide groove 211A and the tube 100, so that such a problem does not occur. Accordingly, the balls 5 can roll while the tube 100 is kept at its predetermined portion.

(1-9) In the liquid discharger 1A, the area of contact between the balls 5 and the tube 100 is small, and the balls 5 produce rolling friction with respect to the tube 100 and the ball guide groove 214 and the rotor 3A, so that frictional loss is considerably reduced. Therefore, torque required to drive the rotor 3A can be reduced, so that the oscillating body 61, serving as a drive source, is made smaller in size. By this, the liquid discharger 1A can be made smaller in size.

(1-10) Since the balls 5 are pushed towards the tube 100 by the rotor body 31A, a large pushing force can be applied to the tube 100 through the balls 5, so that the tube 100 can be reliably pressed and squashed by the balls 5.

(1-11) Since a recess 312 is formed in the bottom surface of the rotor body 31A, and the balls 5 are disposed in the recess 312 and pushed, the balls 5 can be guided. In addition, by forming the recess 312, the thickness of the whole rotor body 31A can be restricted while a height at which the contact groove 321 can be formed is provided as the height of the ring 32. Therefore, the liquid discharger 1A can be made thinner.

(1-12) In the embodiment, since the balls 5 are pushed and rolled by the rotor 3A, the number of parts can be reduced compared to the case where a member for pushing the balls and a member for rolling the balls 5 are formed as separate component parts.

(1-13) Since the liquid discharger is constructed so that the balls 5 are pushed by the rotor 3A, the retainer 4A only needs to hold the balls 5 so that they can roll. Therefore, compared to the case where only the retainer 4A is used to hold the balls 5 and to cause the balls 5 to press the tube 100, the structure of the retainer 4A can be simplified, so that production thereof is simplified, thereby making it possible to reduce costs.

(1-14) Since the drive source of the rotor 3A is an oscillating body 61 which oscillates when alternating voltage is applied to the piezoelectric devices 611, the oscillation of the oscillating body 61 can be directly converted into rotation of the rotor 3A, so that energy loss due to the conversion can be reduced, thereby making it possible to rotationally drive the rotor 3A with high efficiency.

(1-15) Since the rotor 3A is directly driven by the oscillating body 61, a speed change mechanism or the like is not required, so that the liquid discharger 1A can be reduced in size. By this, production costs can also be reduced.

(1-16) Since an ordinary motor is not used for rotating the rotor 3A, there is no electromagnetic noise, or slight electromagnetic noise if there is any electromagnetic noise, such as that produced in an ordinary motor, so that this structure has the advantage that it does not affect devices near the liquid discharger.

(1-17) An arcuate cross section contact groove 321 is formed in the outer periphery of the ring 32 of the rotor 3A, and the protrusion 62 of the oscillating body 61 is caused to contact the contact groove 321. Therefore, the portion of the oscillating body 61 that contacts the contact groove 321 is guided by the contact groove 321, thereby making it possible to prevent the oscillating body 61 from becoming dislodged from the ring 32 due to a shift in the location of contact of the oscillating body 61 with the ring 32.

In addition, the contact groove 321 is arcuate in cross section, so that, even if the location of contact of the oscillating body 61 with the ring 32 is slightly shifted in the vertical direction, the state of contact between the oscillating body 61 and the ring 32 is maintained, so that loss in driving force does not occur.

(1-18) When the rotor 3A is not rotationally driven, the protrusion 62 is pushed against the ring 32. By friction force between them, the rotor 3A is prevented from rotating. Therefore, the rotor 3A does not reluctantly rotate in the reverse direction by, for example, pressure of the liquid inside the tube 100, so that it is possible to prevent the liquid inside the tube 100 from flowing in the reverse direction.

(1-19) The oscillating body 61 is thinner than the rotor 3A, so that the liquid discharger 1A can be made thinner.

(1-20) Since power is transmitted to the outer peripheral end surface of the rotor 3A by the driving mechanism 6, the liquid discharger 1A can be made thinner compared to the case where power is transmitted to the rotary shaft of the rotor 3A.

(1-21) Since the driving mechanism 6 comprises the oscillating body 61, it is possible to oscillate the oscillating body 61 in order to rotate the rotor 3A only by applying voltage to the piezoelectric devices 622, so that the driving mechanism 6 can operate at a lower speed than the case where a motor and a worm gear are used.

(1-22) In assembling the liquid discharger 1A, the tube 100 is mounted to the tube guide groove 211A in the base 2A, the retainer 4A is mounted above the tube 100, the balls 5 are held by the retainer 4A, and the rotor 3A is mounted above the balls 5. The component parts can be mounted and assembled from one direction, so that the assembly operation can be facilitated, and can be easily automated, so that productivity is increased. In particular, since it is not necessary to previously sub-assemble the retainer 4A and the balls 5, the assembly process can be simplified, so that productivity can be further increased.

Second Embodiment

Next, a second embodiment of the present invention will be described with reference to FIGS. 4 and 5.

In each of the following embodiments and modifications, component parts which are the same as or similar to those of the first embodiment are given the same reference numerals, and are not described or are only simply described.

Figure 4:
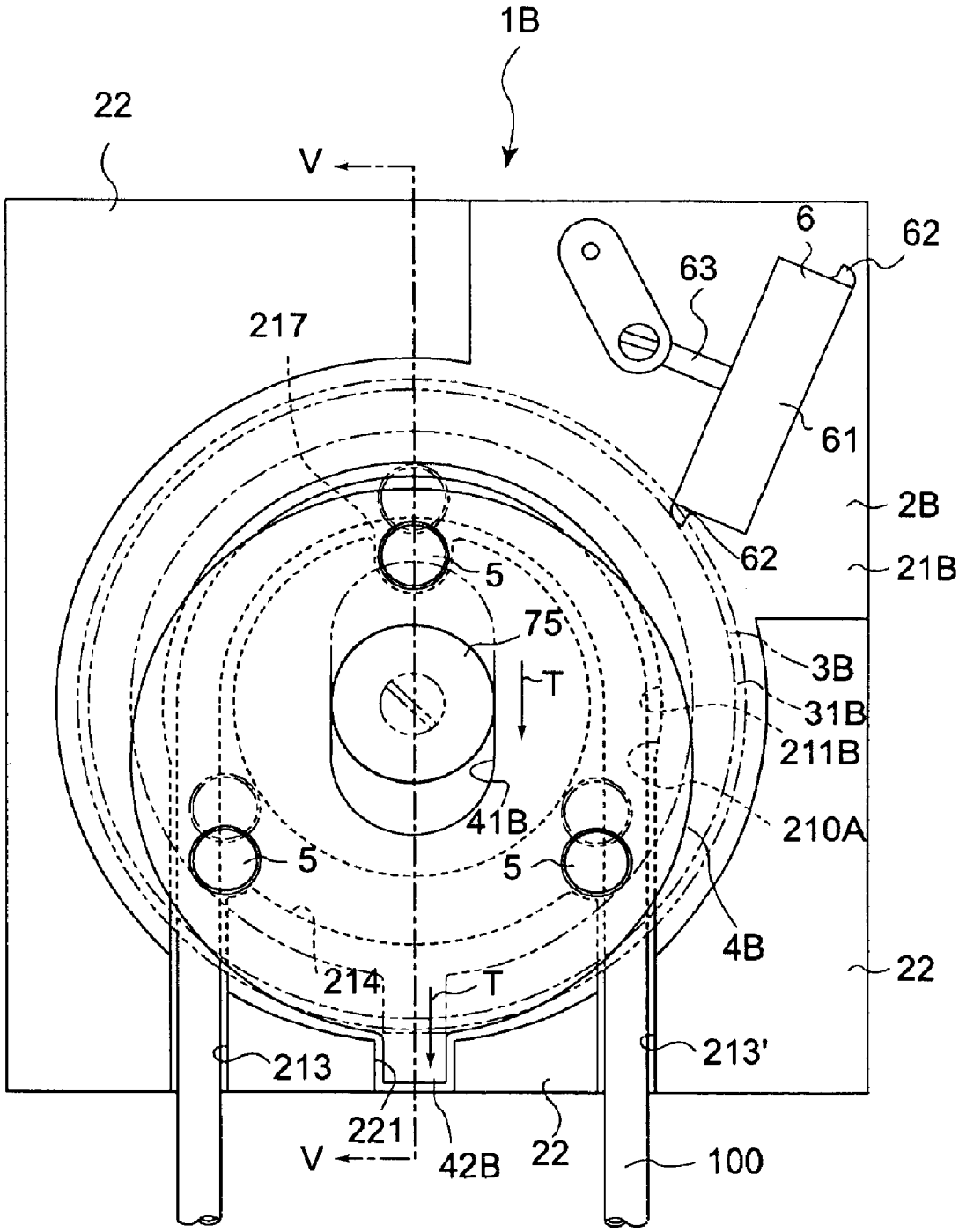
FIG. 4 is a plan view of a liquid discharger of a second embodiment of the present invention.
Figure 5:
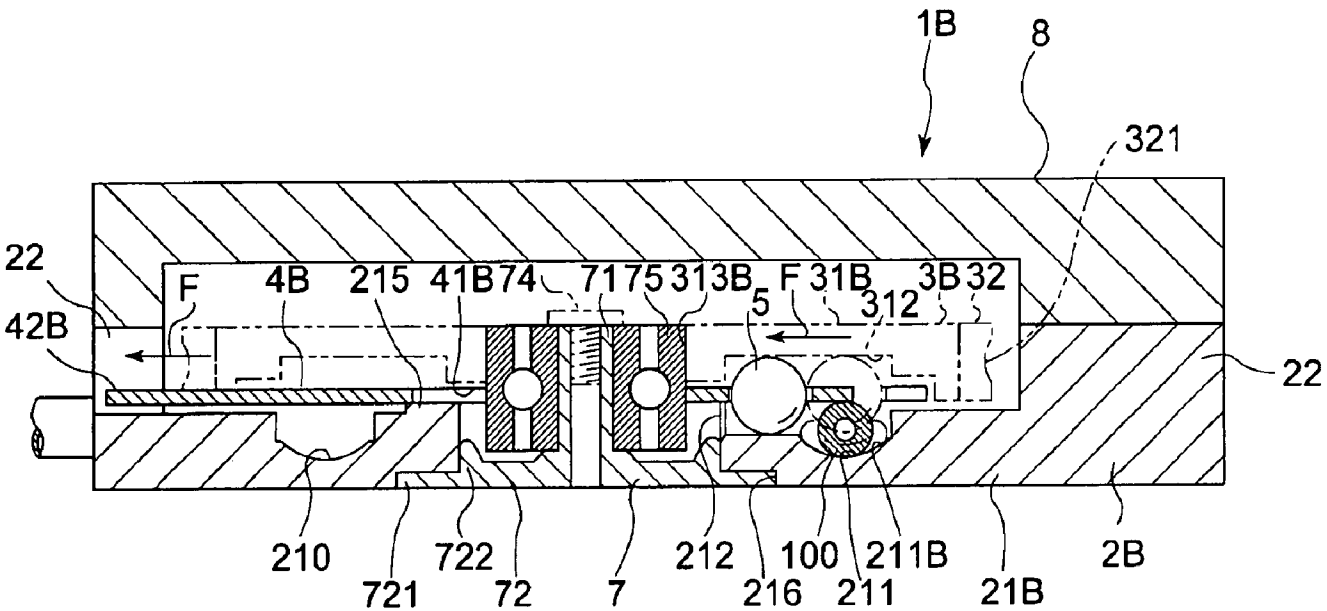
FIG. 5 is a sectional view taken along line V—V of FIG. 4.

In a liquid discharger 1B shown in FIGS. 4 and 5, the structures of a retainer 4B, a rotor 3B, and a tube guide groove 211B of a base 2B differ from the structures of the retainer 4A and the base 2A of the liquid discharger 1A of the first embodiment.

The tube guide groove 211B is formed in a base body 21B of the base 2B. A groove 221 used to operate a handle is formed between parallel linear grooves 213 and 213' of a wall 22. In addition, in the tube guide groove 211B, a groove 217 for holding a ball 5 is formed at a location opposite to the groove 221 with a shaft section 7 being disposed between the groove 221 and the groove 217. The holding groove 217 has the form of a recess for holding one ball 5 and extending from the side surface defining the tube guide groove 211B towards the shaft section 7. The holding groove 217 is formed shallower than the tube guide groove 211B by an amount corresponding to the thickness of a tube 100, so that only one ball 5 can be held in the groove 217.

Similarly, even at portions where a circular groove 214A and parallel linear grooves 213 and 213' intersect, as shown in FIG. 4, the wall 22, where ball guide groove 214 is formed, is cut so that a ball 5 which is ordinarily at a location indicated by two concentric dotted circles in FIG. 4 can move to a location indicated by corresponding solid line circles.

A shaft hole 41B of the retainer 4B is formed with an elliptical shape. Similarly, a shaft hole 313B of a rotor body 31B of the rotor 3B is formed with an elliptical shape. A handle 42B which protrudes outwardly of the inner periphery of the retainer 4B is provided at a portion of the retainer 4B, and is disposed in the groove 221.

Here, when the handle 42B which is provided at the retainer 4B is pulled in the direction of arrow T (in a direction orthogonal to a shaft body 71 of the shaft section 7), the locations where the retainer 4B and balls 5 are placed are moved in the direction of arrow T, so that the ball 5 that is completely on the tube 100 moves into the holding groove 217 and away from the top surface of the tube 100. By this, a pressing-and-squashing operation of the ball 5 on the tube 100 is cancelled.

Preferably, only a portion of each of the other two balls is always disposed on the tube 100, the tube 100 is formed with a circular shape, and the balls 5 are spheres, so that the tube 100 is barely pressed and squashed by these balls. Even if the retainer 4B slides, the balls 5 only move in the direction of extension of the tube 100, so that the positional relationships between the balls 5 and the tube 100 are almost the same. Therefore, the tube 100 is not pressed and squashed even by these balls 5. Consequently, by pulling out the retainer, the pressing-and-squashing operation on the tube 100 by the ball 5 can be cancelled.

In order to pull out the retainer 4B, the handle 42B must be positioned in the groove 221. This can be achieved by, for example, providing a switch which can control driving of an oscillating body 61, and rotating the retainer 4B by moving the ball 5 while it is rotated as the rotor 3B rotates as a result of driving the oscillating body 61 until the handle 42B can be seen from the groove 221; or by providing a sensor which can detect the position of the handle 42B, that is, the angle of rotation of the retainer 4B and setting a control mode in which the handle 42B automatically stops at the groove 221.

On the other hand, when using the liquid discharger 1B, the retainer 4B and the balls 5 are set at predetermined locations by pushing in the handle 42B. At this time, the handle 42B is positioned below the rotor 3B, and barely protrudes outwardly of the inner periphery of the rotor 3B. Therefore, the retainer 4B rotates without bumping into the wall 22 of the base 2B, etc.

Here, the balls 5 are guided by the tube guide groove 211B and the ball guide groove 214, so that, unless they are at the locations shown in FIG. 4, they cannot slide. Therefore, even if the shaft hole 41B of the retainer 4B is a slotted hole, the retainer 4B rotates smoothly.

In addition, a contact surface 211 defining the tube guide groove 211B is formed with an arc shape, and the top surface of the tube 100 with which a ball 5 is in contact is also curved along the ball 5. Therefore, unless a large force is exerted, such as when the handle 42B is pulled, the ball 5 is also guided by the tube 100 and rolls along the tube 100.

The second embodiment can provide the following advantages in addition to the advantages similar to those of the first embodiment.

(2-1) A ball 5 is removed from the top surface of the tube 100 by pulling the handle 42B that is provided at the retainer 4B, so that the pressing-and-squashing operation of the ball 5 on the tube 100 can be cancelled. Therefore, when the liquid discharger 1B is not used or during the period of time until a user starts using the liquid discharger 1B, by sliding the retainer 4B, it is possible to prevent the tube 100 from becoming deformed. Consequently, unlike the case where the tube 100 is pressed and squashed for a long period of time, deterioration of the tube 100 is not accelerated, thereby making it possible to make the liquid discharger 1B more durable. In addition, since it is possible to prevent the tube 100 from becoming deformed, errors occurring in the discharge rate can be reduced.

(2-2) Since the shaft holes of the retainer 4B and the rotor 3B are slotted holes, and the retainer 4B can be constructed so that it can slide by only forming a handle 42B at the retainer 4B, the structure can be made very simple, so that an increase in costs can be restricted.

(2-3) Unless the handle 42B is positioned in the groove 221, the retainer 4B cannot slide, and when the handle 42B is pushed in, the ball 5 that has moved onto the tube 100 automatically returns to its predetermined position because the top surface of the tube 100 is curved. Therefore, the retainer 4B can be moved in and out by the user of the liquid discharger 1B by a simple operation.

Third Embodiment

Next, a description of a third embodiment of the present invention will be given with reference to FIG. 6.

Figure 6:
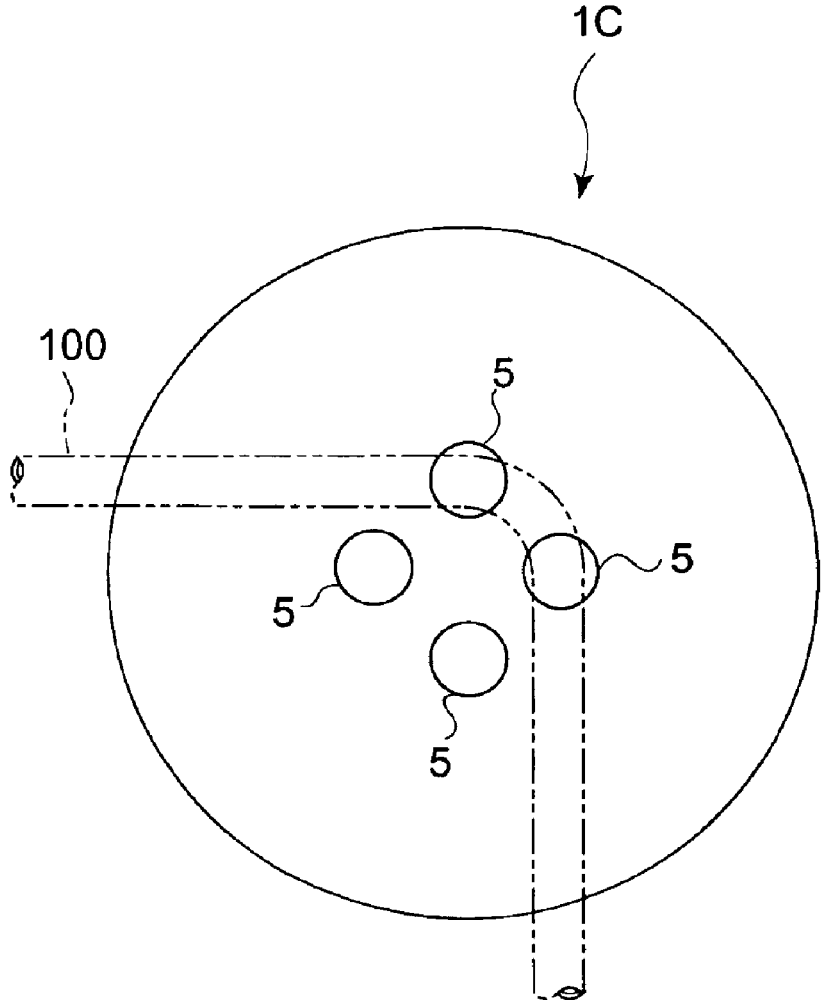
FIG. 6 is a schematic view of a liquid discharger of a third embodiment of the present invention.

FIG. 6 is a schematic view of a liquid discharger 1C of the third embodiment. The liquid discharger 1C differs from the liquid dischargers 1A and 1B of the previous embodiments in that a tube 100 is disposed by bending it at an angle of substantially 90 degrees, and in that four balls 5 are used.

The distance from a shaft section (not shown) to the balls 5 is smaller than the distance from the shaft section 7 to the balls 5 in the previous embodiments.

Therefore, the third embodiment can provide the following advantages in addition to the advantages similar to those of the first embodiment.

(3-1) Liquid can be reliably discharged with a small discharge rate. In other words, when one wants to make the liquid discharge rate small, the distance of movement of the balls 5, that is, the radius measured from the shaft may be made small in the previous embodiments. However, the bending angle of the tube 100 when the tube 100 is disposed in the form of a U shape is very small, so that the opening of the tube 100 is blocked when the tube 100 is bent, so that the liquid may no longer be reliably discharged.

In contrast to this, when, as in this embodiment, the bending angle of the tube 100 is 90 degrees, even if the distance from the shaft section to the balls 5 is made small, the opening of the tube 100 is not squashed, so that a small amount of liquid can be reliably discharged.

(3-2) When the radius from the rotary shaft to the balls 5 is small, torque for pressing and squashing the tube 100 by driving the balls 5 can be made small. Therefore, an output of the driving means, such as a motor or the oscillating body 61, for driving the rotor 3A, can be made small, so that the driving means, that is, the liquid discharger 1C can be made small in size.

Fourth Embodiment

Next, a description of a fourth embodiment of the present invention will be given with reference to FIGS. 7 to 10.

Although the liquid dischargers 1A to 1C of the above-described embodiments comprise corresponding retainers 4A and 4B, a liquid discharger 1D of the fourth embodiment does not comprise a retainer.

Figure 7:
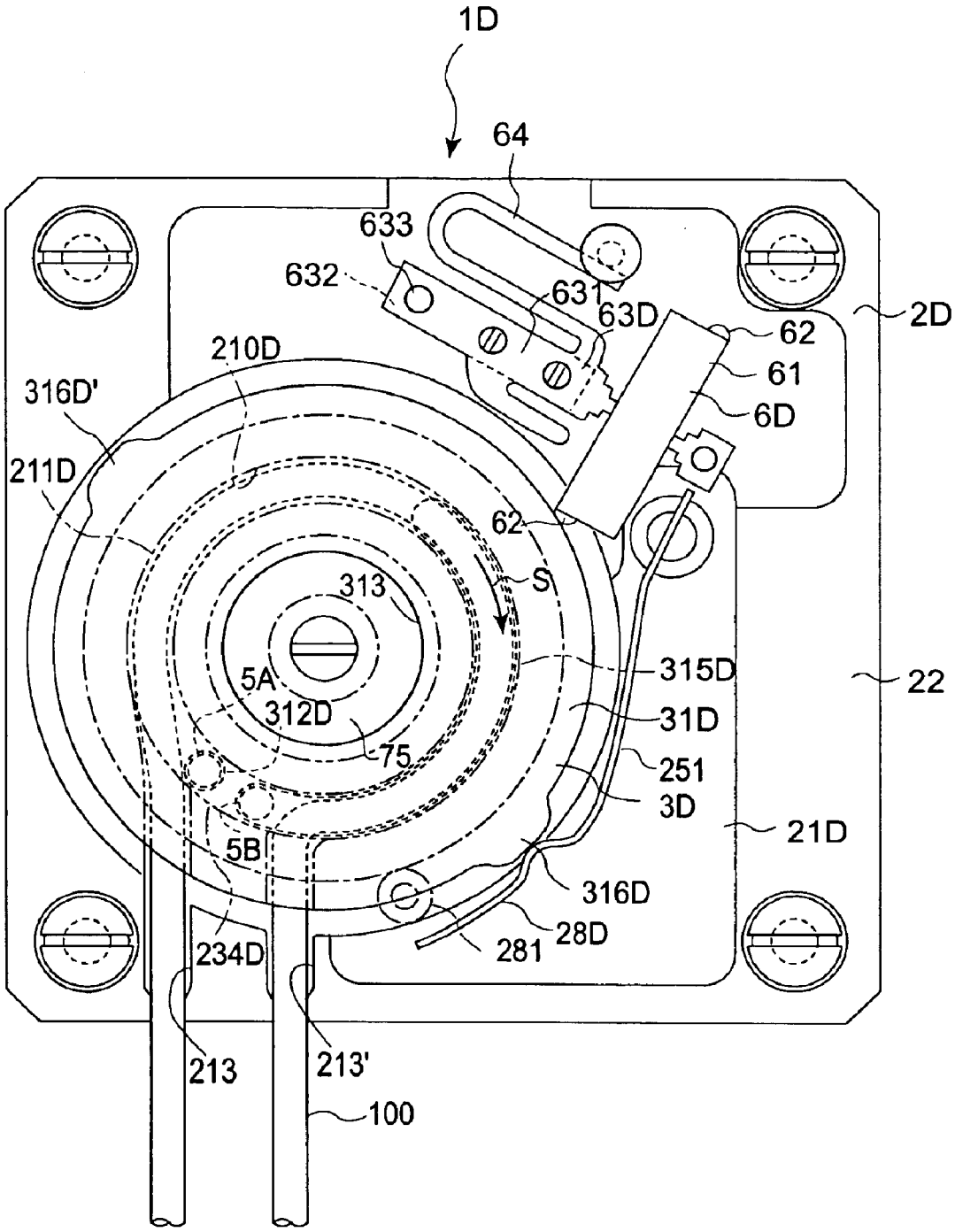
FIG. 7 is a plan view of a liquid discharger of a fourth embodiment of the present invention.
Figure 8:
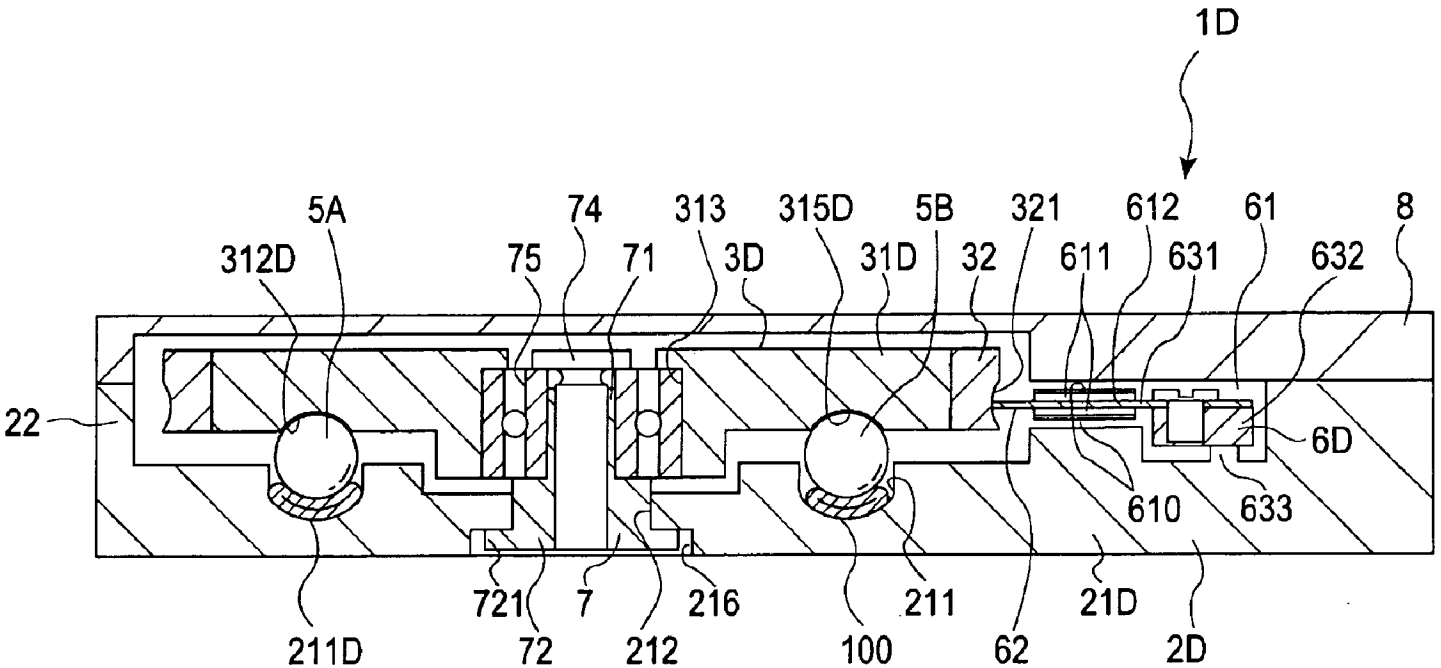
FIG. 8 is a sectional view of FIG. 7.
Figure 9:
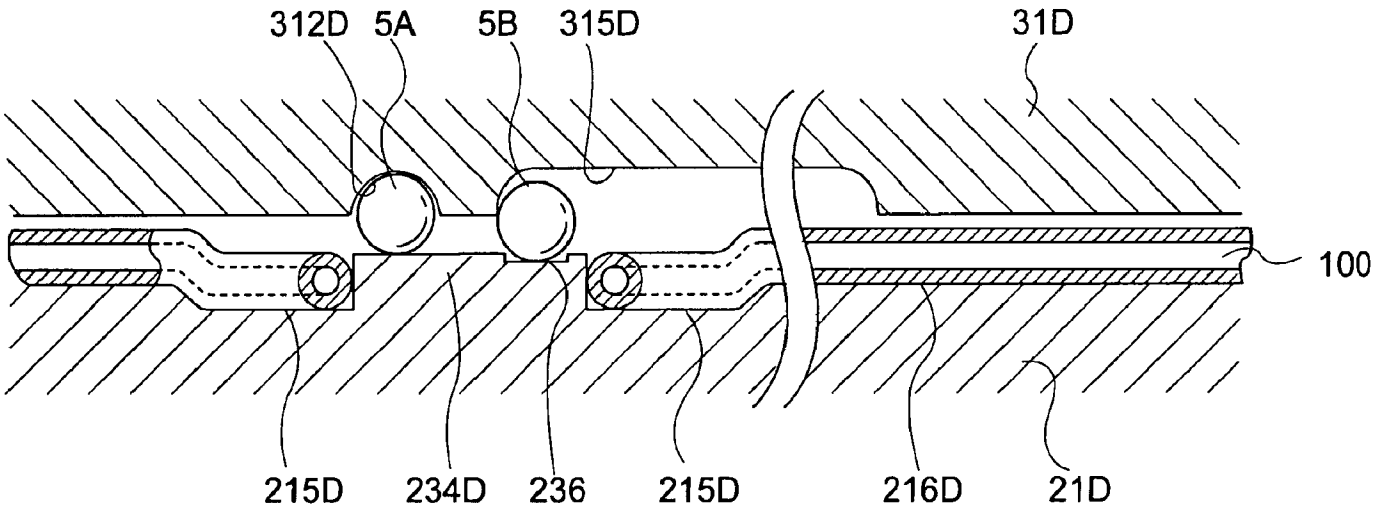
FIG. 9 is a sectional view of a development as seen from the outside along a tube used in the fourth embodiment.

As shown in FIGS. 7 to 9, the liquid discharger 1D comprises two balls, a first ball 5A and a second ball 5B. The first and second balls 5A and 5B are of the same type as the balls 5 used in the above-described previous embodiments.

A planar circular groove 210D is formed in a base body 21D. As in the first embodiment, two parallel linear grooves 213 and 213' which connect to the circular groove 210D and to the outside of a base 2D are formed. A tube 100 is not disposed at a semicircular portion of the circular groove 210D at the side of the groove 213 and 213'. The tube 100 is mounted along the grooves 213 and 213' and in a substantially U-shape (or circular shape) form along a semicircular portion of the planar circular groove 210D that is not situated at between parallel linear grooves 213 and 213'. Therefore, the outer perimeter of a semicircular portion of the circular groove 210D not between parallel liner grooves 213 and 213' form a tube guide groove 211D. Like the tube guide grooves 211A and 211B used in the previous embodiments, the tube guide groove 211D has an arc shape in cross section.

With reference to FIGS. 7 and 9, a ball placing section 234D is formed at the circular groove 210D of the base 2D. Of the portions of the tube guide groove 211D, bottom surfaces 215D at both sides of the ball placing section 234D are formed so that the top surface of the part of the tube 100 disposed on the bottom surfaces 215D, and the top surface of the ball placing section 234D are at substantially the same height level. A second bottom surface 216D of the tube guide groove 211D (on which tube 100 also lies) is at a higher level than the first bottom surfaces 215D by about ½ of the radius of tube 100.

Therefore, the tube 100 is pressed and squashed by the first ball 5A or the second ball 5B and the second bottom surface 216D of the tube guide groove 211D.

The ball placing section 234D does not have tube 100 disposed on it, that is, it is displaced from tube 100, so that it serves as an initial position for the first ball 5A and the second ball 5B. A cavity 236 is formed in the portion of the ball placing section 234D where the second ball 5B is placed. The height from the cavity 236 to a ball guide groove 315D of a rotor body 31D (described later) is greater than the diameter of the second ball 5B.

Continuing the description with reference to FIGS. 7 and 8, a recess 312D (FIG. 7), which is a ball mounting section, and the ball guide groove 315D (FIG. 8) are formed in a tube-100-side surface of the rotor body 31D of a rotor 3D.

The recess 312D holds the first ball 5A so that it can roll. The recess 312D has a form with a size that can hold only the first ball 5A. The recess 312D is formed at a location in correspondence with the location of the circular groove 210D, and, in an initial state, is positioned above the ball placing section 234D (FIG. 9). Therefore, the first ball 5A held by the recess 312D is disposed on the ball placing section 234D.

The ball guide groove 315D is formed along the circular groove 210D. In other words, the ball guide groove 315D is formed with an arc shape with the center of rotation of the rotor 3D as a center. The second ball 5B is movably placed in the ball guide groove 315D.

As shown in FIGS. 7 and 9, the front-side end of the ball guide groove 315D in a forward-rotation-direction as indicated by arrow S (i.e. the forward-rotation-direction front-end) is disposed close to the recess 312D. That is, the forward-rotation-direction front-end of ball guide groove 315D is shown in FIG. 9 as the end of ball guild groove 315D in contact with ball 5B. In an initial state, the forward-rotation-direction front-end of ball guide groove 315D is positioned over the cavity 236 of the ball placing section 234D. Therefore, in the initial state, the second ball 5B, which has been placed at the forward-rotation-direction front-end of the ball guide groove 315D, is disposed in the cavity 236 of the ball placing section 234D.

The back-side end of the ball guide groove 315D in the forward-rotation-direction (i.e. the forward-rotation-direction back-end) is disposed opposite to (or 180 degrees from) recess 312D (which hold first ball 5A) with a shaft hole 313 disposed therebetween. In the initial state, the forward-rotation-direction back-end is positioned above tube 100, which is disposed in circular groove 210D (see FIG. 9).

Recess 312D and ball guide groove 315D move above the circular groove 210D with the rotation of the rotor body 31D.

Protrusions 316D and 316D' (shown in FIG. 7) are formed at the outer peripheral edge of the rotor body 31D so as to protrude in a planar direction defined by the plane of rotor body 31*d*. The protrusions 316D and 316D' form rotation detecting means 28D, described below. The protrusion 316D is formed opposite to, or 180 degrees from, the protrusion 316D', with the shaft hole 313 being disposed therebetween.

With reference to FIG. 7, the structure of an arm 63D of a driving mechanism 6D is different from the structure of the arm 63 used in the first embodiment. The arm 63D comprises an arm body 631 for supporting substantially the center of a reinforcing plate 612 of an oscillating body 61, and an arm supporting section 632 for supporting the arm body 631 mounted to the base 2D. A pin 633, provided at the base 2D, is inserted in the arm supporting section 632, so that the arm supporting section 632 can rotate upon the pin 633 as a center. The arm body 631 is mounted to the arm supporting section 632 with a screw, and, at an end thereof opposite to the pin 633, supports substantially the center of the reinforcing plate 612 in the lengthwise direction.

A spring member 64 is rotated with the pin 633 as center by biasing the arm 63D towards the rotor 3D in order to bring a protrusion 62 of the oscillating body 61 supported by the arm 63D into contact with a contact groove 321.

The liquid discharger 1D of the embodiment comprises the rotation detecting means 28D for detecting the rotation of the rotor 3D. The rotation detecting means 28D comprises the aforementioned protrusions 316D and 316D', a plate spring 251, and a detecting section 281.

The detecting section 281 is provided so as to protrude upward from the base body 21D. When the detecting section 281 is brought into an electrically connected state by coming into contact with an end of the plate spring 251, it detects the rotating speed of the rotor 3D.

In other words, when an end of the plate spring 251 is in contact with a portion other than the protrusions 316D and 316D' of the rotor body 31D, the detecting section 281 is brought into contact with the plate spring 251. When an end of the plate spring 251 is pushed outwardly of the rotor body 31D by protrusions 316D and 316D', the detecting section 281 is disposed at a location where it is out of contact with the plate spring 251.

Therefore, every time the rotor 3D undergoes half a rotation, an end of the plate spring 251 is pushed by protrusions 316D and 316D', is swung, and is brought out of contact with the detecting section 281, so that the rotation of the rotor 3D can be detected every half a rotation of the rotor 3D.

Such liquid discharger 1D discharges liquid in the following way.

Figure 10:
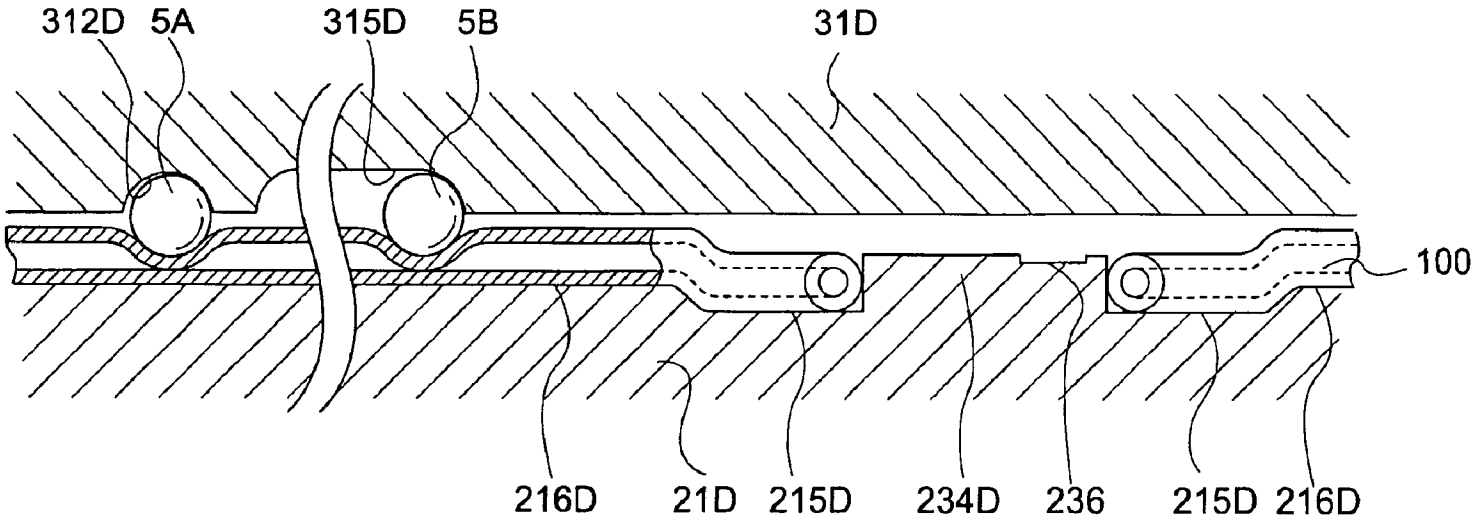
FIG. 10 is a sectional view of a development as seen from the outside along the tube used in the fourth embodiment.

As shown in FIG. 9, in the initial state, the first ball 5A and the second ball 5B are disposed on the ball placing section 234D. When the rotor 3D is rotated in the forward direction (in the direction of arrow S in FIG. 7), the first ball 5A held in the recess 312D rolls onto the tube 100. On the other hand, since the second ball 5B, which is placed in the cavity 236, initially remains idle even as the rotor 3D rotates, so that the second ball 5B does not move from the cavity 236. When the rotor 3D rotates further in the forward direction, as shown in FIG. 10, the second ball 5B comes into contact with, and is held by, the forward-rotation-direction back-end of the ball guide groove 315D. This causes the second ball 5B to roll onto tube 100. Therefore, the forward-rotation-direction back-end of the ball guide groove 315D is a ball holding section for holding the second ball 5B so that it can roll.

As described above, the first ball 5A and the second ball 5B press and squash the tube in order to discharge a predetermined amount of liquid.

On the other hand, after use of the liquid discharger 1D, the rotor 3D rotates in the reverse direction. In this case, when the rotor 3D rotates in the reverse direction, the first ball 5A held in the recess 312D rolls towards its initial position. The second ball 5B separates from the forward-rotation-direction back-end of ball guide groove 315D, and remains where it is until it comes into contact with the forward-rotation-direction front-end of the ball guide groove 315D. When the rotor 3D rotates even further, the forward-rotation-direction front-end of the ball guide groove 315D pushes the second ball 5B, so that the second ball 5B is guided to its initial position 236, shown in FIG. 9.

Accordingly, in the embodiment, the ball guide groove 315D of the rotor 3D becomes a leading means for leading the second ball 5B from its initial position to the forward-rotation-direction back-end of the ball guide groove 315D, which serves as a ball holding section. In addition, as the ball guide groove 315D is rotated backwards and its forward-rotation-direction front-end comes into contact with the second ball 5B, the ball guide groove 315D becomes a leading-away means for returning the second ball 5B from the forward-rotation-direction back-end to it's the second ball's initial position 236.

Therefore, the fourth embodiment can provide the following advantages in addition the advantages (1-1) to (1-10), (1-12), and (1-14) to (1-21) of the first embodiment.

(4-1) In the initial states, the first ball 5A and the second ball 5B are not on the tube 100, so that they do not press and squash the tube 100. Therefore, it is possible to prevent plastic deformation of the tube 100. In addition, after use, the balls 5A and 5B can easily be returned to their initial positions by only rotating the rotor 3D in the reverse direction. Therefore, it is possible to prevent plastic deformation of the tube 100 not only during the period of time from the time after the assembly of the liquid discharger at a plant to the time the user starts to use the liquid discharger, but also after the user has once used the liquid discharger. Therefore, since, as mentioned above, plastic deformation of the tube 100 can be prevented, it is possible to reduce errors occurring in the discharge rate.

(4-2) In the case where a cavity 236 is not formed in the ball placing section 234D, when the rotor 3D is rotated in the forward direction, the second ball 5B on the ball placing section 234D may move before the forward-rotation-direction back-end defining the ball guide groove 315D comes into contact therewith. Moreover, the second ball 5B may roll down onto the tube 100 from the ball placing section 234D.

The second ball 5B may roll down from the ball placing section 234D even when the first ball 5A and the second ball 5B are being returned to their initial positions by the rotation of the rotor 3D in the reverse direction.

In contrast to this, in the embodiment, since a cavity 236 is formed, when the rotor 3D is rotated, the second ball 5B does not move until the forward-rotation-direction back-end defining the ball guide groove 315D comes into contact with the second ball 5B. Therefore, the discharge rate of the liquid discharger 1D can be made precise.

In addition, even when the rotor 3D is rotated in the reverse direction, the second ball 5B does not fall off the ball placing section 234D because it stays in the cavity 236.

(4-3) In the embodiment, the balls 5A and 5B are held by the rotor body 31D, so that a retainer is not required, thereby making it possible to reduce the number of component parts.

(4-4) Since the detecting means 28D comprises a plate spring 251, protrusions 316D and 316D', and a detecting section 281, the rotating speed of the rotor body 31D can be easily computed by detecting the protrusions 316D and 316D', disposed at a predetermined interval on the rotor body 31D, by the detecting section 281.

In addition, since a recess 312D and a ball guide groove 315D for holding the balls 5A and 5B, respectively, are formed in the rotor body 31D, the balls 5A and 5B do not slip and move with respect to the rotor body 31D, so that the balls 5A and 5B can reliably move when the rotor body 31D rotates. Therefore, by detecting the amount of rotation (rotating speed) of the rotor body 31D, the amounts of movement of the balls 5A and 5B, that is, the liquid discharge rate can be precisely known, so that the discharge rate can be controlled with high precision.

(4-5) Since the detecting section 281 is formed so that it can be brought into electrical connection with the plate spring 251 within a range in which an end of the plate spring 251 swings, the rotating speed of the rotor 3D can be easily computed by only detecting the state of electrical connection state of the detecting section 281.

(4-6) Since the top surface of the ball placing section 234D and the top surface of the tube 100 disposed on the bottom surfaces 215D are substantially at the same height, large changes in load do not occur when the first ball 5A and the second ball 5B move onto the tube 100. Therefore, the rotor 3D can rotate smoothly.

Fifth Embodiment

Figure 11:
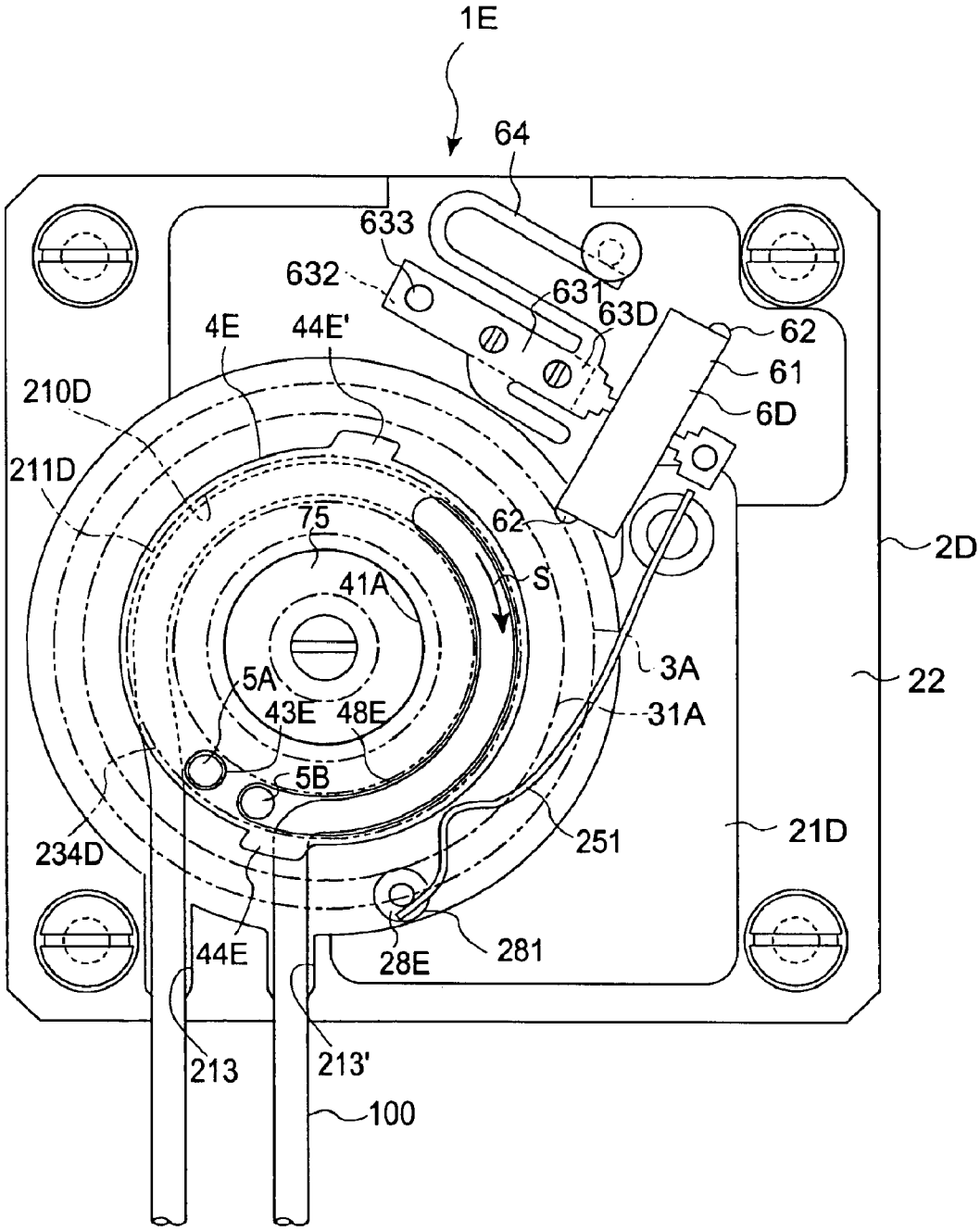
FIG. 11 is a plan view of a liquid discharger of a fifth embodiment of the present invention.

Next, a description of a fifth embodiment will be given with reference to FIG. 11.

In the fourth embodiment, a retainer is not provided. A recess 312D and the like are formed in the tube-100-side surface of the rotor body 31D, and are used to roll the first and second balls 5A and 5B. A liquid discharger 1E of this embodiment differs from the liquid discharger 1D of the fourth embodiment in that it comprises a retainer 4E, which is used to roll first and second balls 5A and 5B while it holds them.

The retainer 4E includes a ball mounting section 43E formed so as to pass through the front and back surfaces of the retainer 4E and a ball guide groove 48E.

The ball mounting section 43E is slightly larger than the first ball 5A, and holds the first ball 5A so that it can roll. The ball mounting section 43E is formed at a location corresponding to that of a circular groove 210D. In an initial state, the ball mounting section 43E is positioned above a ball placing section 234D. Therefore, the first ball 5A held by the ball mounting section 43E is in its initial state disposed on the ball placing section 234D.

The ball guide groove 48E is formed along the circular groove 210D. In other words, the ball guide groove 48E is formed with an arc shape with the center of rotation of the retainer 4E as a center. The second ball 5B is movably placed in this ball guide groove 48E.

A forward-rotation-direction front-side end (forward-rotation-direction front-end) of the ball guide groove 48E is disposed close to the ball mounting section 43E. In the initial state, the front-end is disposed above a cavity 236 of the ball placing section 234D. Therefore, in the initial state, the second ball 5B disposed at the forward-rotation-direction front-end of the ball guide groove 48E is disposed in the cavity 236 of the ball placing section 234D.

A forward-rotation-direction back-side end (forward-rotation-direction back-end) of the ball guide groove 48E is positioned opposite to, or 180 degrees from, the ball mounting section 43E with a shaft hole 41A being disposed between them. In the initial state, the forward-rotation-direction back-end is positioned above the tube 100 placed in the circular groove 210D.

Such ball mounting section 43E and ball guide groove 48E move above the circular groove 210D by the rotation of a rotor body 31A.

Protrusions 44E and 44E' are formed at the outer peripheral edge of the retainer 4E so as to protrude in the planar direction. Rotating speed of the retainer 4E is detected using the protrusions 44E and 44E'. The protrusions 44E and 44E' are formed opposite each other or 180 degrees from each other with a shaft section 7 being disposed therebetween. The protrusions 44E and 44E', a plate spring 251, and a detecting section 281 form rotation detecting means 28E.

Such liquid discharger 1E discharges liquid in the following way.

As in the fourth embodiment, in the initial states, the first ball 5A and the second ball 5B are disposed on the ball placing section 234D. When the rotor 3D is driven, forward rotation of the retainer 4E (in the direction of arrow S) causes the first ball 5A held by the ball mounting section 43E to roll on the tube 100. On the other hand, the second ball 5B is placed in the cavity (not shown), so that, even if the retainer 4E rotates, it does not move out of the cavity. When the retainer 4E rotates further, the second ball 5B comes into contact with and is held by the forward-rotation-direction back-end of the ball guide groove 48E, and rolls on the tube 100. Therefore, the forward-rotation-direction back-end of the ball guide groove 48E becomes a ball holding section for holding the second ball 5B.

Accordingly, the first ball 5A and the second ball 5B press and squash the tube in order to discharge a predetermined amount of liquid.

On the other hand, after a user finishes using the liquid discharger 1E, as in the fourth embodiment, the rotor 3D is rotated in the reverse direction in order to return the first ball 5A and the second ball 5B to their initial positions. Therefore, in the embodiment, the ball guide groove 48E of the retainer 4E becomes leading means for leading the second ball 5B from its initial position to the forward-rotation-direction back-end serving as a ball holding section. In addition, the ball guide groove 48E becomes leading-away means for returning the second ball 5B from the forward-rotation-direction back-end serving as a ball holding section to its initial position.

Therefore, the fifth embodiment can provide the following advantages in addition to the advantages (1-1) to (1-22) of the first embodiment and the advantages (4-2) and (4-6) of the fourth embodiment.

(5-1) In the initial states, since the first ball 5A and the second ball 5B are not disposed on the tube 100, it is possible to prevent plastic deformation of the tube 100. After use, the balls 5A and 5B can be returned to their initial positions by rotating the retainer 4E in the reverse direction. Therefore, it is possible prevent plastic deformation of the tube 100 not only during the period of time from the time after assembly of the liquid discharger at a plant to the time the user starts to use the liquid discharger, but also after the user has once started using the liquid discharger. Consequently, since it is possible to prevent plastic deformation of the tube 100, errors occurring in the discharge rate can be reduced.

(5-2) Since the detecting means 28E comprises a plate spring 251, protrusions 44E and 44E', and a detecting section 281, the rotating speed of the retainer 4E can be easily computed by detecting the protrusions 44E and 44E', disposed at a predetermined interval on the retainer 4E, by the detecting section 281. In addition, since only the electrical connection state of the detecting section 281 needs to be detected to detect the rotating speed, the rotating speed can be easily detected.

(5-3) In this embodiment, since the balls 5A and 5B are held by the retainer 4E, the distance between the balls 5A and 5B can be precisely maintained, so that the liquid discharge rate can be made precise.

In addition, since the retainer 4E rotates integrally with the balls 5A and 5B, the balls 5A and 5B can move reliably as the retainer 4E rotates. Therefore, by detecting the amount of rotation (rotating speed) of the retainer 4E, the amounts of movement of the balls 5A and 5B, that is, the liquid discharge rate can be precisely known, so that the discharge rate can be controlled with high precision.

Sixth Embodiment

Next, a description of a sixth embodiment of the present invention will be given with reference to FIGS. 12 to 18.

Like the liquid dischargers of the first to third embodiments, a liquid discharger 1F of this embodiment comprises a rotor 3F and a retainer 4F.

Figure 12:
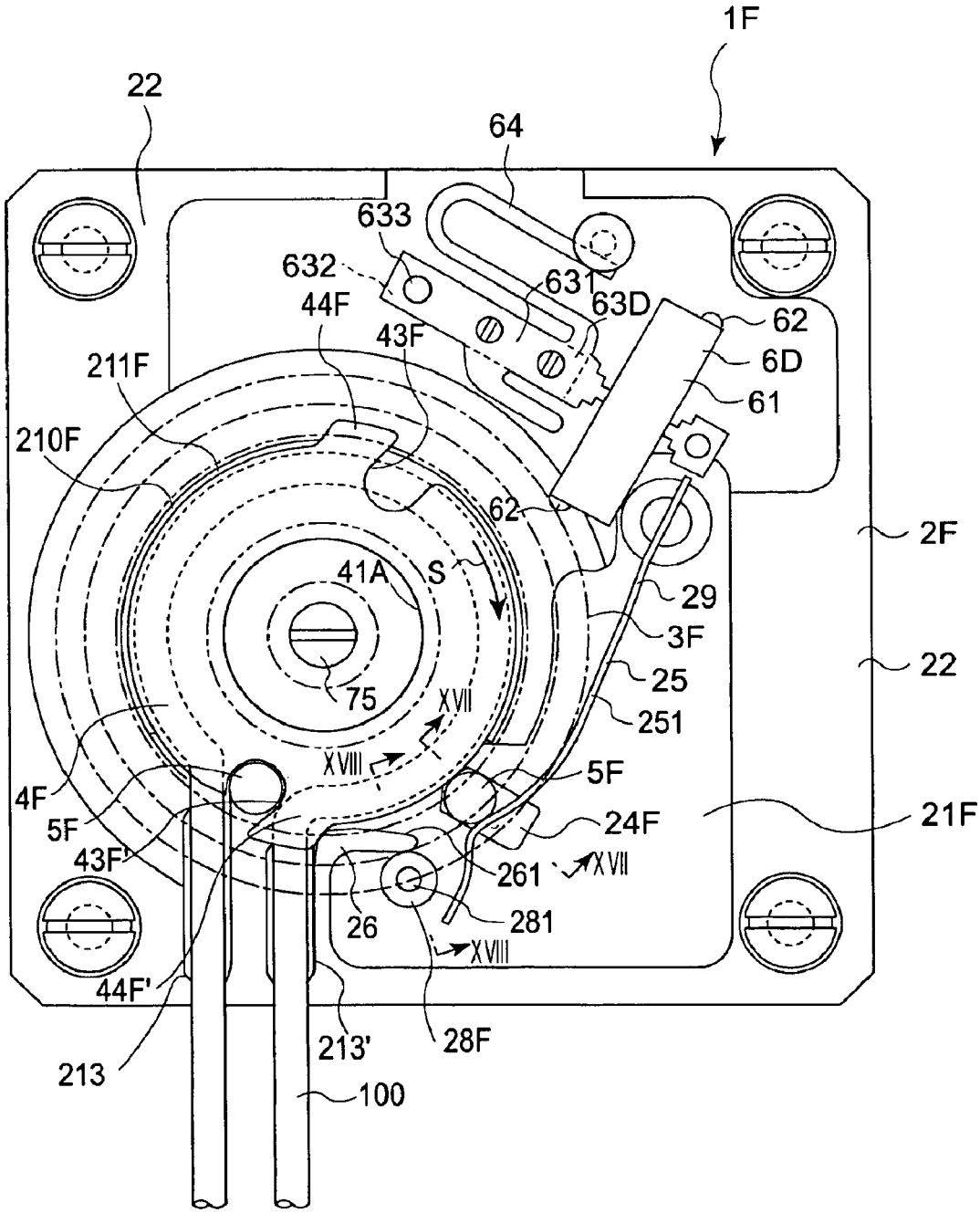
FIG. 12 is a plan view of a liquid discharger of a sixth embodiment of the present invention.
Figure 13:
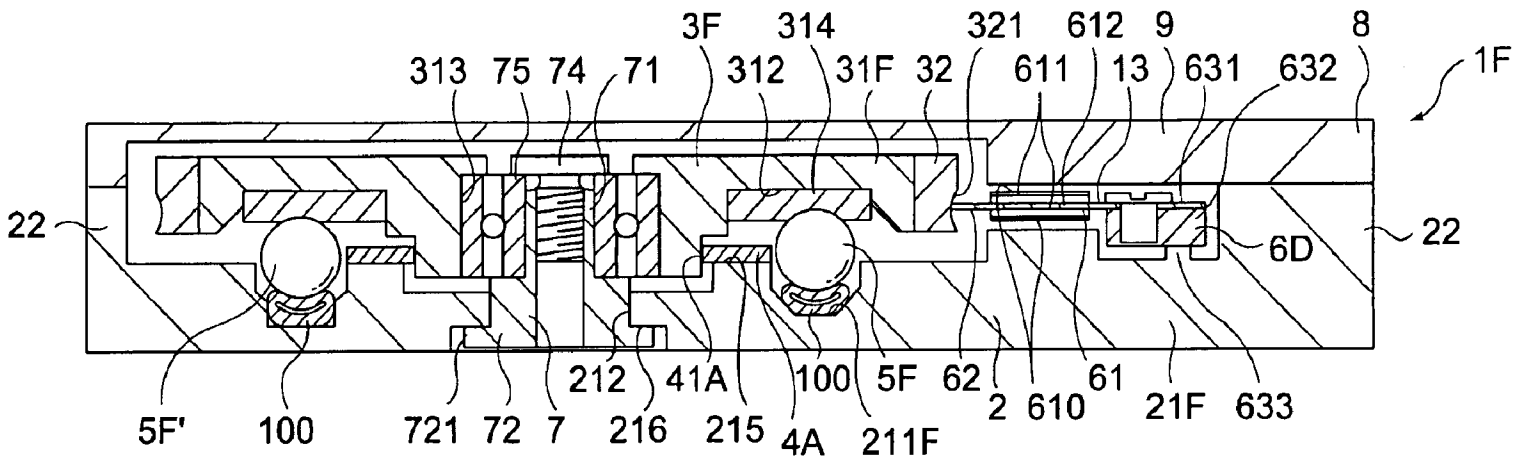
FIG. 13 is a sectional view of FIG. 12.

As shown in FIGS. 12 and 13, the retainer 4F has a disc shape, and is provided substantially parallel to and rotatable with respect to a base 2F with a shaft section 7 as center. In plan view, the outer peripheral edge of the retainer 4F is such as to extend between a tube 100 and an initial position of a lead-in ball 5F (described later).

The retainer 4F comprises at the outer peripheral edge thereof two ball holding sections 43F and 43F' for holding balls 5F and 5F', and catch sections 44F and 44F' provided near the ball holding sections 43F and 43F', respectively. The balls 5F and 5F' are of the same type as the balls 5 used in the first embodiment.

The ball holding sections 43F and 43F' are provided opposite to or 180 degrees apart from each other with a shaft hole 41A being disposed therebetween. These ball holding sections 43F and 43F' are provided at equal distances from the shaft hole 41A, that is, at locations that always allow them to pass above a portion of a circular groove 210F at a tube guide groove 211F as the retainer 4F rotates. A shaft of the rotor 3F, secured to a ball bearing 75, is loosely fitted to the shaft hole 41A of the retainer 4F. In this state, the bottom surface of the retainer 4F is placed on a protrusion 215 of the base 2F. By this, the retainer 4F is rotatable with respect to the base 2F.

There are two types of balls, the lead-in ball 5F which is held by the ball holding section 43F and the ball 5F' which is held by the ball holding section 43F'. Of the balls 5F and 5F', the lead-in ball 5F is initially disposed in a lead-in ball disposition groove 24F (FIGS. 12 and 17), described below, in a base body 21F and is led into the ball holding section 43F from the lead-in ball disposition groove 24F.

The ball holding section 43F is formed by cutting away a portion of the retainer 4F in a substantially U shape from the outer peripheral edge of the retainer 4F to a location above the tube 100. By this, at the initial position, the lead-in ball 5F can move into and out of the ball holding section 43F from a direction crossing the direction of rotation of the retainer 4F (in the radial direction of the retainer 4F), and can be held at the end surfaces defining the cutaway portion of the retainer 4F so that it can roll. In order to gradually move the lead-in ball 5F towards the back (center of rotation of the retainer 4F) as the retainer 4F rotates, the cutaway portion that forms the ball holding section 43F is angled in the direction of rotation of the retainer 4F.

The ball holding section 43F' is formed by cutting away a portion of the retainer 4F above the tube 100 to a size slightly larger than the ball 5F'. By this, the ball 5F' is held and rolled by pushing the ball 5F' in the direction of rotation of the retainer 4F by an edge defining the cutaway portion of the retainer 4F. Unlike the ball holding section 43F, the ball holding section 43F' is formed so as not to allow the ball 5F' to move into and out of the ball holding section 43F' in a direction crossing the direction of rotation of the retainer 4F.

The catch sections 44F and 44F' are formed, respectively, at opposite portions of the retainer 4F in the direction of rotation of the retainer 4F so as to protrude in the outer peripheral direction. These catch sections 44F and 44F' are also provided opposite to each other or 180 degrees from each other with the shaft hole 41A being disposed between them.

Of the catch sections 44F and 44F', the catch section 44F serving as transporting means passes the initial position of the lead-in ball 5F as the retainer 4F rotates in order to catch and transport the lead-in ball 5F at the initial position.

The rotor 3F comprises a substantially disc-shaped rotor body 31F, and a ring 32 secured to the outer periphery of the rotor body 31F by, for example, press-fitting.

An annular recess 312 is formed at a location of the bottom surface of the rotor body 31F corresponding to the top portions of the ball holding sections 43F and 43F' of the retainer 4F. A resilient member 314, formed of silicone rubber or the like, for increasing friction force with respect to the balls 5F and 5F' is mounted in the recess 312.

By the resilient member 314 mounted in the recess 312, the above-described rotor 3F pushes the balls 5F and 5F' held by the corresponding ball holding sections 43F and 43F' of the retainer 4F from above the balls 5F and 5F' in order to press and squash the tube 100, and exerts rotational force to the balls 5F and 5F' when the rotor 3F rotates in order to cause the balls 5F and 5F' to roll on the tube 100 and to move to different pressing-and-squashing locations of the tube 100.

The liquid discharger 1F of the embodiment comprises a driving mechanism 6D similar to that used in the fourth embodiment.

Figure 14:
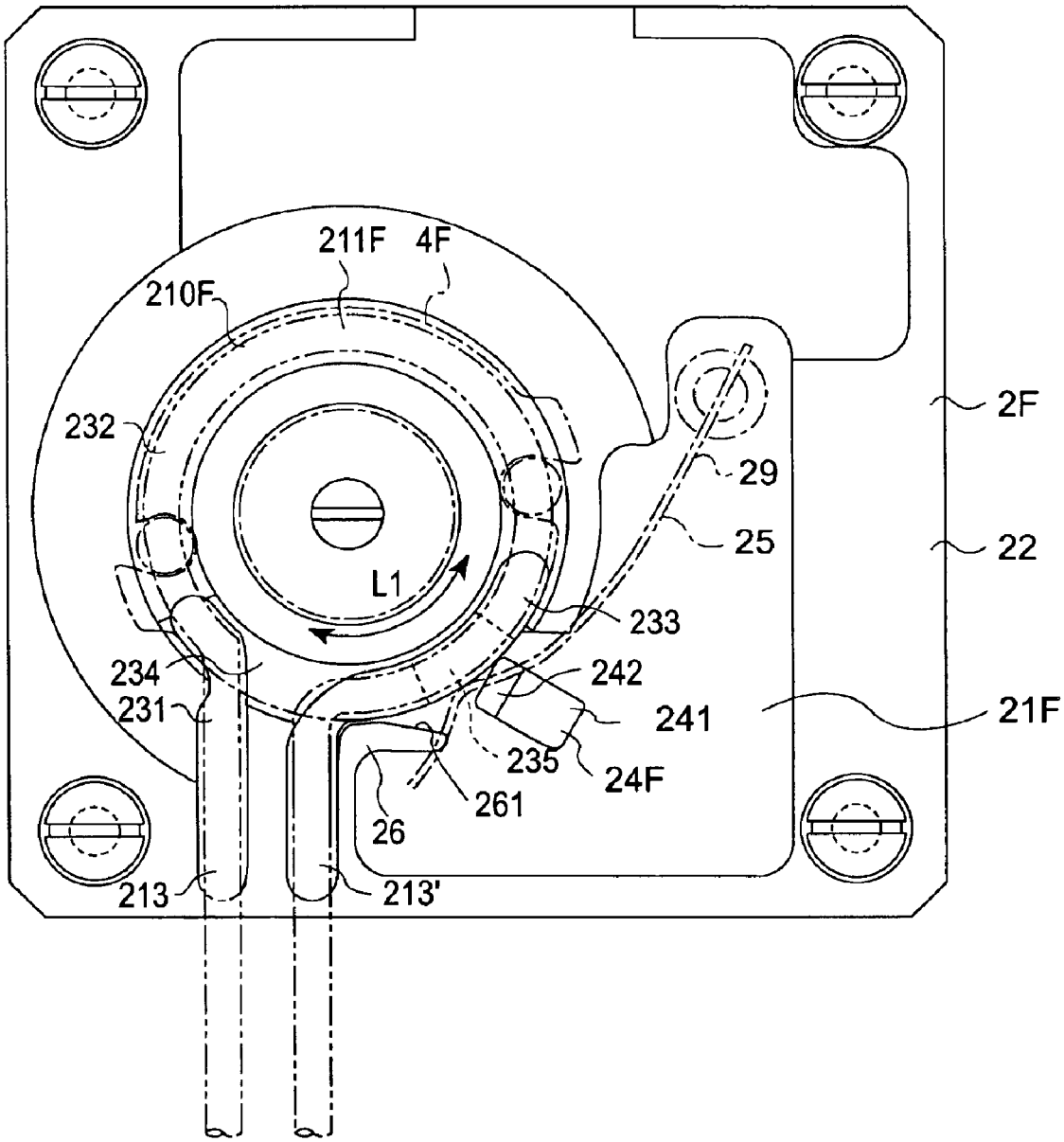
FIG. 14 is a plan view of a base used in the sixth embodiment.
Figure 15:
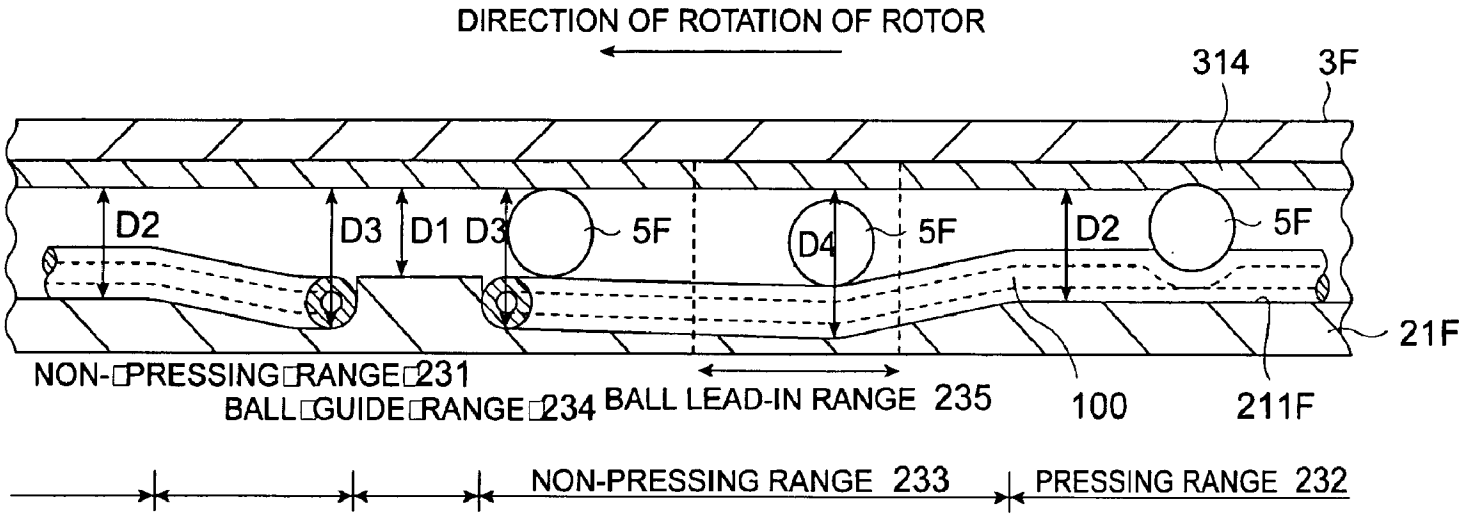
FIG. 15 is a sectional view of a development as seen from the outside along a tube used in the sixth embodiment.
Figure 17:
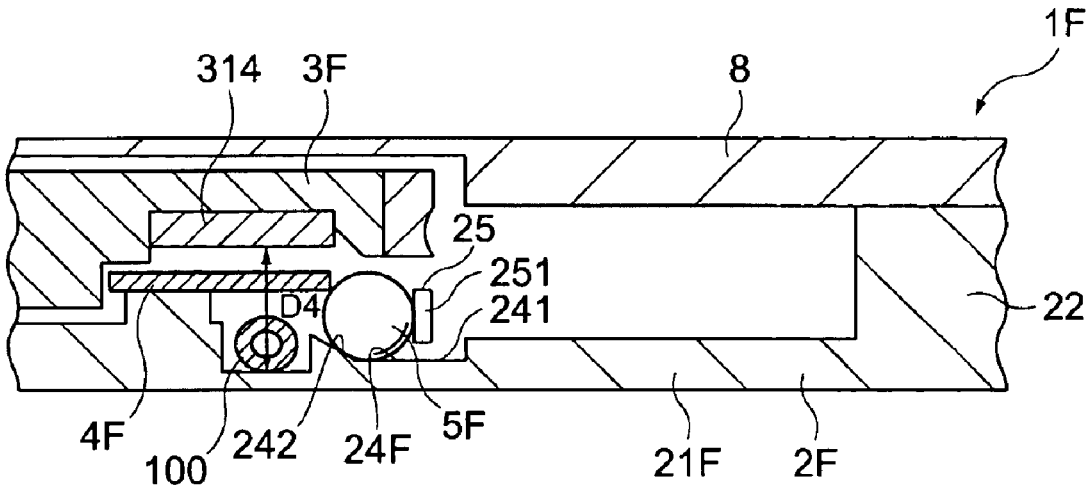
FIG. 17 is a sectional view taken along XVII—XVII of FIG. 12.
Figure 18:
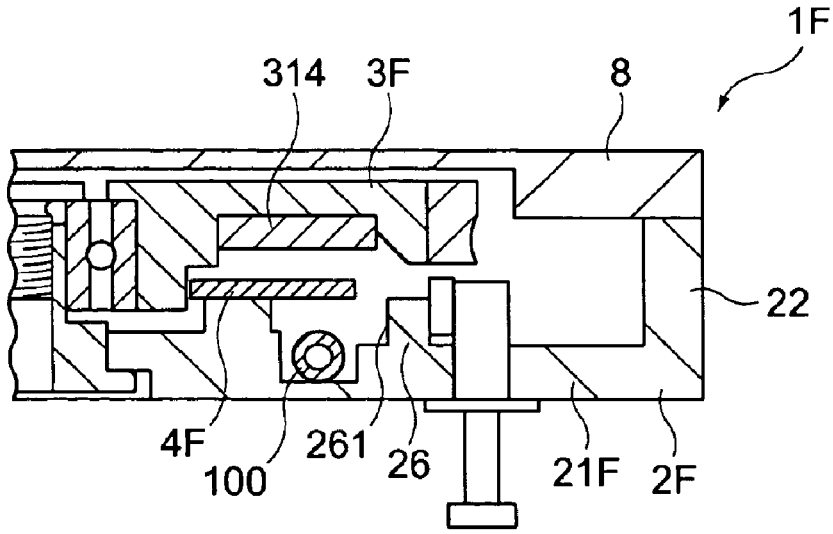
FIG. 18 is a sectional view taken along line XVIII—XVIII of FIG. 12.

Next, the depth of the tube guide groove 211F from the bottom surface of the rotor 3F will be discussed while referring to FIGS. 14 and 15. FIG. 14 is a sectional view of a development as seen from the outside along the circular groove 210F. FIG. 17 is a sectional view taken along line XVII—XVII of FIG. 12. FIG. 18 is a sectional view taken along line XVIII—XVIII of FIG. 12. In the description below, D4 to D1 denote depths from the resilient member 314 at the rotor 3F, where D4>D3>D2>D1. In addition, in the description below, of the tube 100, the side situated outwardly of the base 2F at the side of the groove 213 is referred to as "the base-end side" of the tube 100, whereas the side situated outwardly of the base 2F at the side of the groove 213' is referred to as "the front-end side."

In the following order from the base-end side to the front-end side of the tube 100, the tube guide groove 211F includes a non-pressing range 231 in which the tube 100 is not pressed by the balls 5F and 5F', a pressing range 232 in which the tube 100 is pressed by the balls 5F and 5F', and a non-pressing range 233 in which the tube 100 is not pressed by the balls 5F and 5F'.

The non-pressing range 231 is formed by the groove 213 which connects to the outside of the base 2F and a portion of the circular groove 210F which connects to the groove 213'. In the non-pressing range 231, the depth becomes smaller from the depth D3 to the depth D2 from the base-end side to the front-end of the tube 100.

Figure 16:
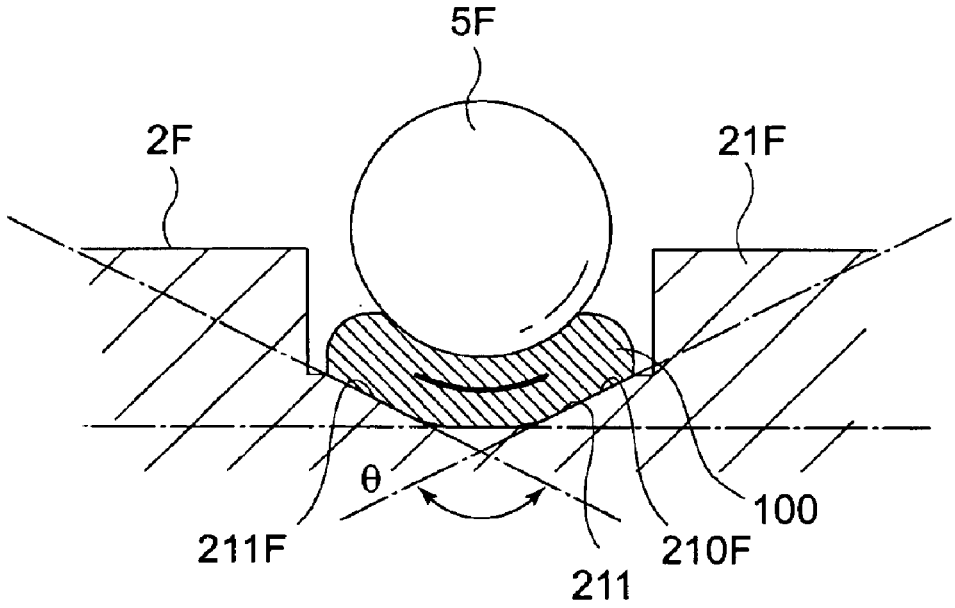
FIG. 16 is a sectional view of a tube guide groove in the sixth embodiment.

The pressing range 232 is formed by an arcuate portion of the circular groove 210F which extends through an angle equal to or greater than 180 degrees. The depth of the pressing range 232 is equal to the depth D2. The cross sectional shape of a contact surface 211 defining the tube guide groove 211F in the pressing range 232 is, as shown in FIGS. 13 and 16, a shape which linearly approximates to an arc shape formed concentrically with the balls 5F and 5F'. When the shape of the contact surface 211 is formed linearly close to an arc shape, ordinarily, as shown in FIG. 16, this is achieved using three lines, and setting the angle of intersection θ between inclined planes at both sides of a planar plane parallel to the top surface of the base 2F at a value of the order of approximately 135 degrees. Here, the radius R of the shape which linearly approximates to an arc shape is, for example, equal to 1.25 mm.

The non-pressing range 233 includes a portion of the circular groove 210F having a predetermined length of L1 and the groove 213'. In the non-pressing range 233, the depth continuously becomes larger from the depth D2 to the depth D4 and then continuously becomes smaller to the depth D3, from the base-end side to the front-end side of the tube 100.

Of the portions of the circular groove 210F, a portion thereof where the tube guide groove 211F is not formed, that is, a short arcuate portion disposed between the two grooves 213 and 213' is a ball guide range 234, which has a depth equal to the depth D1.

At the depth D2, when the balls 5F and 5F' pass on the tube 100 disposed in the tube guide groove 211F, the balls 5F and 5F' pushed by the rotor 3F squash the tube 100 and bring it to a pressed-and-squashed state.

When the depth D2 is made smaller, the balls 5F and 5F' press and squash the tube 100 excessively, causing a large friction to be produced between the tube 100 and the balls 5F and 5F', so that the balls 5F and 5F' do not roll smoothly. Therefore, it is not desirable for the depth D2 to be made smaller. On the other hand, when the depth D2 is made larger, the tube 100 cannot be completely pressed and squashed, so that the precision of the liquid discharge rate from the tube 100 is reduced.

At the depth D3, when the balls 5F and 5F' pass on the tube 100 disposed in the tube guide groove 211F, the balls 5F and 5F', while rotational force is applied thereto by the rotor 3F, roll on the tube 100 without squashing the tube 100. Here, the depth to the top portion of the tube 100 disposed at the depth D3 portion becomes equal to the depth D1.

At the depth D4, the distance from the resilient member 314 provided at the rotor 3F to the top portion of the tube 100 is greater than the heights of the balls 5F and 5F'. Therefore, since the balls 5F and 5F' are disposed on the tube 100 without contacting the rotor 3F, the balls 5F and 5F' roll while their sides are pushed by the retainer 4F.

In other words, in the tube guide groove 211F, the range situated at a side opposite to or situated 180 degrees from the depth-D4 portion of the non-pressing range 233 is the pressing range 232. Therefore, when the ball 5F passes the depth-D4 portion, the ball 5F' passes the pressing range 232. The ball 5F' has rotational force exerted thereupon by the rotor 3F, and pushes the ball holding section 43F' of the retainer 4F and causes the retainer 4F to rotate, so that the ball 5F is pushed by the ball holding section 43F. This operation is also performed when the ball 5B passes the depth-D4 portion.

At the base body 21F are provided the lead-in ball disposition groove 24F where the lead-in ball 5F is initially disposed, urging means 25 for biasing the lead-in ball 5F disposed at the lead-in ball disposition groove 24F towards the outer peripheral edge of the retainer 4F, detecting means 28F for detecting operation of the urging means 25, and a guide protrusion 26 serving as guiding means for guiding the lead-in ball 5F to the ball holding section 43F of the retainer 4F.

The lead-in ball disposition groove 24F is, in plan view, disposed close to the depth-D4 portion of the non-pressing range 233 (hereinafter referred to as "the ball lead-in range 235"), and is formed at a location which is misaligned with the path of the ball holding section 43F of the retainer 4F.

As also shown in FIG. 17, the lead-in ball disposition groove 24F includes a flat portion 241 where the lead-in ball 5F is placed and a slope 242 which slopes upward from the flat portion 241 to the ball lead-in range 235. In other words, the lead-in ball 5F at the flat portion 241 passes along the slope 242 and reaches the height of the path of the ball holding section 43F.

The urging means 25 comprises a plate spring 251, disposed at the base body 21F, for biasing the lead-in ball 5F by the front-end side thereof. The plate spring 251 operates as follows.

First, until the ball holding section 43F of the retainer 4F reaches the ball lead-in range 235, the lead-in ball 5F disposed at the lead-in ball disposition groove 24F is retained by the front-end of the plate spring 251 and is in contact with the outer peripheral edge of the retainer 4F.

Next, when the ball holding section 43F of the retainer 4F reaches the ball lead-in range 235, the lead-in ball 5F is caught by the catch section 44F of the retainer 4F and rotates along with the retainer 4F. In this state, the lead-in ball 5F is not held by the ball holding section 43F, but is positioned near the ball holding section 43F.

Thereafter, the lead-in ball 5F is retained by the plate spring 251 and is pushed into the ball holding section 43F of the retainer 4F. At this time, the lead-in ball 5F moves along the slope 242 from the flat portion 241 of the lead-in ball disposition groove 24F, and reaches the height of the path of the ball holding section 43F of the retainer 4F.

Thereafter, the plate spring 251 is brought into a state in which it is in direct contact with the outer peripheral edge of the retainer 4F.

Although the plate spring 251 has enough spring force to bias the lead-in ball 5F and to push it into the ball holding section 43F of the retainer 4F, its dimensions, material, angle, and position on the base body 21F are such as to allow rotation of the retainer 4F to the extent possible.

The detecting means 28F comprises a plate spring 251, catch sections 44F and 44F' serving as shape change portions of the retainer 4F, and a detecting section 281 for detecting swinging movement of the front-end of the plate spring 251 occurring when it comes into contact with the catch section 44F or the catch section 44F' of the retainer 4F.

The detecting section 281 is provided so as to protrude upward from the base body 21F. When the detecting section 281 is brought into an electrically connected state when the front-end of the plate spring 251 comes into contact therewith, the rotating speed of the retainer 4F is detected.

In other words, when the front-end of the plate spring 251 is in contact with a portion of the retainer 4F other than where the catch sections 44F and 44F' are formed, the detecting section 281 is brought into a state of contact with the plate spring 251. When the front-end of the plate spring 251 is pushed outwardly of the retainer 4F by the catch section 44F or the catch section 44F', the detecting section 281 is disposed at a location where it is out of contact with the plate spring 251.

Therefore, the front-end of the plate spring 251 is pushed is swung by the catch section 44F and the catch section 44F', so that it is brought out of contact with the detecting section 281 every time the retainer 4F undergoes half a rotation. Therefore, by the urging means 25, the rotation of the retainer 4F can be detected every half a rotation of the retainer 4F.

As also shown in FIG. 18, the guide protrusion 26 is provided at the initial position of the lead-in ball 5F on the base body 21F, that is, forwardly of the lead-in ball disposition groove 24F in the direction of rotation of the retainer 4F so as to protrude upward from the base body 21F. The guide protrusion 26 has a guide surface 261 which is inclined with respect to the path of the ball holding sections 43F and 43F' of the retainer 4F toward a shaft section 7 in plan view. The lead-in ball 5F is such as to move on the base body 21F while it contacts the guide surface 261 as the retainer 4F rotates. The guide surface 261 guides the lead-in ball 5F which is transported by being caught by the catch section 44F towards the path of the ball holding section 43F from the path of the catch section 44F in order to lead the lead-in ball 5F into the ball holding section 43F of the retainer 4F.

The aforementioned urging means 25, the slope 242 of the lead-in ball disposition groove 24F, the tube guide groove 211F serving as guiding means, the catch section 44F of the retainer 4F serving as transporting means, and the guide protrusion 26 form leading means 29.

Next, the operation of the embodiment will be described from Steps 0 to 4 in that order with reference to FIGS. 12 and 19.

Step 0 (Initial State)

As shown in FIG. 12, in Step 0, the ball 5F' stands still in the ball guide range 234 while the ball 5F' is held by the ball holding section 43F'. On the other hand, the ball holding section 43F of the retainer 4F is in the pressing range 232, but the lead-in ball 5F has not yet been led into the ball holding section 43F. Therefore, neither of the balls 5F and 5F' are pressing and squashing the tube 100. The lead-in ball 5F is disposed in the lead-in ball disposition groove 24F, and is in contact with the outer peripheral edge of the retainer 4F by being biased by the plate spring 251.

Step 1

Next, when alternating voltage of a predetermined frequency is applied to the oscillating body 61 of the driving mechanism 6D, the rotor 3F continuously rotates in the direction of arrow S shown in FIG. 12 by a pushing force of the oscillating body 61.

This causes the ball 5F' held by the ball holding section 43F' and pushed by the rotor 3F to roll and to pass from the ball guide range 234 to the pressing range 232 through the non-pressing range 231 in order to press and squash the tube 100. The ball 5F' moves forward while the ball 5F' causes liquid to be discharged from the front-end of the tube 100.

At this time, the ball holding section 43F of the retainer 4F still does not have the lead-in ball 5F led into it.

Step 2

Then, when the ball holding section 43F of the retainer 4F reaches the ball lead-in range 235, the lead-in ball 5F is caught by the catch section 44F of the retainer 4F and moves forward in the direction of rotation of the retainer 4F. At the same time, while the lead-in ball 5F is pushed into the ball holding section 43F by being biased by the plate spring 251, the lead-in ball 5F moves in the direction of rotation of the retainer 4F. This causes the lead-in ball 5F to contact the guide surface 261 of the guide protrusion 26 in order to be guided from the path of the catch section 44F towards the path of the ball holding section 43F, thereby making the lead-in ball 5F move towards the ball holding section 43F. By this, the lead-in ball 5F is led into the ball holding section 43F of the retainer 4F.

The ball that has been led into the ball holding section 43F of the retainer 4F in the ball lead-in range 235 is held by the ball holding section 43F. However, since it is in the non-pressing range 233, it does not press and squash the tube 100. Accordingly, only the ball 5F' presses and squashes the tube 100 as it moves in the pressing range 232 in order to cause liquid to be discharged from the front-end of the tube 100.

Step 3

Figure 19:
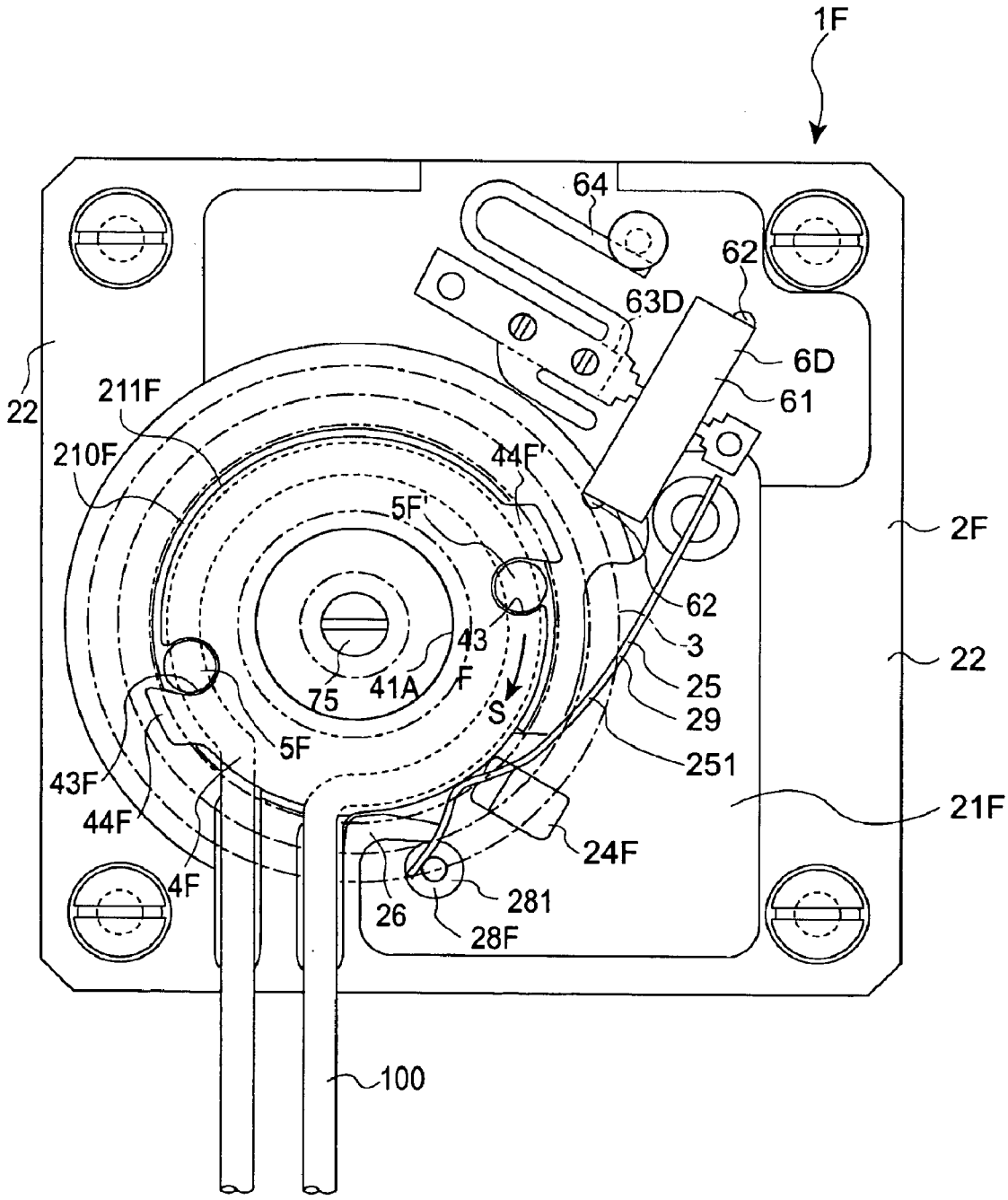
FIG. 19 is a plan view illustrating the operation of the liquid discharger of the sixth embodiment.

Thereafter, as shown in FIG. 19, even when the lead-in ball 5F passes through the ball guide range 234 and the non-pressing range 231 from the non-pressing range 233, and reaches a starting point in the pressing range 232, the ball 5F' is not yet at an end point in the pressing range 232.

Therefore, the balls 5F and 5F' each press the liquid inside the tube 100 and divide the liquid into sections, so that the liquid inside the tube 100 flows inside the tube 100 as the balls 5F and 5F' move to different press-and-squashing locations of the tube 100. The liquid section which is situated closer to the front-end side of the tube 100 than the portions of the tube 100 pressed and squashed by each of the balls 5F and 5F' is still being pushed out from the front-end of the tube 100 by the ball 5F'.

Step 4

Next, when the ball 5F' reaches the non-pressing range 233 from the pressing range 232, so that its press-and-squashing operation on the tube 100 is cancelled, the liquid confined between the two balls 5F and 5F' is discharged this time by the ball 5F from the front-end of the tube 100.

By repeating the above-described operations, the balls 5F and 5F' cause liquid to be alternately discharged from the front-end of the tube 100 by rolling on the tube 100 while pressing and squashing the tube 100.

At this time, since each of the balls 5F and 5F' is held by the retainer 4F at an interval of 180 degrees between them, the two balls 5F and 5F' divide the tube 100 in the pressing range 232 once. Therefore, by computing the volume of the space in the pressed and squashed tube 100, the amount of liquid contained in the tube 100 can be measured.

The discharge rate is set based on the inside diameter of the tube 100, the radius of the balls 5F and 5F' and the portion of the circular groove 210F at the tube guide groove 211F, and the rotating speed of the rotor 3F. In particular, the rotating speed of the rotor 3F can be easily adjusted by controlling the voltage applied to the piezoelectric devices 611 of the driving mechanism 6D.

The liquid discharger 1F is used by a user after being manufactured, inspected, and shipped. Therefore, after completing the inspection process, it is necessary to return the liquid discharger 1F to its initial state. In addition, it is desirable to return it to its initial state, for example, when the user temporarily stops using the liquid discharger 1F for a long period of time after he has used it. In that case, the liquid discharger is returned to its initial state by the following method.

First, the retainer 4F is rotated in the forward or reverse direction in order to position the ball holding section 43F in the ball lead-in range 235. Next, for example, the plate spring 251 is flexed after inserting a pin from a hole formed in a side surface of the base 2F in order to move the lead-in ball 5F to the lead-in ball disposition groove 24F from the ball holding section 43F. In this state, the retainer 4F is slightly rotated in the reverse direction. Then, when the inserted pin is pulled out, the plate spring 251 is brought into a state in which it biases the lead-in ball 5F towards the outer peripheral edge of the retainer 4F, so that the lead-in ball 5F is disposed again at its initial position. By further rotating the retainer 4F in the reverse direction, the ball 5F' is disposed again in the ball guide range 234. Therefore, the pin becomes leading-away means for returning the lead-in ball 5F from the ball holding section 43F to its initial position.

Although a pin is used for flexing the plate spring 251 when returning the liquid discharger 1F to its initial state, the plate spring 251 can be flexed by rotating a cam which is rotatably provided near the front-end of the plate spring 251 on the base body 21F.

The sixth embodiment of the present invention can provide the following advantages in addition to the advantages (1-1) to (1-8) and (1-10) to (1-21) of the first embodiment.

(6-1) One of the two balls is used as the lead-in ball 5F, which is initially disposed at the lead-in ball disposition groove 24F that is misaligned with the path of the ball holding section 43F of the retainer 4F, and which is led into the ball holding section 43F from its initial position. By this, in the initial state, the lead-in ball 5F does not press and squash the tube 100, so that it is possible to prevent the tube 100 from having a tendency to become deformed, so that errors occurring in the discharge rate can be reduced.

(6-2) Since the ball guide range 234 is provided in the circular groove 210F, and the ball 5F' is initially disposed in the ball guide range 234, even the ball 5F' does not press and squash the tube 100, so that it is possible to prevent the tube 100 from having a tendency to become deformed. Therefore, errors occurring in the discharge rate can be reduced.

(6-3) The ball holding section 43F is formed by cutting a portion of the retainer 4F from its outer peripheral edge to a location above the tube 100, and urging means 25 for biasing the lead-in ball 5F at its initial position towards the outer peripheral edge of the retainer 4F is provided. Accordingly, although the lead-in ball 5F is moved towards the outer peripheral edge of the retainer 4F by the urging means 25 until the ball holding section 43F reaches the ball lead-in range 235, the lead-in ball 5A can be pushed into the ball holding section 43A by the urging means 25 when the ball holding section 43F reaches the ball lead-in range 235, so that the lead-in ball 5F can move on the tube 100 while being held by the ball holding section 43F. Therefore, the lead-in ball 5F can be easily led into the ball holding section 43F.

(6-4) Since the lead-in ball disposition groove 24F has a slope 242, when the lead-in ball 5A is pushed into the ball holding section 43F by the urging means 25, the lead-in ball 5F can smoothly move from the flat portion 241 to the height of the path of the ball holding section 43F.

(6-5) Since the ball lead-in range 235 is provided after adjusting the depth of the tube guide groove 211F, the lead-in ball 5F does not contact the resilient member 314 provided at the rotor 3F when the lead-in ball 5F is led into the ball holding section 43F of the retainer 4F. Therefore, a force is not exerted on the lead-in ball 5F by the rotor 3F, and a difference in level from the lead-in ball disposition groove 24F to the top portion of the tube 100 can be made small due to the lead-in ball 5F, so that the lead-in ball 5F can be smoothly led into the ball holding section 43F.

As a result, since the biasing force exerted upon the lead-in ball 5F by the urging means 25 can be set at a small value, even if the urging means 25 contacts the outer peripheral surface of the retainer 4F after it has pushed the lead-in ball 5F into the ball holding section 43F, it is possible to reduce load on the rotation of the retainer 4F.

(6-6) Since a catch section 44F is formed at the retainer 4F, the lead-in ball 5F in the lead-in ball disposition groove 24F moves along with the retainer 4F by the catch section 44F. In this state, the lead-in ball 5F is not held by the ball holding section 43F, but is disposed near the ball holding section 43F. Thereafter, the ball holding section 43F moves by being biased by the urging means 25. Therefore, the lead-in ball 5F can be reliably led into the ball holding section.

(6-7) Since a guide protrusion 26 is provided, the lead-in ball 5F in the lead-in ball disposition groove 24F is pushed into the ball holding section 43F by the urging means 25 in a direction intersecting the direction of rotation of the retainer 4F on the one hand, and rotates along with the retainer 4F on the other. Therefore, the lead-in ball 5F moves towards the ball holding section 43F by coming into contact with the guide surface 261 of the guide protrusion 26 and being guided towards the path of the ball holding section 43F.

Therefore, the lead-in ball 5F can be reliably led into the ball holding section 43F.

(6-8) Since the detecting means 28F comprises a plate spring 251, catch sections 44F and 44F', and a detecting section 281, the rotating speed of the retainer 4F can be easily computed by detecting the catch sections 44F and 44F', disposed at a predetermined interval at the retainer 4F, using the detecting section 281.

(6-9) Since the detecting section 281 is formed so that it can come into electrical connection with the plate spring 251 within a range in which the front-end of the plate spring 251 swings, the rotating speed of the retainer 4F can be easily computed by only detecting the state of electrical connection of the detecting section 281.

(6-10) Since the plate spring 251 is used for the urging means 25 and the detecting means 28F, the number of component parts, costs, and man-hours required for assembly of the liquid discharger 1F can be reduced.

(6-11) Since the catch section 44F is used for the transporting means and the detecting means 28F, the number of component parts, costs, and man-hours required for assembly of the liquid discharger 1F can be reduced.

(6-12) Since the catch sections 44F and 44F' of the detecting means 28F are provided near the ball holding sections 43F and 43F', the positions of the ball holding sections 43F and 43F' can be easily detected by the detecting means 28F.

(6-13) Since the urging means 25 is provided at the outer peripheral side of the retainer 4F, a large space can be provided for disposing the urging means 25, so that the liquid discharger 1F can be easily produced.

(6-14) The liquid discharger 1F can be returned to its initial state after inspection or after use, so that it is possible to prevent the tube 100 from tending to get deformed during the period of time from the time after shipment to the time the user starts using the liquid discharger 1F or during the period of time until the user uses the liquid discharger 1F again.

(6-15) The cross sectional shape of the contact surface 211 in the pressing range 232 of the tube guide groove 211F is linearly close to an arc shape. However, since the tube 100 is resilient, the tube 100 bends in an arc form, so that, as in the case where the cross sectional shape of the contact surface 211 is an arc shape as in the first embodiment, the opening of the tube 100 can be reliably squashed. In addition, when the cross sectional shape of the contact surface 211 linearly approximates to an arc shape, it can be easily processed compared to the case where the cross sectional shape is an arc shape.

Seventh Embodiment

Next, a seventh embodiment of the present invention will be described with reference to FIGS. 20 and 21.

Figure 20:
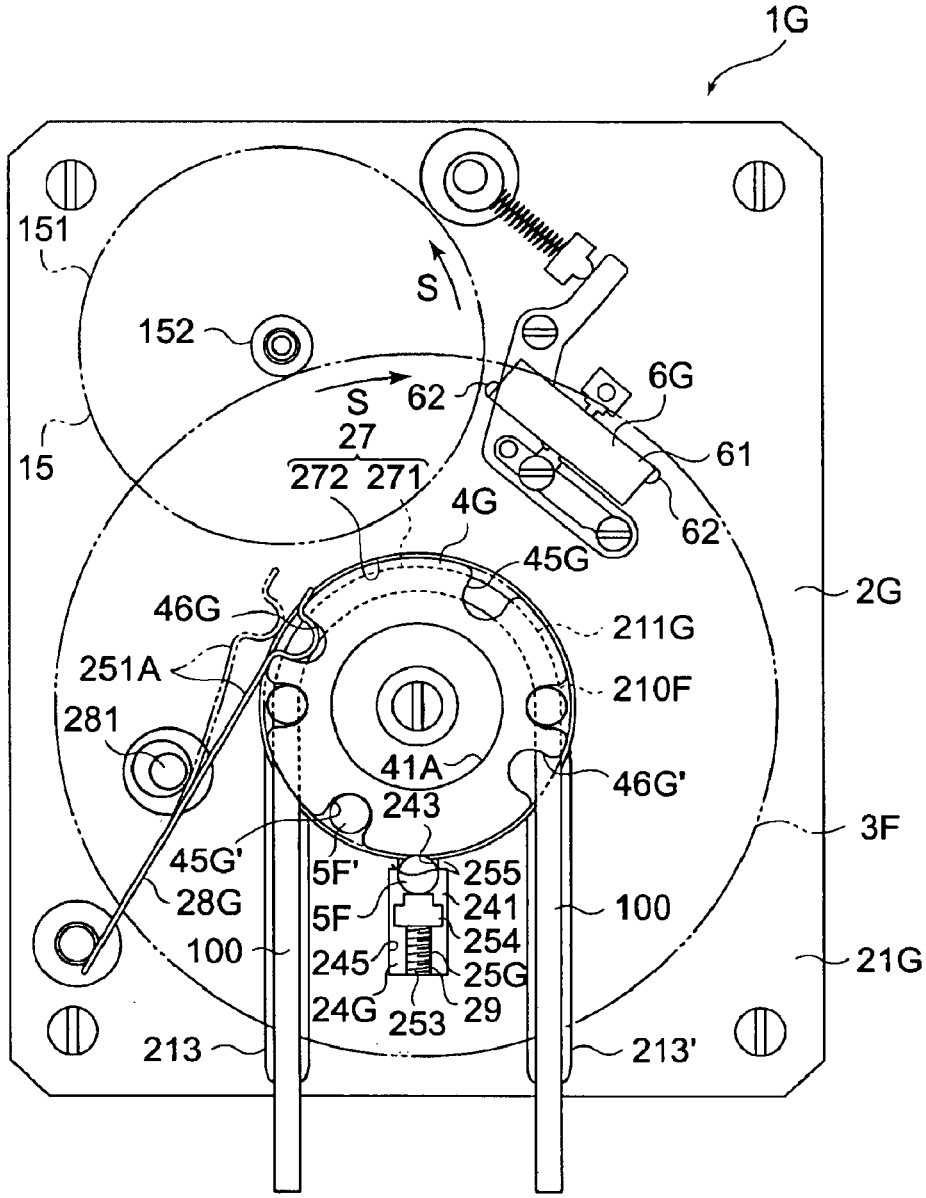
FIG. 20 is a plan view of a liquid discharger of a seventh embodiment of the present invention.
Figure 21:
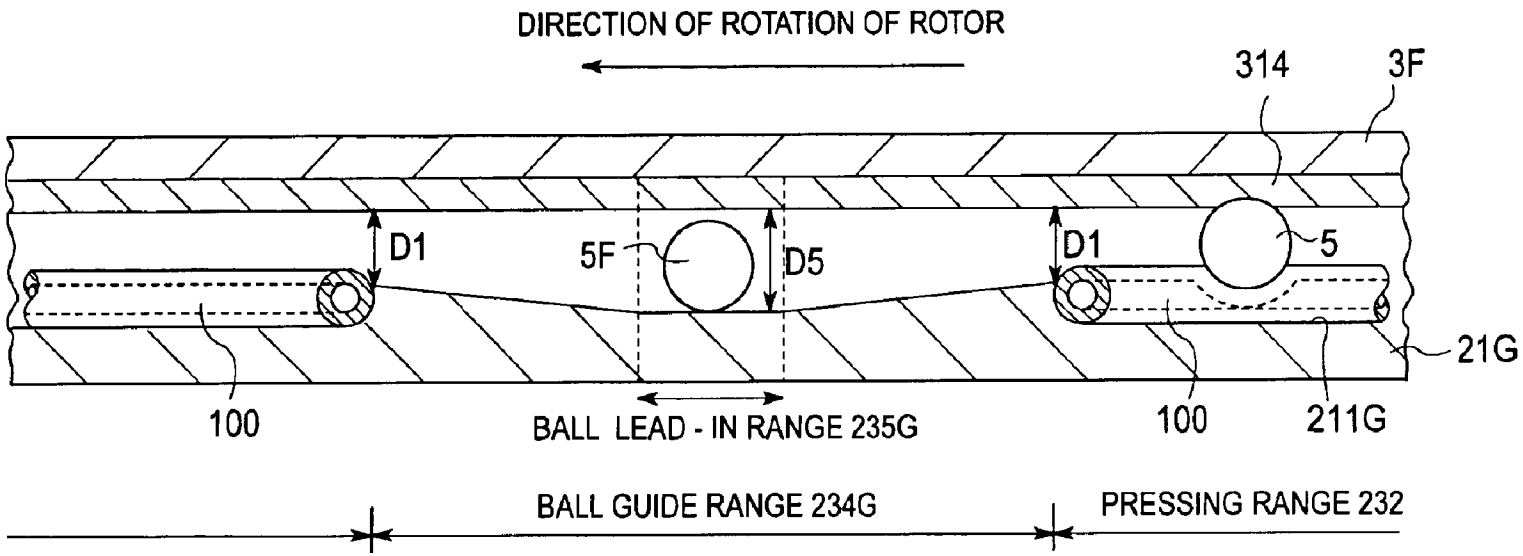
FIG. 21 is a sectional view of a development as seen from the outside along a tube used in the seventh embodiment.

A liquid discharger 1G shown in FIG. 20 differs from that of the sixth embodiment in that the structures of a tube guide groove 211G for disposing the tube 100, a retainer 4G, a driving mechanism 6G, urging means 25G, and detecting means 28G are different.

A retainer recess 27 for holding the retainer 4G and a lead-in ball disposition groove 24G which connects to the retainer recess 27 and which is the place where a lead-in ball 5F is initially disposed are formed at a base body 21G of a base 2G.

The retainer recess 27 includes a circular, retainer-recess bottom surface 271 and a retainer-recess wall surface 272 which surrounds the retainer-recess bottom surface 271.

A circular groove 210F is formed in the retainer-recess bottom surface 271, and grooves 213 and 213' extend outward from opposite portions of the circular groove 210F that are 180 degrees apart from each other with the center of the circular groove 210F being disposed therebetween.

The groove 213, a semicircular portion of the circular groove 210 extending from the groove 213 to the groove 213', and the groove 213' form the tube guide groove 211G which has a substantially U shape.

Next, the depth from the bottom surface of a rotor 3F to the tube guide groove 211G will be discussed with reference to FIG. 21. FIG. 21 is a sectional view of a development as seen from the outer side along the circular groove 210F.

The tube guide groove 211G is formed similarly to the portion of the tube guide groove 211F in the pressing range 232 in the sixth embodiment. Of the portions of the circular groove 210F, a portion thereof where the tube guide groove 211G is not formed, that is, the semicircular portion between the grooves 213 and 213', is formed as a ball guide range 234G.

In the ball guide range 234G, in the direction of rotation of the rotor 3F, the depth becomes continuously larger from depth D1 to depth D5 and then becomes continuously smaller up to depth D1. The depth D5 is equal to the depth measured to the top portion of the tube 100 when the tube 100 is disposed in the depth-D4 portion mentioned in the first embodiment.

Returning to FIG. 20, the retainer 4G has a disc shape, is provided in the retainer recess 27 at the base body 21G, and has its outer peripheral edge surrounded by the retainer-recess wall surface 272 of the retainer recess 27.

The retainer 4G includes two ball holding sections 45G and 45G' and two cutaway portions 46G and 46G'. The ball holding sections 45G and 45G' are disposed opposite to or 180 degrees apart from each other with a shaft hole 41A being disposed therebetween. The cutaway portions 46G and 46G' are provided between the ball holding sections 45G and 45G'.

The ball holding sections 45G and 45G' have structures similar to that of the ball holding section 43F used in the sixth embodiment. Unlike the ball holding section 43F, they are not angled.

Therefore, when the retainer 4G rotates, balls 5G and 5G' held by their corresponding ball holding sections 45G and 45G' try to fly out due to centrifugal force, but are stopped from flying out by the retainer-recess wall surface 272 of the retainer recess 27.

The driving mechanism 6G comprises a transfer mechanism 15 for transferring oscillation of an oscillating body 61 to the rotor 3F.

The transfer mechanism 15 transfers rotating speed imparted by the oscillating body 61 to the rotor 3F by reducing the rotating speed, is rotatably supported at the base 2G, and comprises a large-diameter portion 151 having a large outside diameter and a small-diameter portion 152 having a small outside diameter. These large-diameter portion 151 and small-diameter portion 152 are integrally formed.

The large-diameter portion 151 has a disc shape and its outer peripheral edge has a cross sectional structure that is similar to that of the ring 32 of the rotor 3A used in the first embodiment. A protrusion 62 of the oscillating body 61 is in contact with the outer peripheral edge of the large-diameter portion 151. The small-diameter portion 152 is a friction gear, and its outer peripheral edge is in contact with the ring 32 of the rotor 3F.

In the above-described driving mechanism 6G, when an alternating voltage of a predetermined frequency is applied to a piezoelectric device 611 of the oscillating body 61 by an applying device (not shown), the oscillating body 61 oscillates to apply a pushing force on the large-diameter portion 151 of the transfer mechanism 15 and to rotate the large-diameter portion 151. At the same time, the small-diameter portion 152 also rotates, so that the rotor 3F in contact with the small-diameter portion 152 rotates in the direction of arrow S shown in FIG. 20.

The lead-in ball disposition groove 24G is, in plan view, situated near the depth-D5 portion of the ball guide range 234G (hereinafter referred to as "the ball lead-in range 235G").

The lead-in ball disposition groove 24G connects to the retainer recess 27 at an opening 243, includes a rectangular flat portion 241 and a recess wall surface 245 which surrounds the flat portion 241, and has urging means 25G for biasing the lead-in ball 5G towards the outer peripheral edge of the retainer 4G provided thereat.

The urging means 25G comprises a spring 253 provided at the recess wall surface 245 so as to be opposite to the opening 243, a pusher member 254 which is provided at an end of the spring, and a stopper 255 which is provided so as to protrude into the opening 243.

Here, the urging means 25G operates in the following way.

First, until the ball holding section 45G of the retainer 4G reaches the ball lead-in range 235G, the lead-in ball 5G disposed in the lead-in ball disposition groove 24G is moved by the pusher member 254 and is in contact with the outer peripheral edge of the retainer 4G.

Next, when the ball holding section 45G of the retainer 4G reaches the ball lead-in range 235G, the pusher member 254 biases the lead-in ball 5G and pushes it into the ball holding section 45G of the retainer 4G. After the pusher member 254 has pushed in the lead-in ball 5G, the pusher member 255 engages the stopper 255 and is stopped thereby, so that the pusher member 254 is brought into a state in which it does not bias the outer peripheral edge of the retainer 4G.

The detecting means 28G comprises a plate spring 251G, two cutaway portions 46G and 46G' serving as shape change portions of the retainer 4G, and a detecting section 281 for detecting a swinging movement of an end of the plate spring 251 which occurs when the end of the plate spring 251 comes into contact with the cutaway portions 46G or 46G' of the retainer 4G. The plate spring 251G has at an end thereof a substantially U-shaped protrusion for fitting into the cutaway portions 46G and 46G'.

Next, the operation of the embodiment will be described from Step 0 to Step 4 in that order.

Step 0 (Initial State)

As shown in FIG. 20, in Step 0, while the retainer 4G holds the ball 5G' by the ball holding section 45G', the retainer 4G stands still with the ball 5G' disposed forwardly of the ball lead-in range 235G of the ball guide range 234G in the direction of rotation of the retainer 4G. On the other hand, the ball holding section 45G of the retainer 4G is at the pressing range 232, but does not have the lead-in ball 5G led into it. Therefore, neither of the balls 5G and 5G' press and squash the tube 100.

The lead-in ball 5G is disposed in the lead-in ball disposition groove 24G, and is in contact with the outer peripheral edge of the retainer 4G by being biased by the urging means 25G.

Step 1

Next, when an alternating voltage of a predetermined frequency is applied to the oscillating member 61 of the driving mechanism 6G, the rotor 3F rotates continuously in the direction of arrow S shown in FIG. 20 by the pushing force of the oscillating body 61.

Then, the ball 5G' which is pushed by the rotor 3F rolls and moves to the pressing range 232 from the ball guide range 234G, and presses and squashes the tube 100 and moves while causing liquid to be discharged from the front-end of the tube 100.

At this time, the ball holding section 45G of the retainer 4G still does not have the lead-in ball 5G led into it yet.

Step 2

Then, when the ball holding section 45G of the retainer 4G reaches the ball lead-in range 235G, the lead-in ball 5G is retained by the urging means 25G and pushed into the ball holding section 45G.

The ball which has been led into the ball holding section 45G of the retainer 4G in the ball lead-in range 235G is held by the ball holding section 45G, but is in the ball guide range 234G, so that it does not press and squash the tube 100. Therefore, only the ball 5G' presses and squashes the tube 100 while moving through the pressing range 232 in order to discharge liquid from the front-end of the tube 100.

Steps 3 and 4 which follow Step 2 are the same as those in the sixth embodiment.

The seventh embodiment can provide the following advantages in addition to the advantages (1-1) to (1-8), (1-10) to (1-16), (1-19), and (1-21) of the first embodiment and the advantages (6-1) to (6-3), (6-5), (6-8), and (6-13) to (6-15) of the sixth embodiment.

(7-1) Since a stopper 255 is provided in the urging means 25G, the pusher member 254 engages it and is stopped thereby after the pusher member 254 has pushed in the lead-in ball 5F, so that it does not bias and exert a load upon the outer peripheral edge of the retainer 4G. Therefore, the retainer 4G can rotate smoothly.

(7-2) The optimal frequency of the oscillating body 61 for exerting a pushing force by the protrusion 62 is 270 kHz to 300 kHz. A transfer mechanism 15 is provided in the driving mechanism 6G. Accordingly, by properly adjusting the ratio between the peripheral length of the large-diameter portion 151 and the peripheral length of the small-diameter portion 152 of the transfer mechanism 15, the liquid discharge rate can be adjusted by freely adjusting the rotating speed of the rotor 3F without changing the voltage applied to the oscillating body 61.

Eighth Embodiment

Figure 22:
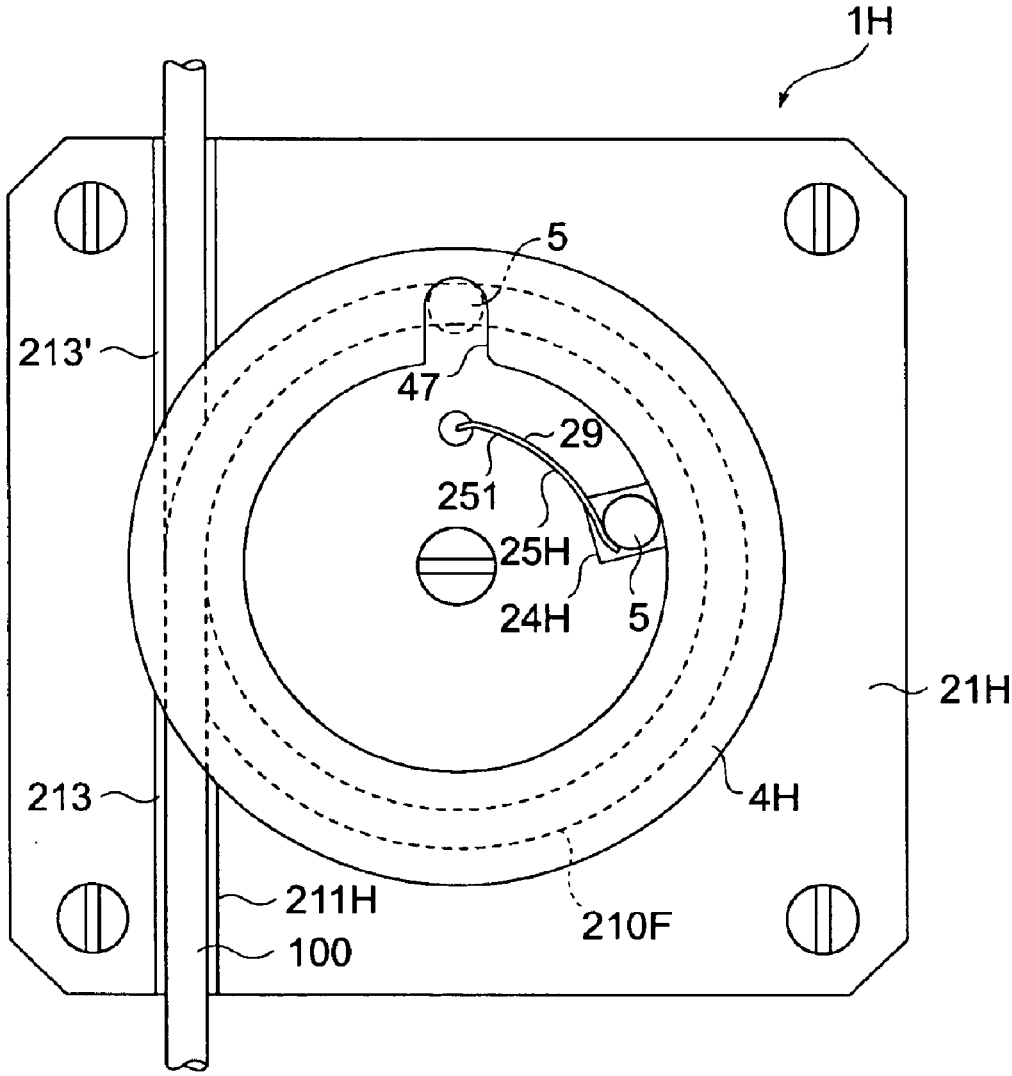
FIG. 22 is a plan view of a liquid discharger of an eighth embodiment of the present invention.

A liquid discharger 1H shown in FIG. 22 differs from the liquid discharger 1F of the sixth embodiment in that the structures of a tube guide groove 211H for disposing the tube 100, a retainer 4H, and urging means 25H are different.

Grooves 213 and 213' extend in opposite directions outwardly of a circular groove 210F from one point of the circular groove 210F.

The groove 213, the entire periphery of the circular groove 210F, and the groove 213' form the tube guide groove 211H.

The depth measured from the bottom surface of a rotor 3F to the tube guide groove 211H is the same as that of the pressing range 232 in the sixth embodiment.

The retainer 4H comprises one ball holding section 47 for holding a ball 5 at its inner peripheral end portion, and can rotate along with the rotor 3F. The ball holding section 47 may be formed in the lower surface of the rotor 3F when the retainer 4H is formed integrally with the rotor 3F.

The ball holding section 47 is provided at a location which always allows it to pass above the circular groove 210F of the tube guide groove 211H as the retainer 4H rotates. The ball holding section 47 has a structure which is similar to that of the ball holding section 43F used in the first embodiment. However, unlike the ball holding section 43F, the ball holding section 47 is not angled.

When the rotor 3F and the retainer 4H rotate, the ball 5 held by the ball holding section 47 tries to fly out therefrom due to centrifugal force, but a cutaway portion that forms the ball holding section 47 prevents it from flying out.

As a ball 5, only the lead-in ball 5 which is held by the ball holding section 47 is used. This lead-in ball 5 is initially disposed in a lead-in ball disposition groove 24H (described later) in a base body 21H.

At the base body 21H are provided the lead-in ball disposition groove 24H where the lead-in ball 5 is initially disposed and urging means 25H for biasing the lead-in ball 5 disposed in the lead-in ball disposition groove 24H towards the inner peripheral edge of the retainer 4H.

The urging means 25H is positioned at the inner peripheral side of the retainer 4H and comprises a plate spring 251.

The eighth embodiment can provide the following advantages in addition to the advantages (1-1) to (1-8), (1-10) to (1-21) of the first embodiment and the advantages (6-1), (6-3), (6-4), (6-14), and (6-15) of the sixth embodiment.

(8-1) Since the ball holding section 47 is provided at the inner peripheral end portion of the retainer 4H, and the urging means 25H is provided at the inner peripheral side of the retainer 4H, the number of component parts disposed outwardly of the retainer 4H can be minimized, so that the liquid discharger 1H can be reduced in size.

Ninth Embodiment

Figure 23:
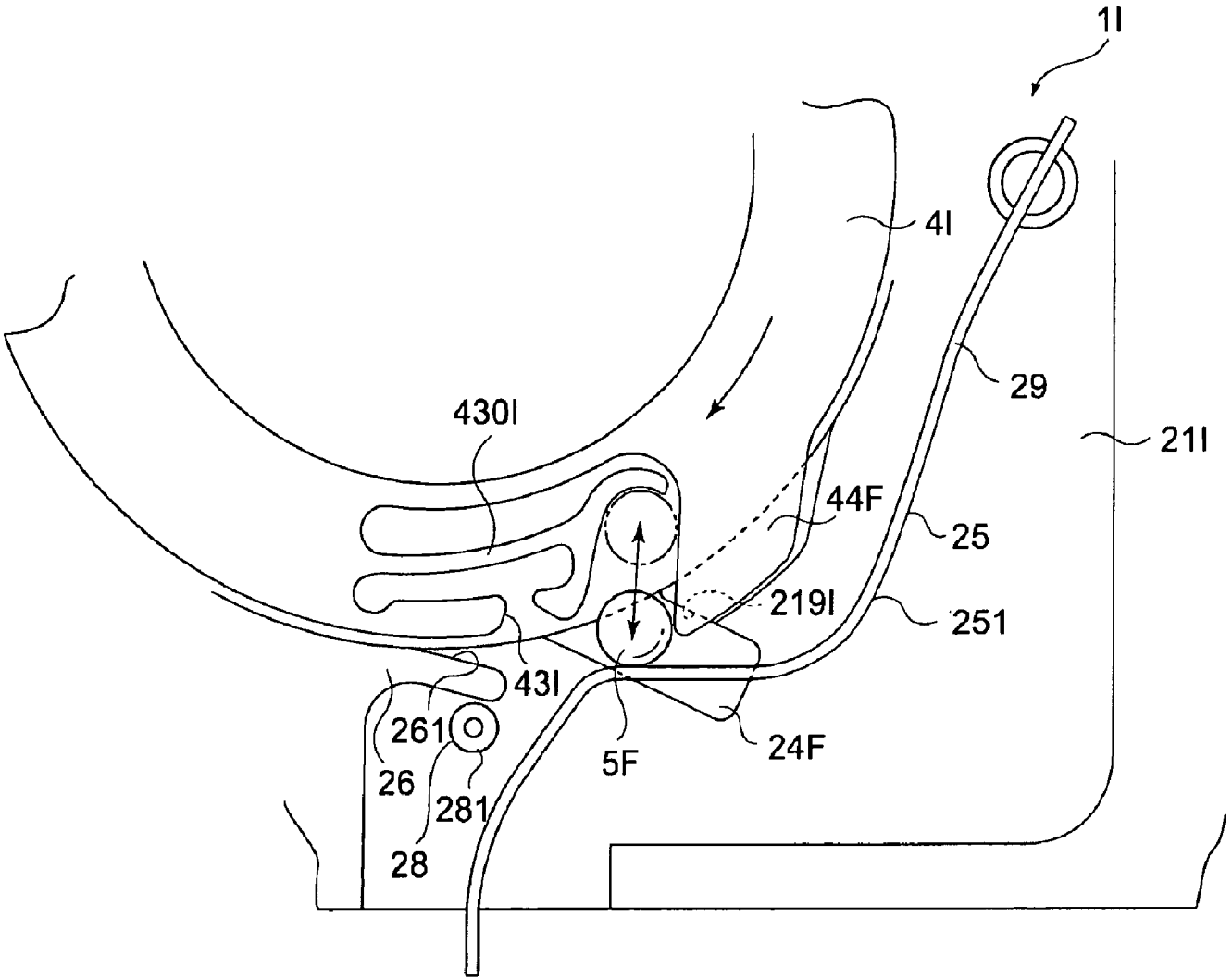
FIG. 23 is a plan view of the main portion of a liquid discharger of a ninth embodiment of the present invention.

A liquid discharger 1I shown in FIG. 23 differs from the liquid discharger 1F of the sixth embodiment in that the structures of a retainer 4I and a base body 21I are different.

Outer-peripheral-direction urging means 430I is mounted to a ball holding section 43I for holding a lead-in ball 5F of the retainer 4I. The outer-peripheral-direction urging means 430I biases the lead-in ball 5F held by the ball holding section 43I in the direction of the outer periphery of the retainer 4I (in a direction opposite to the direction in which the lead-in ball 5F is led into the ball holding section 43I). The biasing force of the outer-peripheral-direction urging means 430I is smaller than the spring force of a plate spring 251.

In the embodiment, an end of the plate spring 251 protrudes towards the outer peripheral side of the base body 21I.

A first initial position guide surface 219I is formed at a side surface of the lead-in ball disposition groove 24F in the base body 21I opposite to a forward side surface of the lead-in ball disposition groove 24F in the base body 21I in the direction of forward rotation of the rotor 3F. The first initial position guide surface 219I is positioned so as to oppose a guide surface 261 with the initial position of the lead-in ball 5F being disposed therebetween. The first initial position guide surface 219I is inclined in a direction of reverse rotation of the retainer 4I.

As in the sixth embodiment, when the ball holding section 43I of the retainer 41 reaches a ball lead-in range 235, the lead-in ball 5F is caught by a catch section 44F of the retainer 4I and is led into the ball holding section 43I of the retainer 4I. The biasing force of the outer-peripheral-direction urging means 430I mounted to the ball holding section 43I is smaller than the spring force of the plate spring 251, so that the lead-in ball 5F is held by the ball holding section 43I.

The lead-in ball 5F held by the ball holding section 43I is moved by the outer-peripheral-direction urging means 430I and rolls while contacting a side surface defining a tube guide groove 211F, so that the ball 5F will not be displaced from a tube 100.

After using the liquid discharger 1I, the retainer 4I is rotated in the reverse direction. When the lead-in ball 5F held by the ball holding section 43I comes back to the vicinity of the lead-in ball disposition groove 24F, a user flexes the plate spring 251 in a direction away from the retainer 4I with his finger. This causes the lead-in ball 5F to be biased by the outer-peripheral-direction urging means 430I and to move out of the ball holding section 43I. The ball 5F is guided to the first initial position guide surface 219I and moves back into the lead-in ball disposition groove 24F. In other words, the first initial position guide surface 219I and the outer-peripheral-direction urging means 430I form leading-away means for returning the lead-in ball 5F from the ball holding section 43I to its initial position.

When the flexing of the plate spring 251 is stopped, the ball 5F is pushed against the outer peripheral surface of the retainer 4I by the plate spring 251.

The ninth embodiment can provide the following advantages in addition to the advantages similar to those of the sixth embodiment.

(9-1) Since an outer-peripheral-direction urging means 430I is provided at the ball holding section 43I of the retainer 4I, when, after the user has finished using the liquid discharger 1I, the retainer 4I is rotated in the reverse direction and, after the retainer 4I has been returned to its predetermined position, the biasing operation of the plate spring 251 is cancelled, the lead-in ball 5F can be reliably and smoothly returned to its initial position by the biasing force of the outer-peripheral-direction urging means 430I. Therefore, since, after the user has finished using the liquid discharger 1I, the pressing-and-squashing operation on the tube 100 can be cancelled, it is possible to prevent the tube 100 from tending to get deformed, so that errors occurring in the discharge rate can be reduced.

In addition, since the plate spring 251 is used for the urging means 25 for leading the ball 5F into the ball holding section 43I of the retainer 4I, the detecting means 28F for detecting rotation of the retainer 4I, and means for allowing the outer-peripheral-direction urging means 430I to return the ball 5F to its initial position or prohibiting it from returning the ball 5F to its initial position, the number of parts, costs, and number of man-hours required for assembly of the liquid discharger 1F can be reduced.

(9-2) Since a first initial position guide surface 291I is formed at the lead-in ball disposition groove 24F, the ball 5F pushed out from the ball holding section 43I by the outer-peripheral-direction urging means 430I can be smoothly returned to its initial position.

Tenth Embodiment

A description of a tenth embodiment of the present invention will be given with reference to FIGS. 24 to 28.

A liquid discharger 1J differs from the liquid discharger 1F of the sixth embodiment in that the structure of a retainer 4J is different.

Figure 24:
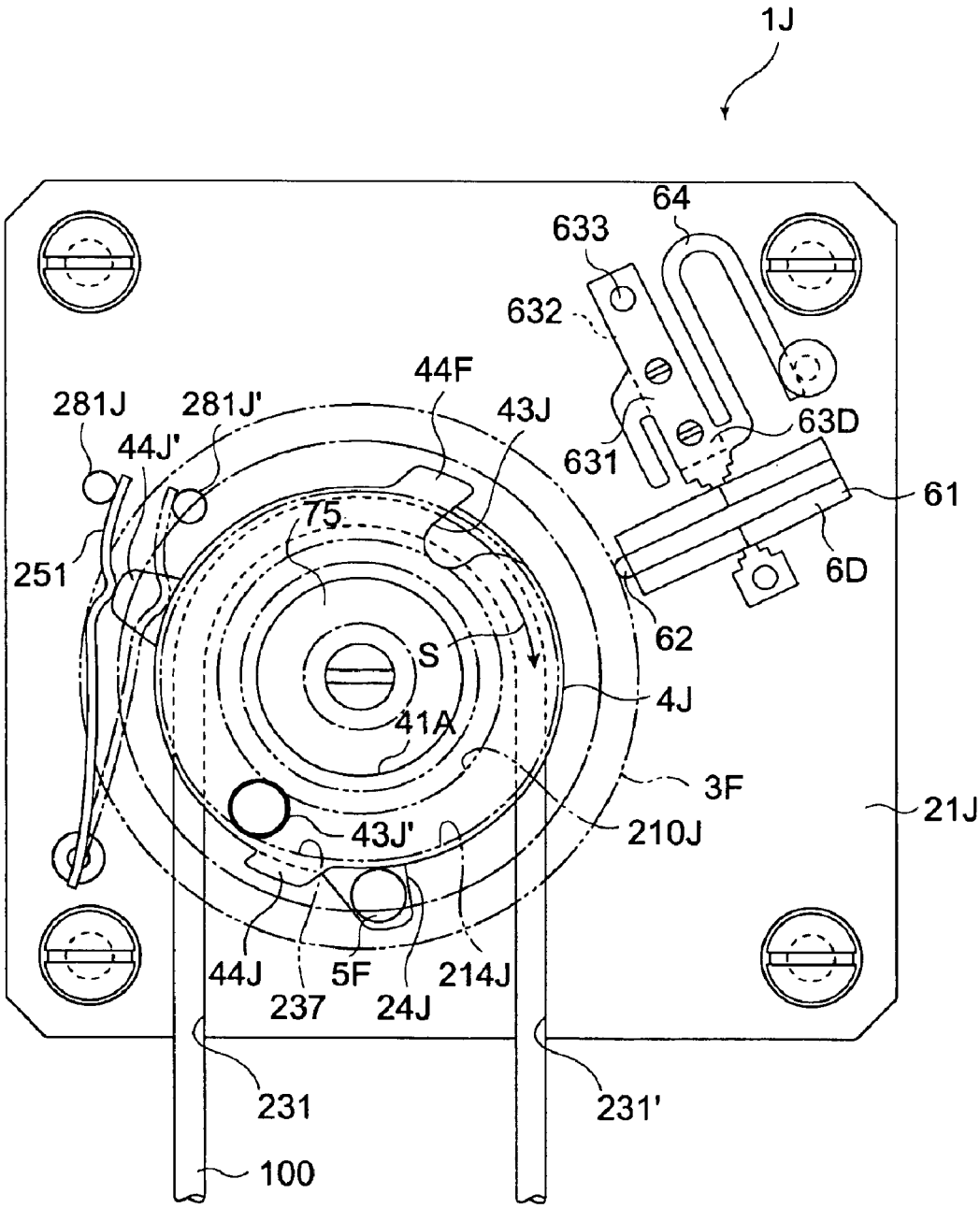
FIG. 24 is a plan view of a liquid discharger of a tenth embodiment of the present invention.
Figure 25:
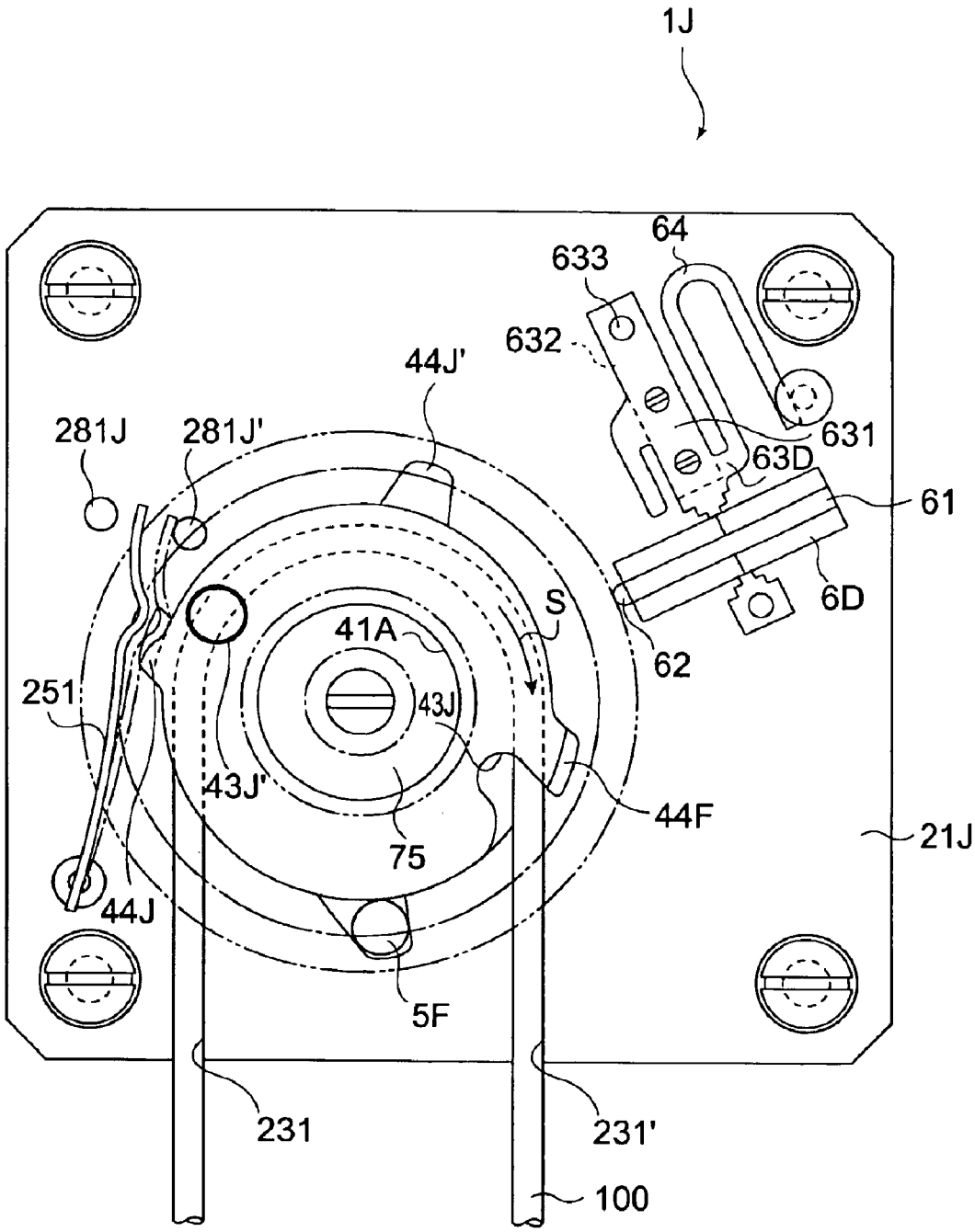
FIG. 25 is a plan view of the liquid discharger of the tenth embodiment of the present invention.

As shown in FIGS. 24 and 25, the retainer 4J comprises a ball holding section 43J formed by cutting away a portion of the retainer 4J in a manner substantially similarly to the way in which the ball holding section 43F used in the sixth embodiment is formed by cutting away a portion of the retainer 4F, and a ball holding section 43J' formed opposite to, or 180 degrees apart from, the ball holding section 43J with a shaft hole 41A being disposed therebetween.

A second initial position guide surface 431J (see FIG. 26) is formed in the ball holding section 43J so as to be formed continuously from a forward side surface of the ball holding section 43J in the direction of forward rotation of the held ball 5F to the outer peripheral surface of the retainer 4J and so that its ball-5F side is inclined with respect to the outer peripheral surface of the retainer 4J in the direction of a shaft section 7. The ball holding section 43J differs from the ball holding section 43F used in the sixth embodiment on this point. Unlike the ball holding section 43J, the ball holding section 43J' does not have a cutaway structure, but has a circular hole form. In the initial state, the ball holding section 43J' is positioned between grooves 231 and 231', so that a ball 5F' held by the ball holding section 43J' is not placed on a tube 100.

A protrusion 44J is formed opposite to or 180 degrees apart from a catch section 44F of the retainer 4J with the shaft hole 4IA being disposed therebetween. The protruding size of the protrusion 44J is substantially the same as the protruding size of the catch section 44F. A large protrusion 44J' is formed between the protrusion 44J and the catch section 44F of the retainer 4J. The protruding size of the large protrusion 44J' is greater than the protruding size of the catch section 44F.

A plate spring 251 is provided at a base body 21J. The plate spring 251 does not bias the lead-in ball 5F, but is only used to detect rotation of the retainer 4J. Detecting sections 281J and 281J' are formed at the base body 21J so as to be disposed on both sides an end portion of the plate spring 251.

The detecting section 281J which is positioned at the outer peripheral side of the base body 21J is used to detect an initial state. In the initial state, the large protrusion 44J' of the retainer 4J contacts the plate spring 251, so that the plate spring 251 and the detecting section 281J are in contact with each other. By this, the initial state is detected.

When the retainer 4J rotates in the forward direction, the large protrusion 44J' and the plate spring 251 are brought out of contact with each other, so that the plate spring 251 comes into contact with the detecting section 281J' and is brought into electrical connection with the detecting section 281J'. When the retainer 4J rotates further in the forward direction, as shown in FIG. 25, the protrusion 44J or the catch 44F of the retainer 4J comes into contact with the plate spring 251, so that the plate spring 251 is separated from the detecting section 281J'. By this, the plate spring 251 and the detecting section 281J' are out of contact with each other, so that the rotating speed of the retainer 4J is detected.

Figure 26:
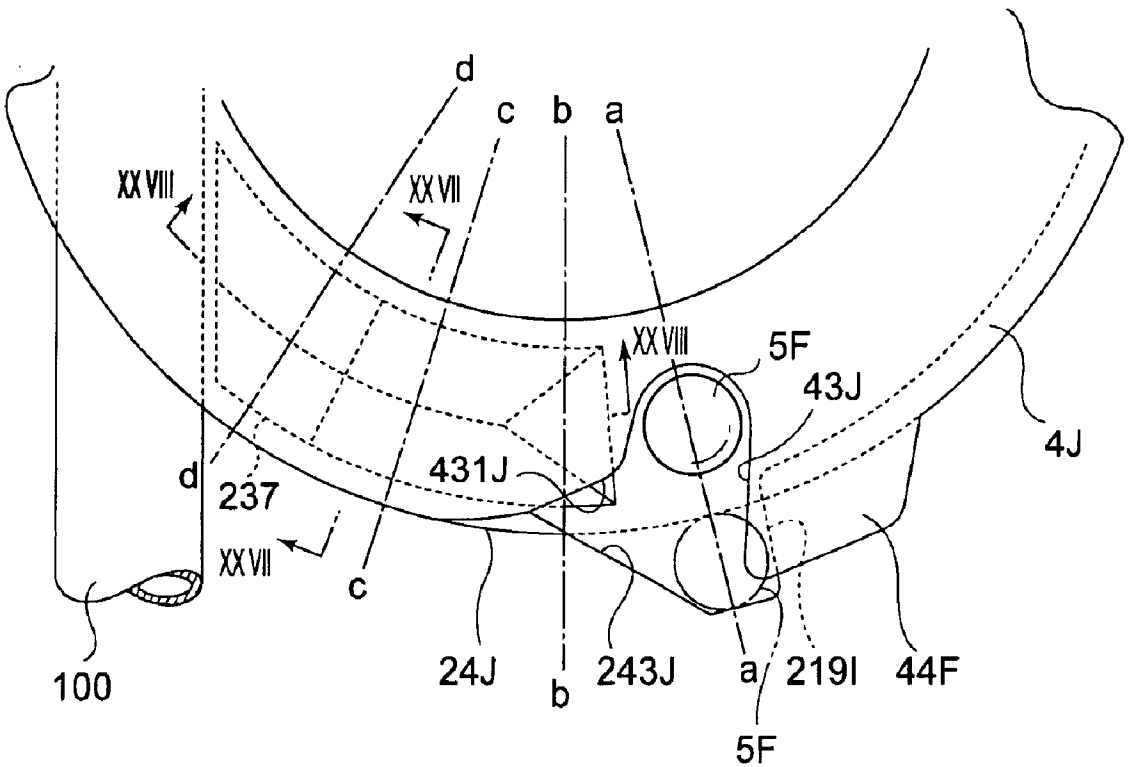
FIG. 26 is a plan view of the main portion of the tenth embodiment.

A lead-in ball disposition groove 24J is formed between the grooves 231 and 231' of the base body 21J. As shown in FIG. 26, the forward surface defining the lead-in ball disposition groove 24J in the direction of forward rotation of a rotor 3F is formed as a ball guide surface 243J inclined towards a path of the ball holding section 43J. A first initial position guide surface 219I is formed at the lead-in ball disposition groove 24J. In this embodiment, a slope 242 is not formed.

A circular groove 210J is formed in the base body 21J. The circular groove 210J has a structure which is substantially the same as that of the circular groove 210A in the first embodiment. However, the structure of a ball guide groove 214J is different from the structure of the ball guide groove 214 in the first embodiment.

Of the portions of the ball guide groove 214J, the portion between the lead-in ball disposition groove 24J and the groove 231 is formed as a ball lead-in groove 237.

A description of the ball lead-in groove 237 will be given with reference to FIGS. 27 and 28.

Figure 27:
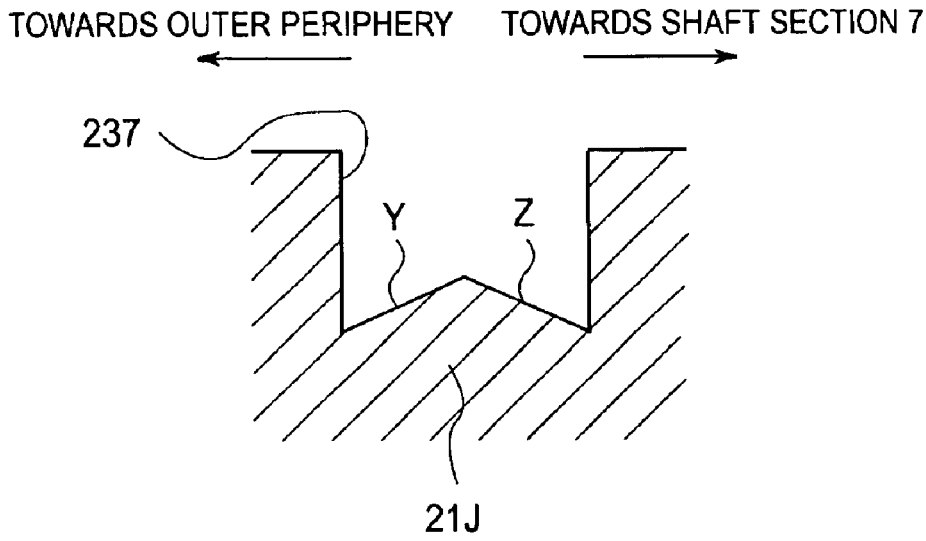
FIG. 27 is a sectional view taken along line XXVII—XXVII of FIG. 26.
Figure 28:
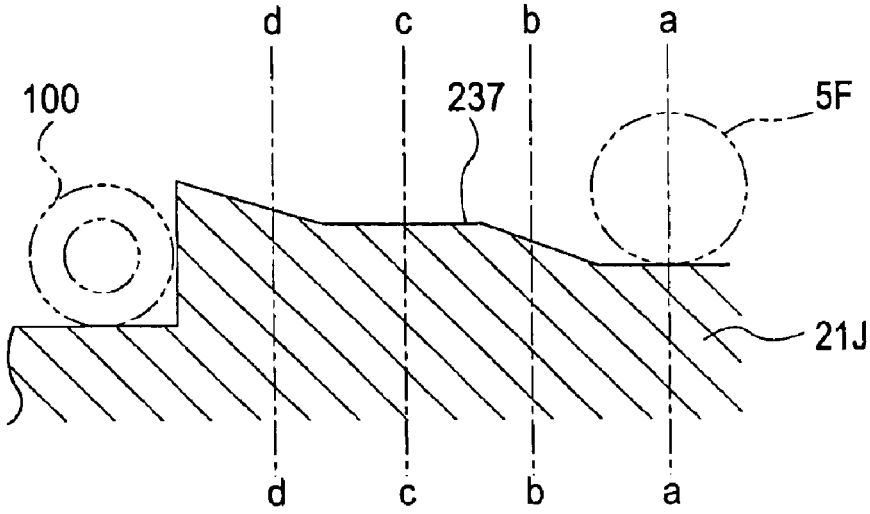
FIG. 28 is a sectional view taken along line XXVIII—XXVIII of FIG. 26.

FIG. 27 is a sectional view taken along line XXVII—XXVII of FIG. 26, and FIG. 28 is a sectional view taken along line XXVIII—XXVIII of FIG. 26.

As shown in FIG. 27, the bottom surface central portion of the ball lead-in groove 237 in a cross section of the circular groove 210J in a radial direction thereof protrudes towards the rotor 3F, and includes an inclined surface Z which inclines towards the shaft section 7 from the central portion and an inclined surface Y which inclines towards the outer periphery of the base body 21J from the central portion. As shown in FIG. 28, the ball lead-in groove 237 includes flat portions and inclined portions which incline upward towards the tube 100. The flat portions and the inclined portions are alternately formed.

In the liquid discharger 1J, the lead-in ball 5F is led onto the tube 100 in the following way.

When the ball holding section 43F of the retainer 4J reaches the vicinity of the lead-in ball disposition groove 24J by forwardly rotating the rotor 3F (in the direction of arrow S in FIG. 24), the lead-in ball 5F is caught by the catch section 44F of the retainer 4J and moves in the direction of rotation of the retainer 4J. At the same time, since a cutaway portion that forms the ball holding section 43J is angled in the direction of rotation of the retainer 4J, the ball 5F is guided to the back side of the ball holding section 43J. The lead-in ball 5F is guided to the back side of the ball holding section 43J even by contacting the ball guide surface 243J. The ball 5F that has been guided into the ball holding section 43J arrives at a flat portion a-a shown in FIG. 28.

When the retainer 4J further rotates in the forward direction, the ball 5F arrives at an inclined portion b-b. Since the lead-in ball 5F is in the back side of the ball holding section 43J, the lead-in ball 5F rolls on the inclined surface Z at the back side (shaft section 7 side) of the ball lead-in groove 237. When the retainer 4J rotates still further in the forward direction, the ball 5F rolls on a flat portion c-c shown in FIG. 28. When the retainer 4J rotates still further in the forward direction, the ball 5F climbs an inclined portion d-d and reaches the top portion of the tube 100.

After use, the rotor 3F is rotated in the reverse direction. During the reverse rotation, the lead-in ball 5F is pushed by the second initial position guide surface 431J of the ball holding section 43J and rolls on the inclined surface Y at the outer side of the ball lead-in groove 237. When the lead-in ball 5F moves to the vicinity of the lead-in ball disposition groove 24J, the lead-in ball 5F is guided to the first initial position guide surface 219I and returns to the lead-in ball disposition groove 24J. Therefore, the first initial position guide surface 219I and the second initial position guide surface 431J form leading-away means for returning the lead-in ball 5F to its initial position.

As the retainer 4J rotates in the reverse direction, the ball 5F' is returned to its initial position between the grooves 231 and 231' by the ball holding section 43J'.

The tenth embodiment can provide the following advantages in addition to the advantages (1-1) to (1-21) of the first embodiment and the advantages (6-1), (6-2), (6-6), (6-8), (6-9), (6-11), (6-12), and (6-14) of the sixth embodiment.

(10-1) Since the ball guide surface 243J which inclines towards the shaft section 7 (that is, which inclines so as to be situated closer to the shaft section 7 as it extends from the back side to the forward side in the direction of forward rotation of the rotor 3F), the lead-in ball 5F caught by the catch section 44F of the retainer 4J is guided to the back side of the ball holding section 43J by the ball guide surface 243J. Therefore, for example, urging means for leading the lead-in ball 5F into the ball holding section 43J is not required, thereby making it possible to reduce the number of component parts.

(10-2) When the retainer 4J rotates in the forward direction, the lead-in ball 5F is guided to the back side of the ball holding section 43J by a cutaway portion that forms the ball holding section 43J and the ball guide surface 243J, so that the lead-in ball 5F rolls on the inclined surface Z at the back side (shaft section 7 side) of the ball lead-in groove 237. Therefore, when the retainer 4J rotates in the forward direction, the lead-in ball 5F is moved towards the center of the ball lead-in groove 237 by the action of the inclined surface Z, so that the lead-in ball 5F does not get displaced from the ball lead-in groove 237.

On the other hand, when the retainer 4J rotates in the reverse direction, the lead-in ball 5F rolls on the inclined surface Y at the outer side by the second initial position guide surface 431J of the retainer 4J. Therefore, it is possible to return the lead-in ball 5F smoothly to the lead-in ball disposition groove 24J formed in the outer peripheral side of the circular groove 210J.

(10-3) Since a first initial position guide surface 219I is formed at the lead-in ball disposition groove 24J, the lead-in ball 5F is guided to the guide surface and smoothly returns to the lead-in ball disposition groove 24J. Therefore, even after the user has finished using the liquid discharger 1J, the pressing-and-squashing operation on the tube 100 can be cancelled, i.e. eliminated, by merely rotating the rotor 3F in the reverse direction, so that it is possible to prevent the tube 100 from having a tendency to get deformed, so that errors occurring in the discharge rate can be reduced.

(10-4) In the case where a large protrusion 44J' for detecting the initial position is not formed at the retainer, when the rotor 3F is rotated in the reverse direction to return the lead-in ball 5F to its initial position, the rotor 3 may be excessively rotated in the reverse direction even after the lead-in ball 5F has returned to its initial position. However, in this embodiment, since the large protrusion 44J' for detecting the initial position is formed on the retainer 4J in order to make it possible to detect the initial position, the rotor 3F is not rotated excessively in the reverse direction.

Eleventh Embodiment

An eleventh embodiment of the present invention will be described using FIG. 29.

In a liquid discharger 1K of this embodiment, stoppers 9K are mounted to the front-end side and base-end side of a tube 100 disposed in grooves 213K and 213'K. The other structural features are the same as those of the liquid discharger 1F of the sixth embodiment.

Figure 30:
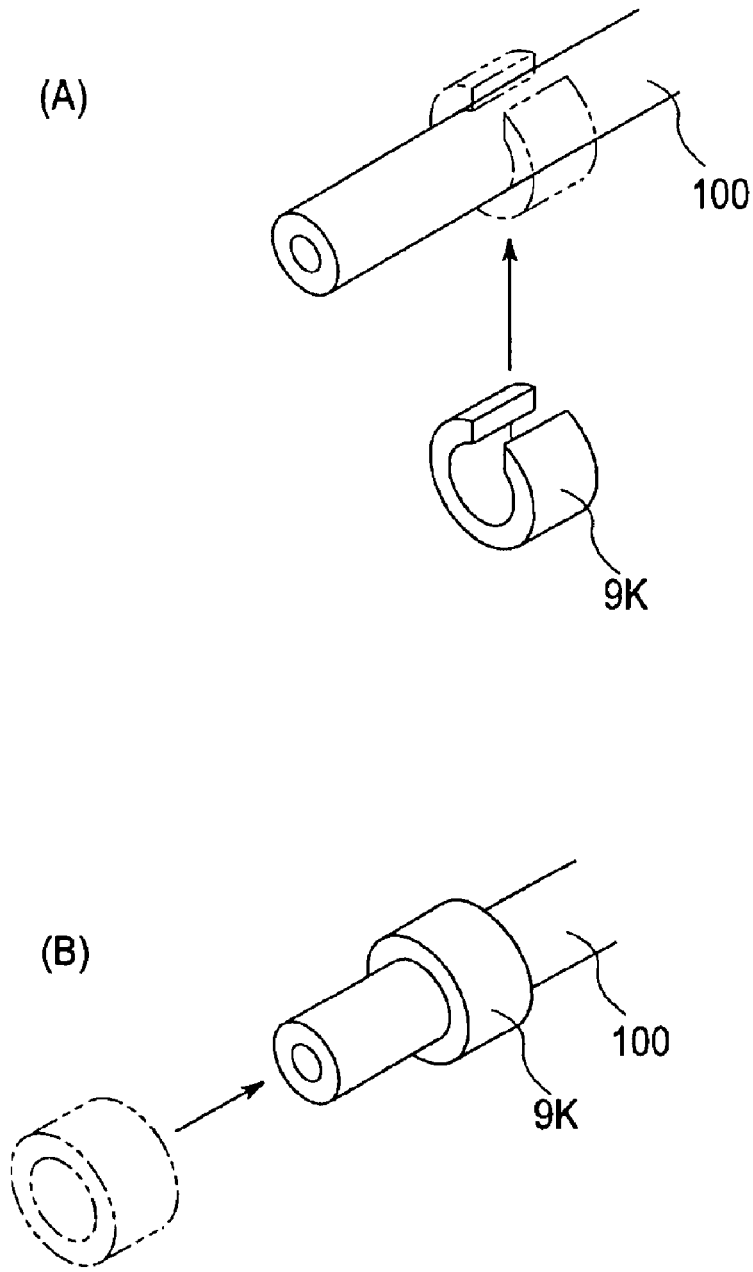
FIGS. 30A and 30B are perspective views of stoppers used in the eleventh embodiment.

The stoppers 9K are formed of the same type of material as the tube 100, such as fluororesin including tetrafluoroethylene. As shown in FIG. 30(A), the stoppers 9K may be formed with a cutaway portion, or, as shown in FIG. 30(B), the stoppers 9K may be formed with the shape of a ring without a cutaway portion. In either case, the stoppers 9K is mounted to the tube 100 by, for example, press-fitting or bonding, so as to be immovable with respect to the tube 100.

Figure 29:
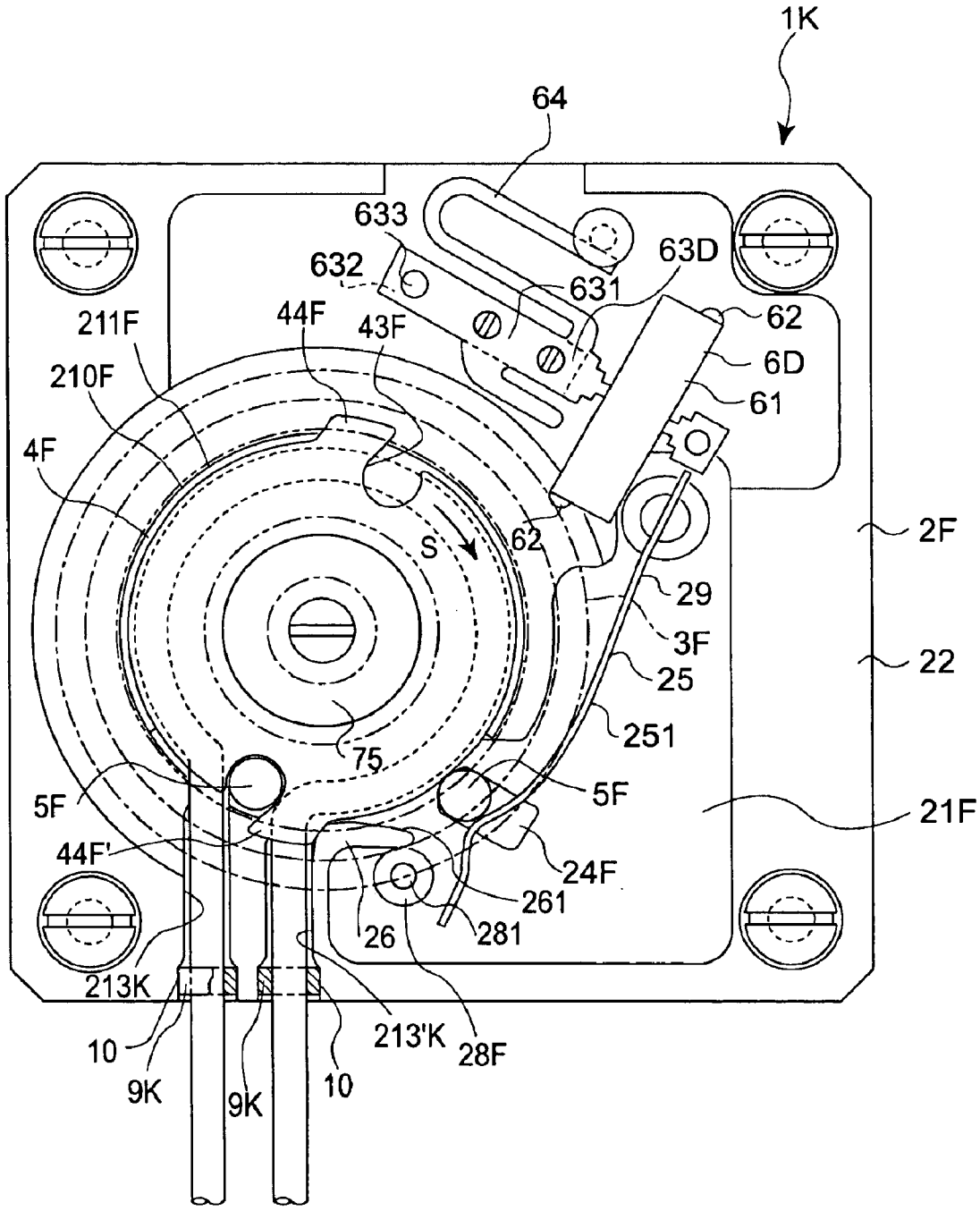
FIG. 29 is a plan view of a liquid discharger of an eleventh embodiment of the present invention.

As shown in FIG. 29, dug-out portions 10 for fitting the stoppers 9K thereto are formed in the grooves 213K and 213'K.

By properly setting the distance between each of the stoppers 9 on the tube 100, a predetermined tension is exerted upon the tube 100 when each of the stoppers 9K is fitted to its corresponding dug-out portion 10, so that the tube 100 is provided in a tensioned state without flexing.

When balls 5F and 5F' roll on the tube 100, the tube 100 is pulled, but, since the stoppers 9K are fitted to the corresponding dug-out portions 10, the liquid discharger 1K is constructed so that tension in a direction opposite to the direction in which the tube 100 is pulled by the balls 5F and 5F' is exerted upon the tube 100. In other words, the stoppers 9K and the dug-out portions 10 form a pulling mechanism for exerting tension on the tube 100.

The eleventh embodiment of the present invention can provide the following advantages in addition to the advantages similar to those of the sixth embodiment.

(11-1) Usually, immediately after a user starts using a liquid discharger, when the balls 5F and 5F' roll on the tube 100, the tube 100 is pulled, so that it is initially stretched or has its resiliency reduced, thereby causing its inside diameter to be changed. Since, by this, the discharge rate is varied, when it is necessary to precisely control the discharge rate, it is necessary to make a test run of the liquid discharger. In contrast to this, in this embodiment, dug-out portions 10 are formed and the stoppers 9K are mounted to the front-end side and the base-end side of the tube 100, so that it is possible to exert a predetermined initial tension on the tube 100. For this reason, it is possible to prevent the tube 100 from moving when the balls 5F and 5F' roll on the tube 100 or the inside diameter of the tube 100 from changing. Therefore, it is possible to restrict changes in the initial discharge rate, so that it is not necessary to, for example, make a test run of the liquid discharger, thereby making it possible to increase work efficiency.

(11-2) Since dug-out portions 10 are formed in the corresponding grooves 213K and 213'K, and the stoppers 9K are fitted to the corresponding dug-out portions 10, the tube 100 is secured at its predetermined position by the stoppers 9K. Therefore, even if the ball 5F rolls on the tube 100, the tube 100 does not move inside a tube guide groove 211F. Consequently, it is possible to prevent errors in the discharge rate of the liquid discharger 1K caused by shifts in the position where the tube 100 is placed.

(11-3) The stoppers 9K may be integrally formed with the tube 100. However, in that case, it is troublesome to produce the tube 100. In contrast to this, in this embodiment, the stoppers 9K and the tube 100 are formed as separate members, so that the tube 100 can be easily produced.

Twelfth Embodiment

Figure 31:
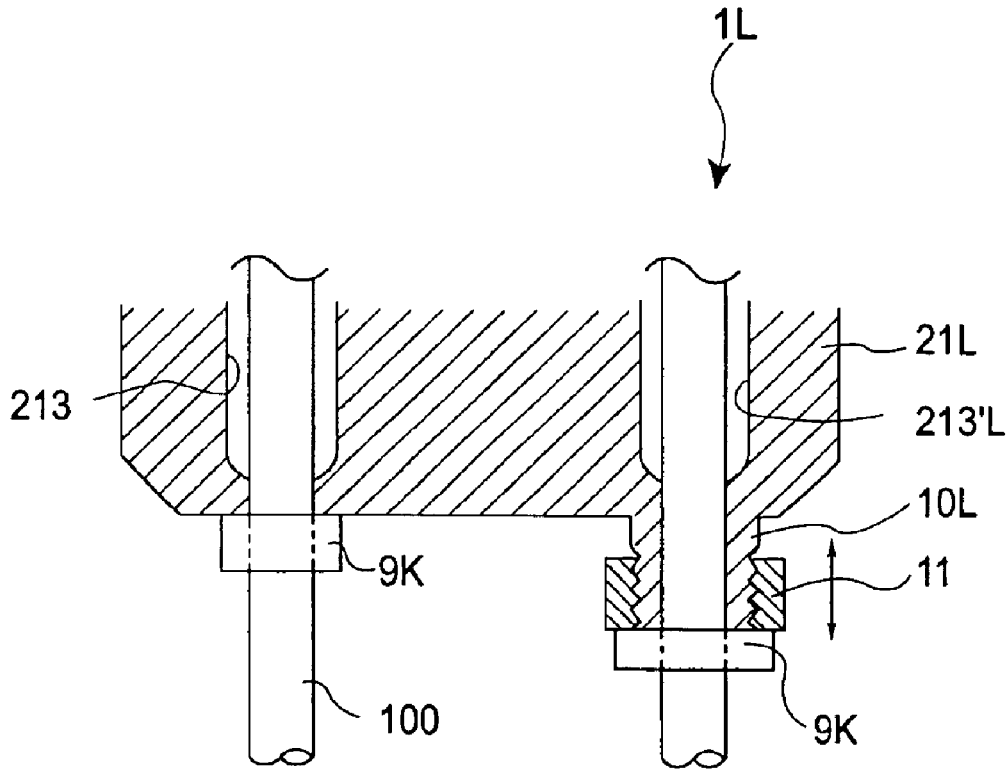
FIG. 31 is a plan view of the main portion of a liquid discharger of a twelfth embodiment of the present invention.

A twelfth embodiment of the present invention will be described using FIG. 31. FIG. 31 illustrates the main portion of a liquid discharger 1L.

In the liquid discharger 1L, a groove-213L'-side portion of a base body 21L protrudes in the direction of the outer periphery of the base body 21L and is formed as a protrusion 10L. The protrusion 10L is threaded and has a nut 11 screwed thereon.

A stopper 9K mounted to the base-end side of a tube 100 stops at an outer-peripheral side surface of the base body 21L.

On the other hand, a stopper 9K mounted to the front-end side of the tube 100 stops at the nut 11 screwed on the protrusion. The mounting position of this stopper 9K can adjusted by the nut 11. Therefore, by adjusting the nut 11, force exerted upon the tube 100 can be adjusted.

The twelfth embodiment of the present invention can provide the following advantages in addition to the advantages similar to those of the eleventh embodiment.

(12-1) Since force exerted upon the tube 100 can be adjusted by adjusting the nut 11, the discharge rate can be finely adjusted by changing the inside diameter of the tube 100 after placing the tube 100. Therefore, it is possible to correct variations in the discharge rate caused by variations in the assembly precision and dimensions of the component parts of the liquid discharger 1L.

Even if the precision with which the stoppers 9K and the nut 11 are mounted to the tube 100 is not so high, force exerted upon the tube 100 can be adjusted later on, so that the tube 100, the stoppers 9K, and the nut 11 can be easily mounted.

(12-2) Since force exerted upon the tube 100 can be adjusted, the tube 100 can be put in a state which allows balls 5F and 5F' to roll most efficiently. Therefore, the rotor 3F can be rotated with minimum force, so that the power supply of the driving mechanism 6D can be made small. Consequently, the liquid discharger 1L can be reduced in size.

Thirteenth Embodiment

Figure 32:
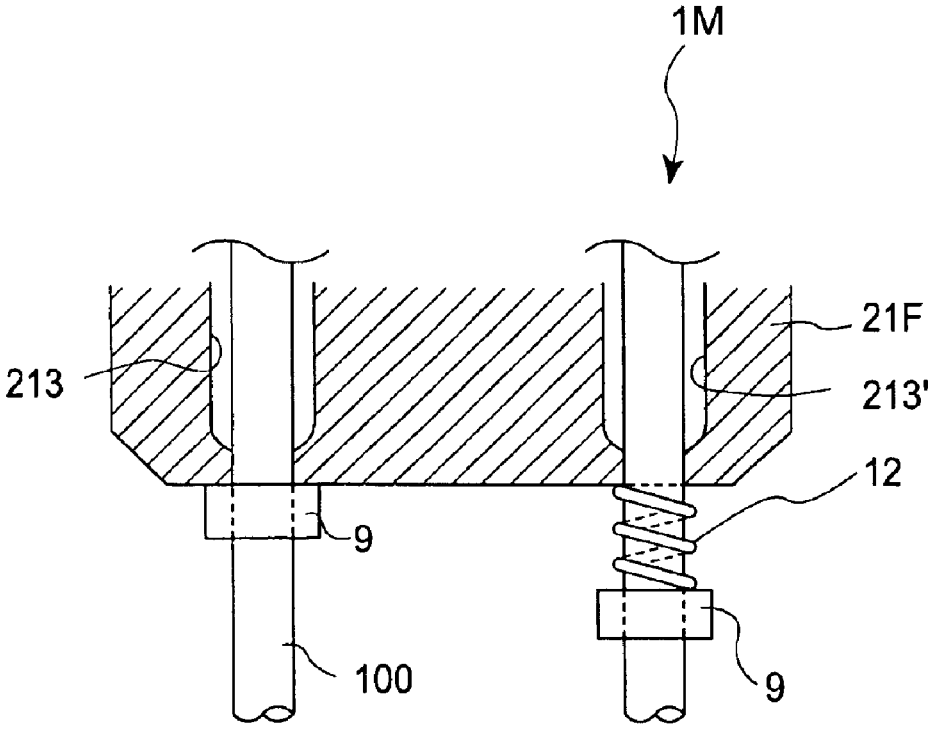
FIG. 32 is a plan view of the main portion of a liquid discharger of a thirteenth embodiment of the present invention.

A thirteenth embodiment of the present invention will be described using FIG. 32. FIG. 32 illustrates the main portion of a liquid discharger 1M.

In the liquid discharger 1M, a stopper 9K is mounted to the base-end side of a tube 100. As in the twelfth embodiment, the stopper 9K stops at an outer-peripheral side surface of a base body 21F.

On the other hand, a stopper 9K is mounted to the front-end side of the tube 100 through a shape memory alloy spring 12. The spring 12 stretches and contracts by the temperature of the tube 100.

Figure 33:
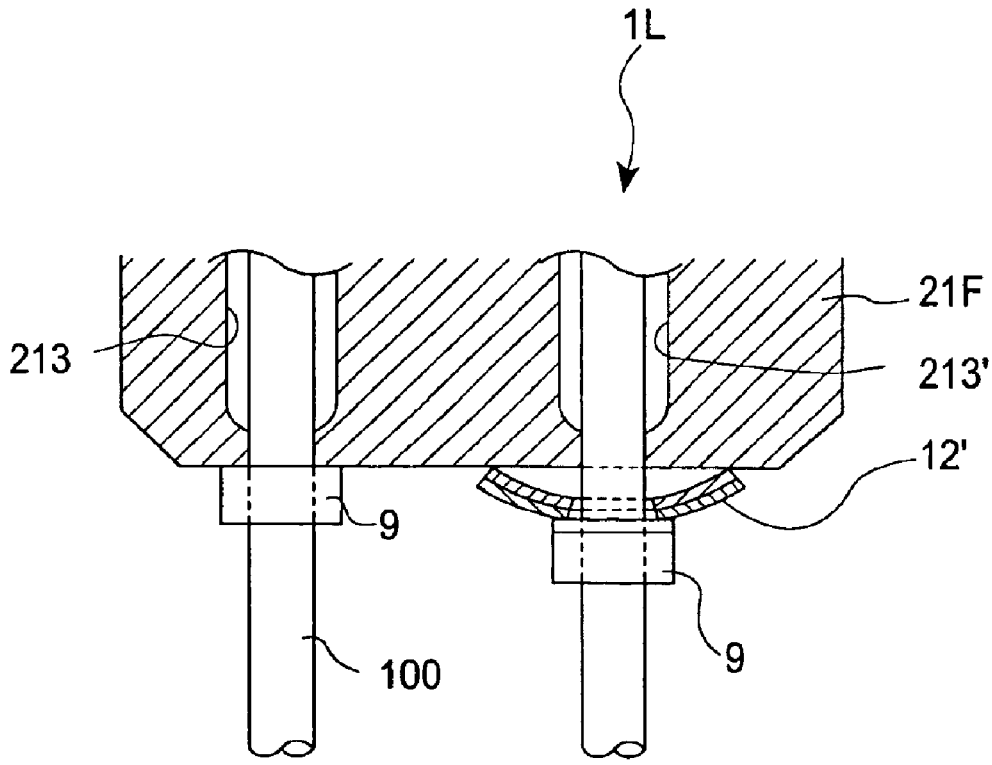
FIG. 33 is a plan view of another type of stopper used in the thirteenth embodiment.

As shown in FIG. 33, instead of the spring 12, for example, a bimetallic plate spring 12', formed by stacking two pieces of metals of different types upon each other, may be used.

The thirteenth embodiment can provide the following advantages in addition to the advantages similar to those of the twelfth embodiment.

(13-1) The size of the tube 100 may change due to, for example, the temperature of the liquid or the temperature of the room where the liquid discharger 1L is installed. In this embodiment, the spring 12 stretches or contracts due to the temperature of, for example, the tube 100, so that, when the tube 100 stretches and contracts, the stopper 9K moves in order to automatically adjust the tension exerted upon the tube 100. Therefore, if the amount by which the spring 12 or the plate spring 12' stretches and contracts with changes in temperature is set in accordance with the amount by which the tube 100 stretches and contracts, the diameter of the tube 100 can be maintained at a constant value even if changes in temperature occur, so that a stable discharge rate can be ensured. Since the spring 12 automatically stretches and contracts according to temperature, it is not necessary to manually adjust the diameter of the tube 100 every time in accordance with, for example, the temperature of the liquid. Therefore, it is not necessary to go to the trouble of making manual adjustments, so that the user can made reliable adjustments without forgetting to make adjustments.

Fourteenth Embodiment

Figure 34:
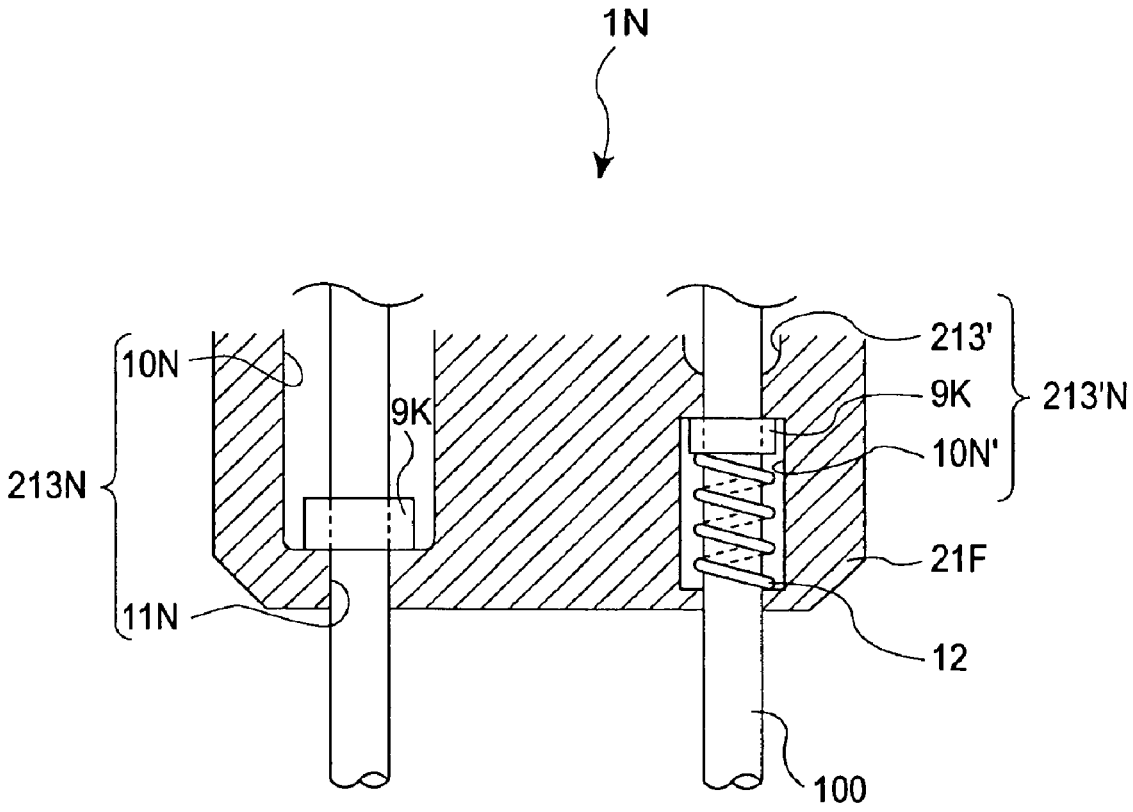
FIG. 34 is a plan view of the main portion of a liquid discharger of a fourteenth embodiment of the present invention.

A fourteenth embodiment of the present invention will be described using FIG. 34. FIG. 34 shows the main portion of a liquid discharger 1M.

A groove 213N includes a large-width portion 10N having a width that is larger than the diameter of a tube 100, and a small-width portion 11N which is a portion of the groove 213N at the base-end side of the tube 100 and which is substantially the same size as the tube 100. A stopper 9K mounted to the base-end side of the tube 100 is set inside the large-width portion 10N of the groove 213N, and stops at a boundary between the large-width portion 10N and the small-width portion 11N.

A groove 213'N includes a groove portion 213' and a dug-out portion 10N' which connects to the groove portion 213'. A stopper 9K mounted to the front-end side of the tube 100 and a shape memory alloy spring 12 are set in the dugout portion 10N'. The location where the spring 12 is mounted to the tube 100 is situated forwardly of the location where the stopper 9K is mounted to the tube 100.

Therefore, the fourteenth embodiment can provide the following advantages.

(14-1) The stopper 9K mounted to the base-end side of the tube 100 stops at the boundary between the large-width portion 10N and the small-width portion 11N, and the stopper 9K mounted to the front-end side of the tube 100 is secured inside the dug-out portion 10N' by the spring 12. Therefore, even if the base-end side and the front-end side of the tube 100 are pulled in the direction of the outer periphery of the base body 21F, the location where the tube 100 is placed is not shifted.

(14-2) In the liquid discharger 1N, the diameter of the tube 100 may become large due to changes in, for example, the temperature of the liquid inside the tube 100. In that case, since the spring 12 stretches and contacts, compression force is exerted on the tube 100, so that changes in the diameter of the tube 100 is prevented from occurring.

Any one of the above-described liquid dischargers 1A to 1N may be used by incorporating it in the following apparatuses.

Apparatus 1 Incorporating Liquid Discharger

Figure 35:
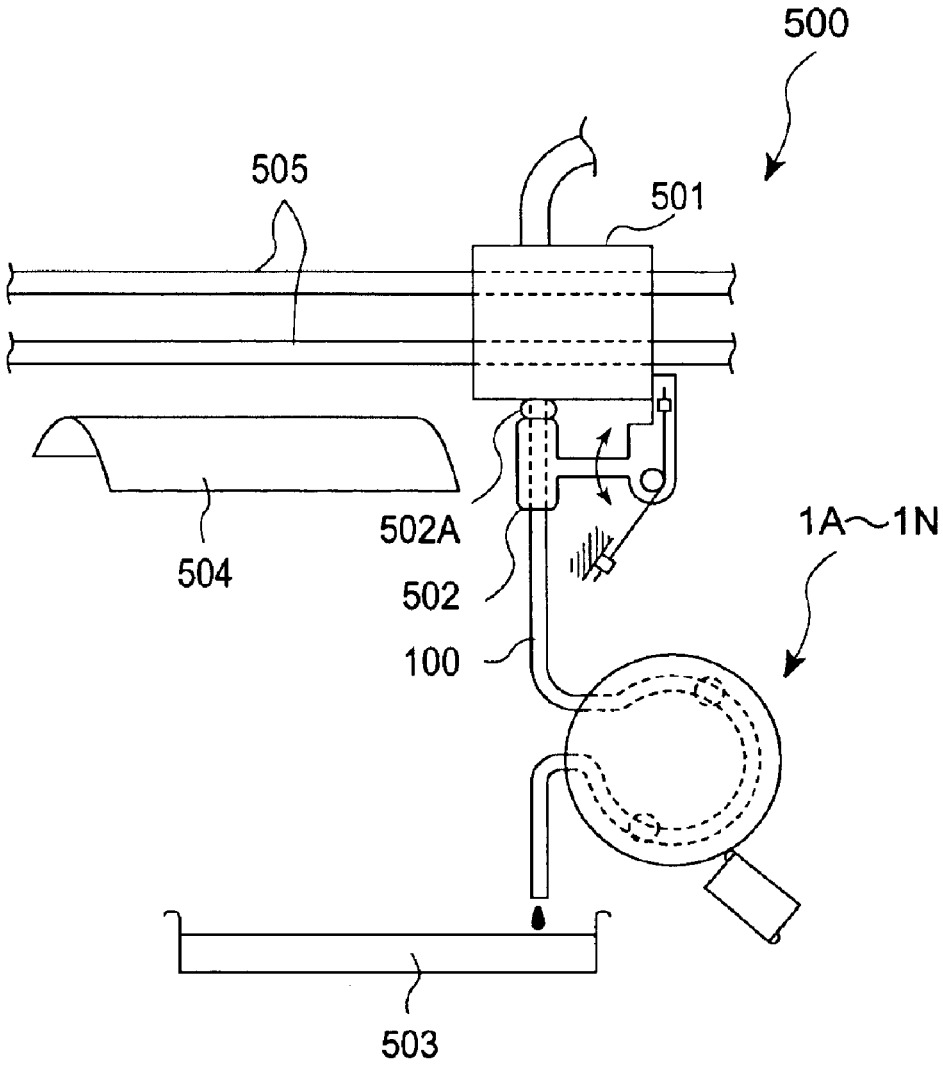
FIG. 35 shows a printer including the liquid discharger of any one of the first to fourteenth embodiments.

For example, as shown in FIG. 35, any one of the liquid dischargers 1A to 1N may be incorporated in a printer 500 for sucking up ink. The printer 500 comprises a printer head 501 which moves along guide rails 505 to discharge ink onto paper 504.

A tube head 502 which is rotatably disposed and which is fixed by a spring is mounted to one end side (i.e. the intake side, or sucking side) of the tube 100 used in any one of the liquid dischargers 1A to 1N. When the printer head 501 returns to its standby position (position shown in FIG. 35), the tube head 502 rotates against the biasing force of the spring, so that a shock absorption pad 502A mounted to the tube head 502 comes into close contact with an end of a nozzle of the printer head 501.

On the other hand, an ink absorption pad 503 is provided at the other end side (discharging side) of the tube 100.

In such a printer 500, any one of the liquid dischargers 1A to 1N is used for sucking out ink or air from an ink ejection nozzle of the printer head 501 disposed at the standby position.

In other words, when a new ink cartridge is mounted, any one of the liquid dischargers 1A to 1N is used to draw ink to the nozzle from an ink tank of the cartridge. Any one of the liquid dischargers 1A to 1N is used when, before reusing the printer 500, deteriorated ink having, for example, high viscosity remaining in, for example, the nozzle is sucked by any one of the liquid dischargers 1A to 1N in order to discharge this ink from the front-end of the tube 100 to the ink absorption pad 503. By this, it is possible to prevent a reduction in the quality of an image occurring due to a change in the way the ink flies out from the nozzle to the paper or in the amount of ink flying out from the nozzle to the paper caused by an increase in the viscosity of the ink.

Any one of the liquid dischargers 1A to 1N may be used to suck, along with the ink, air bubbles generated in, for example, the nozzle, an ink path inside the head 510, or the portion of the tube extending from the cartridge to the head 501 and to discharge them to the ink absorption pad 503.

In this way, when any one of the liquid dischargers 1A to 1N of the present invention is used as a pump that is incorporated in the printer 500, it can provide the following advantages.

More specifically, since any one of the liquid dischargers 1A to 1N of the present invention is a thin, small pump, it is possible to reduce the space used for setting it, so that the printer can be smaller and thinner.

In addition, it is possible to efficiently discharge deteriorated ink or ink mixed with air bubbles from the nozzle, so that a high-quality image can be stably printed.

Apparatus 2 Incorporating Liquid Discharger

Figure 36:
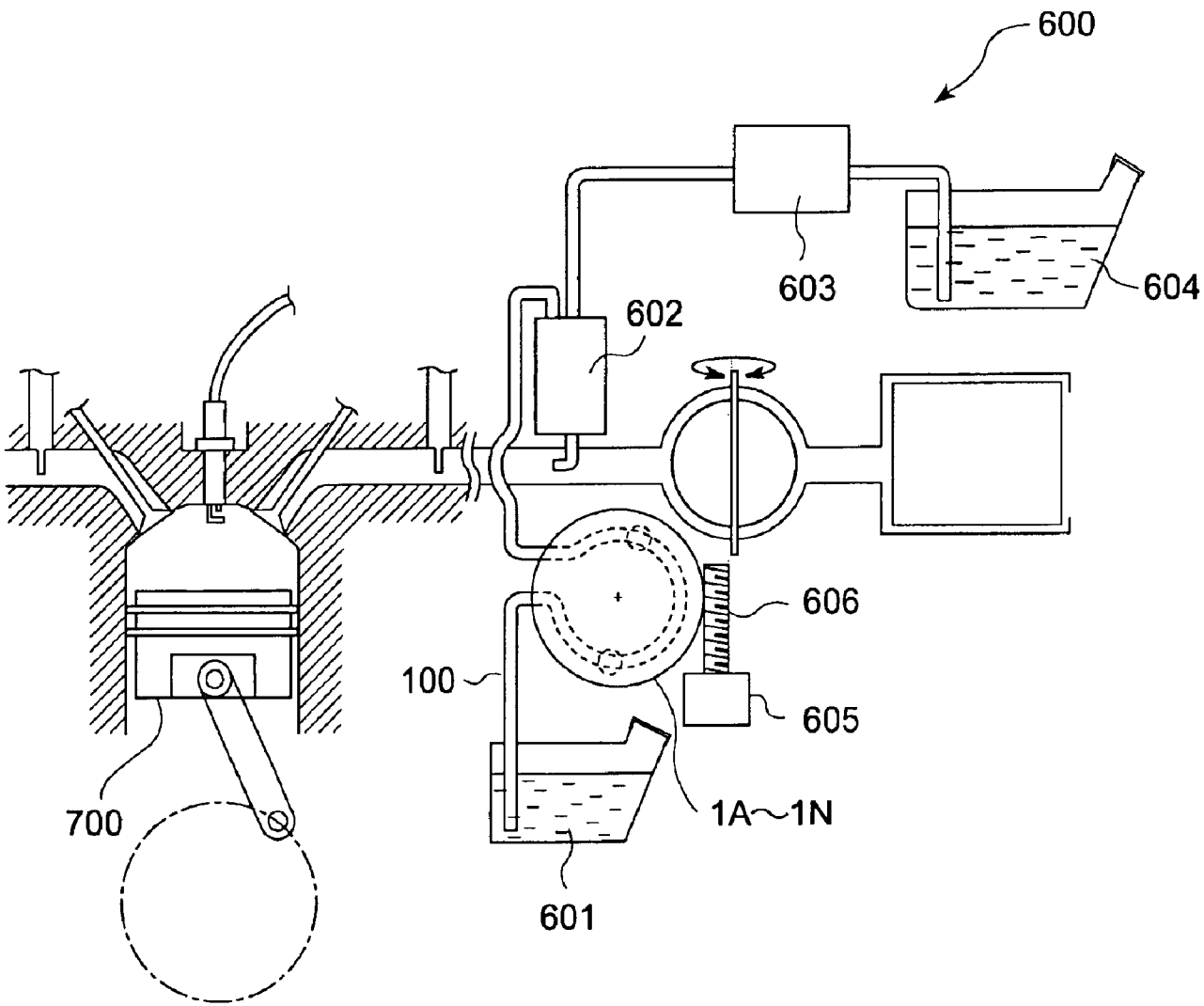
FIG. 36 shows an additive discharger including the liquid discharger of any one of the first to fourteenth embodiments.

FIG. 36 illustrates an additive discharger 600 which incorporates any one of the liquid dischargers 1A to 1N. The additive discharger 600 is used to, for example, mix gasoline or the like with an additive.

The base-end side (sucking side) of the tube 100 used in any one of the liquid dischargers 1A to 1N is connected to an additive tank 601. On the other hand, the front-end side (discharging side) of the tube 100 is connected to a fuel injector 602. Gasoline, which serves as fuel, is sent into the fuel injector 602 from a fuel tank 604 through a fuel pump 603.

By any one of the liquid dischargers 1A to 1N, the gasoline is mixed with an additive. The gasoline mixed with the additive is sent into an engine 700.

As a driving mechanism of any one of the liquid dischargers 1A to 1N, there may be used a combination of a worm gear 606, which can be driven by a direct-current (DC) motor 605, and a tooth formed by cutting away a side surface of a rotor; or a gear which is superimposed on the rotor and driven by the DC motor 605. By this, electrical power of, for example, a battery can be used to drive the motor 605 only by voltage conversion, so that a drive circuit, such as that used for an electro-mechanical transducer, is not required, thereby reducing the costs of the driving mechanism.

In this way, by incorporating any one of the liquid dischargers 1A to 1N in the additive discharger 600, the additive mixing amount can be precisely and finely controlled by controlling the driving of the motor 605 in accordance with, for example, the air-fuel ratio, accelerator opening, exhaust gas concentration, and temperature. Therefore, the engine can be driven in an optimal state. In addition, since any one of the liquid dischargers 1A to 1N can be made thinner, the amount of space used to set it can be made small, thereby making it easier to incorporate it around the engine.

Apparatus 3 Incorporating Liquid Discharger

The present invention may be applied to a heat transfer system for transferring heat by circulating heat transfer fluid as a result of providing any one of the liquid dischargers 1A to 1N of the present invention between a heat absorber and a radiator which are connected by a tube filled with heat transfer fluid.

Figure 37:
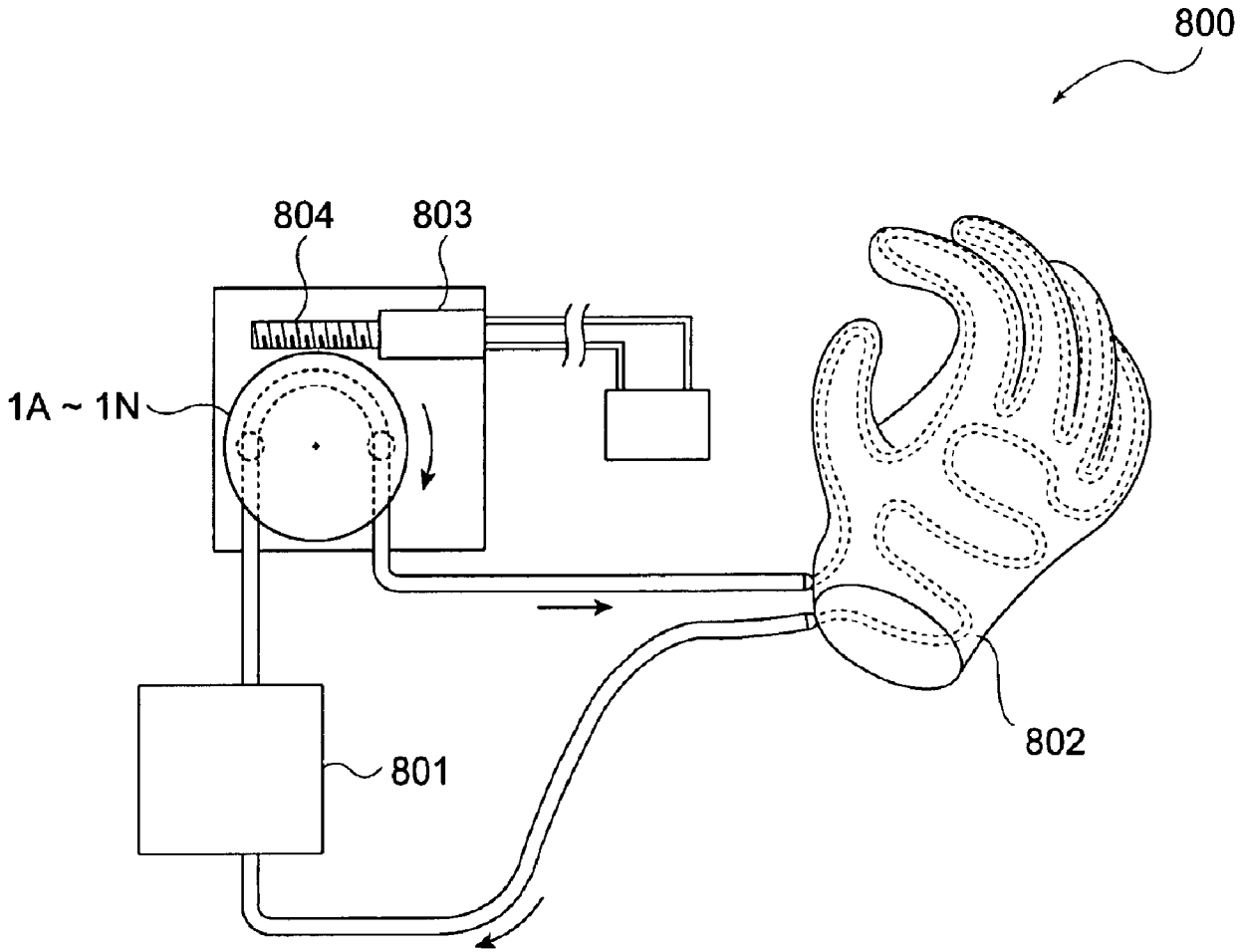
FIG. 37 shows a glove system for heat insulation including the liquid discharger of any one of the first to fourteenth embodiments.

FIG. 37 shows a glove system 800 for heat insulation which makes use of exhaust heat of an engine, which is taken as one example of the heat transfer system. The glove system 800 for heat insulation is a system, having a heat absorber 801 mounted near an engine cylinder of a motorbicycle or the like, used to transfer warmed heat transfer fluid to a radiator inside a glove 802 by any one of the liquid dischargers 1A to 1N. The heat transfer fluid which has been sent to the radiator returns again to the heat absorber 801. The base-end side of the tube 100 used in any one of the liquid dischargers 1A to 1N is connected to the heat absorber 801, and the front-end side thereof is connected to the radiator. An example of a driving mechanism of any one of the liquid dischargers 1A to 1N is a worm gear 804 which can be driven by a direct-current motor 803.

Although, as a power supply of the driving mechanism, a special-purpose battery may be used, a battery for a motorbicycle or the like may also be used.

For the heat absorber, a water jacket of a liquid-cooled engine may be used; and for the heat transfer fluid, an engine radiator liquid may be used. A flexible tube through which heat transfer fluid flows may be wound upon the outer periphery of the engine and used as a radiator.

For example, a radiator in which a flexible tube is wound between the inside and the outer skin of the glove may be used.

By using any one of the liquid dischargers 1A to 1N, the following advantages can be provided.

Since the glove 802 can be warmed by the exhaust heat of the engine, the energy can be reused. A new energy source required to warm the glove 802 only needs to provide electrical power for turning any one of the liquid dischargers 1A to 1N, so that energy can be saved. In addition, since the electrical power required is smaller compared to that required in a glove system for heat insulation of a type in which electrical current is made to flow through a thermoelectrical wire, it is possible to reduce the capacity of a battery or a generator.

Apparatus 4 Incorporating Liquid Discharger

Figure 38:
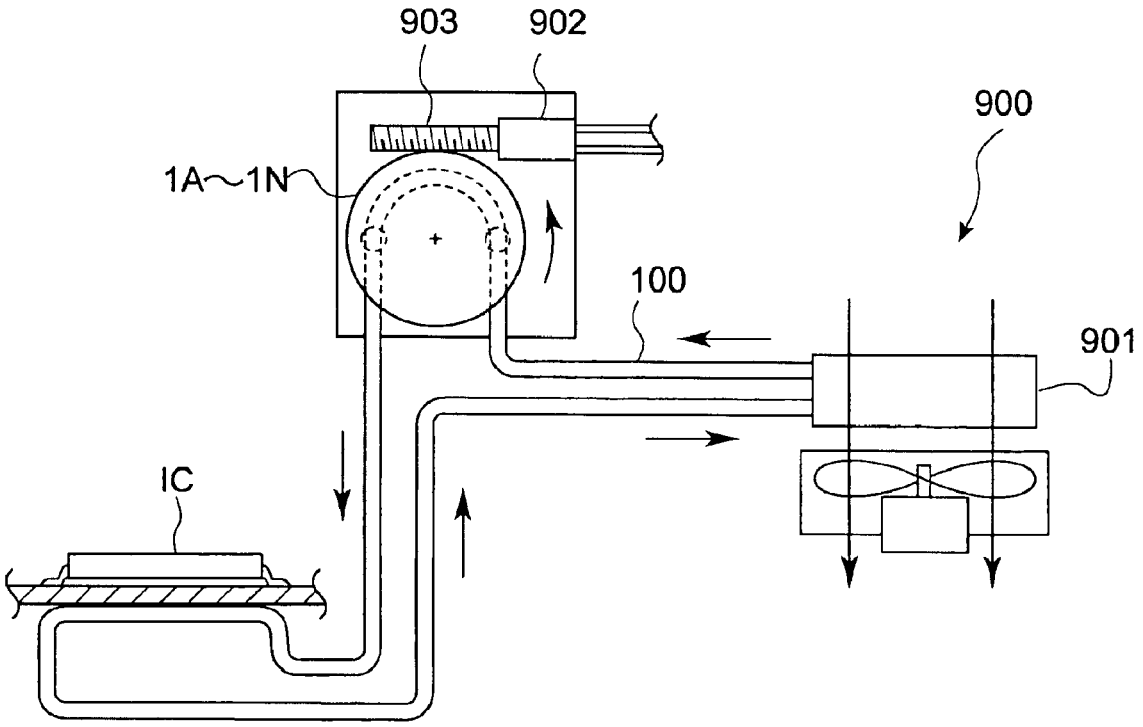
FIG. 38 shows a personal computer including the liquid discharger of any one of the first to fourteenth embodiments.

FIG. 38 shows a personal computer 900 which incorporates any one of the liquid dischargers 1A to 1N used for an integrated circuit (IC) cooling system, which is taken as another example of a heat transfer system. A radiator 901 is connected to one end of the tube 100 of any one of the liquid dischargers 1A to 1N. The other end of the tube 100 is disposed near the IC and is connected to the radiator 901.

Liquid cooled by the radiator 901 flows from one end to the other end of the tube 100. Since the IC is disposed at the other end side of the tube 100, liquid inside the tube 100 absorbs the heat of the IC and the warmed liquid is sent into the radiator 901.

It is desirable that the tube 100 be formed of a metal in order to increase thermal conductivity near the IC. It is more desirable that a heat-absorption fin for increasing heat absorption area be provided. Therefore, it is desirable that the portion of the tube 100 near the IC be formed of a material which has high thermal conductivity and which can be easily formed into a tubular shape (for example, for provided a fin), such as aluminum, copper, or an alloy thereof.

Depending on the place of use or object to be cooled, a pipe or tube formed of resin or the like may be used considering how easy it is to route it even if its thermal conductivity is low. In addition, such a metallic or resinous tube mentioned above and a resilient resinous tube disposed inside any one of the liquid dischargers 1A to 1N may be joined together to form the tube 100.

The radiator 901 is disposed near a radiating fan disposed, for example, at the back side of the personal computer, and can efficiently dissipate heat by wind from the fan flowing to the radiator 901.

Although the tube 100 may be directly disposed near the IC, it may be disposed at the back of a device mounting surface of a substrate as shown in FIG. 38.

As a driving mechanism of any one of the liquid dischargers 1A to 1N, a worm gear 903 which can be driven by a direct-current (DC) motor 902 may be used. In that case, when the driving/stopping of any one of the liquid dischargers 1A to 1N is controlled by a thermostat which operates in accordance with the temperature of the IC, the temperature of the IC can be effectively maintained at a constant value.

By using any one of the liquid dischargers 1A to 1N, the following advantages can be provided.

Since, by any one of the liquid dischargers 1A to 1N, liquid which has been cooled by the radiator 901 can be circulated to cool the IC, the personal computer 900 system is stabilized, so that high-density mounting is achieved and processing speed is increased.

The present invention is not limited to the above-described embodiments, so that the present invention encompasses modifications, improvements, and the like within the scope which allows the objects of the present invention to be achieved.

Figure 39:
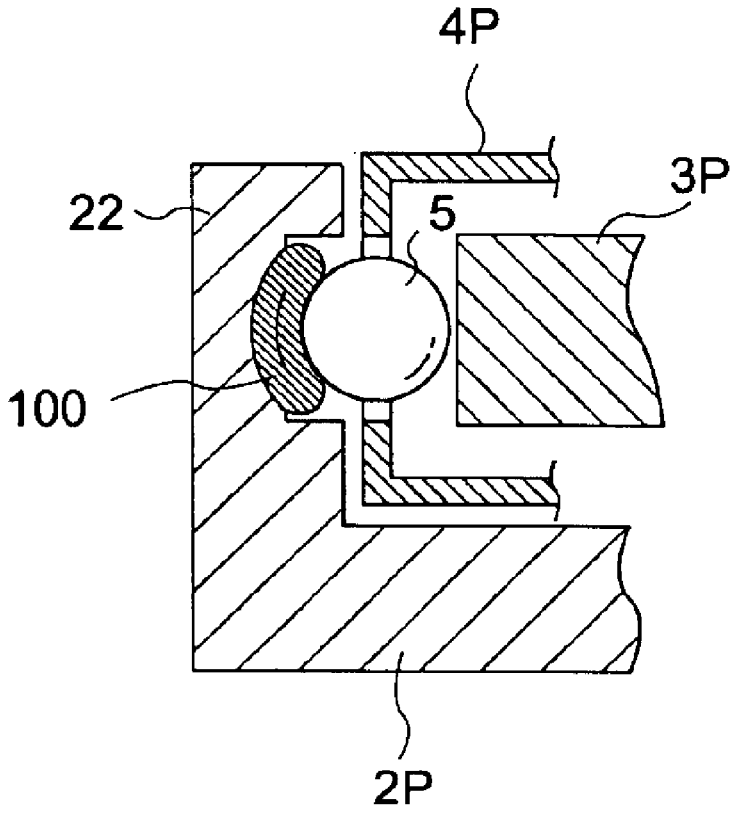
FIG. 39 is a sectional view of a modification of the present invention.

For example, although in each of the embodiments, a ball 5 presses and squashes the tube 100 from the top surface of the tube 100, as shown in FIG. 39, it is possible to set a tube 100 at a side surface of a wall 22 of a base 2P, hold the ball 5 by the side surface of a retainer 4P, and to push the ball 5 from the side surface of the tube 100 in order to press and squash the tube 100. In that case, a pusher member 3P is disposed opposite to the tube 100 with the ball 5 disposed between the pusher member 3P and the tube 100.

When the liquid discharger is constructed in this way, the tube 100 is disposed at the outer peripheral side of the retainer 4P. Accordingly, compared to the above-described embodiments, the planar area of the liquid discharger becomes large, but the height can be reduced, so that the liquid discharger can be made thinner.

Although, in each of the above-described embodiments, the balls 5 to 5F' are pushed by their corresponding rotors 3A to 3F, the present invention is not limited thereto. For example, it is possible to provide a rotary shaft at the balls and to push the balls using the rotary shaft in order to press and squash the tube.

Although, in the first to fifth embodiments, the cross sectional shapes of the contact surfaces 211 of the tube guide grooves 211A, 211B, and 211D that contact the tube 100 are arc shapes formed concentrically with the balls 5 to 5B, the present invention is not limited thereto, so that, as in the sixth embodiment, the cross sectional shapes may be shapes that linearly approximate to an arc shape.

In addition, the central portions of the cross sections of the contact surfaces 211 of the corresponding tube guide grooves 211A, 211B, and 211D that contact the tube 100 may be simply recessed in order to form, for example, a cross-sectional triangular shape. In that case, the distance from each cross sectional central portion to the ball 5 and the distance from each cross sectional edge to the ball 5 are sometimes slightly different. However, when the tube 100 is pressed, the tube 100 deforms along the shapes of the tube guide grooves 211A, 211B, and 211D. Therefore, compared to the case where the contact surface that contacts the tube 100 is flat, it is also possible to press both edges of the tube 100, so that the precision of the discharge rate from any of these liquid dischargers can be good.

Figure 40:
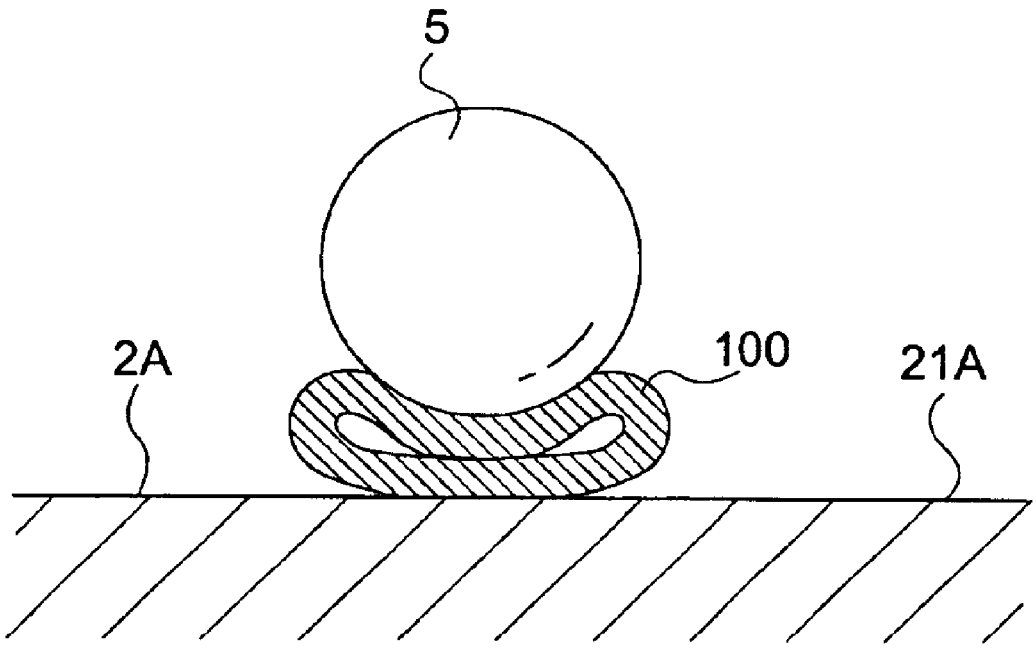
FIG. 40 is a sectional view of a modification of the present invention.
Figure 41:
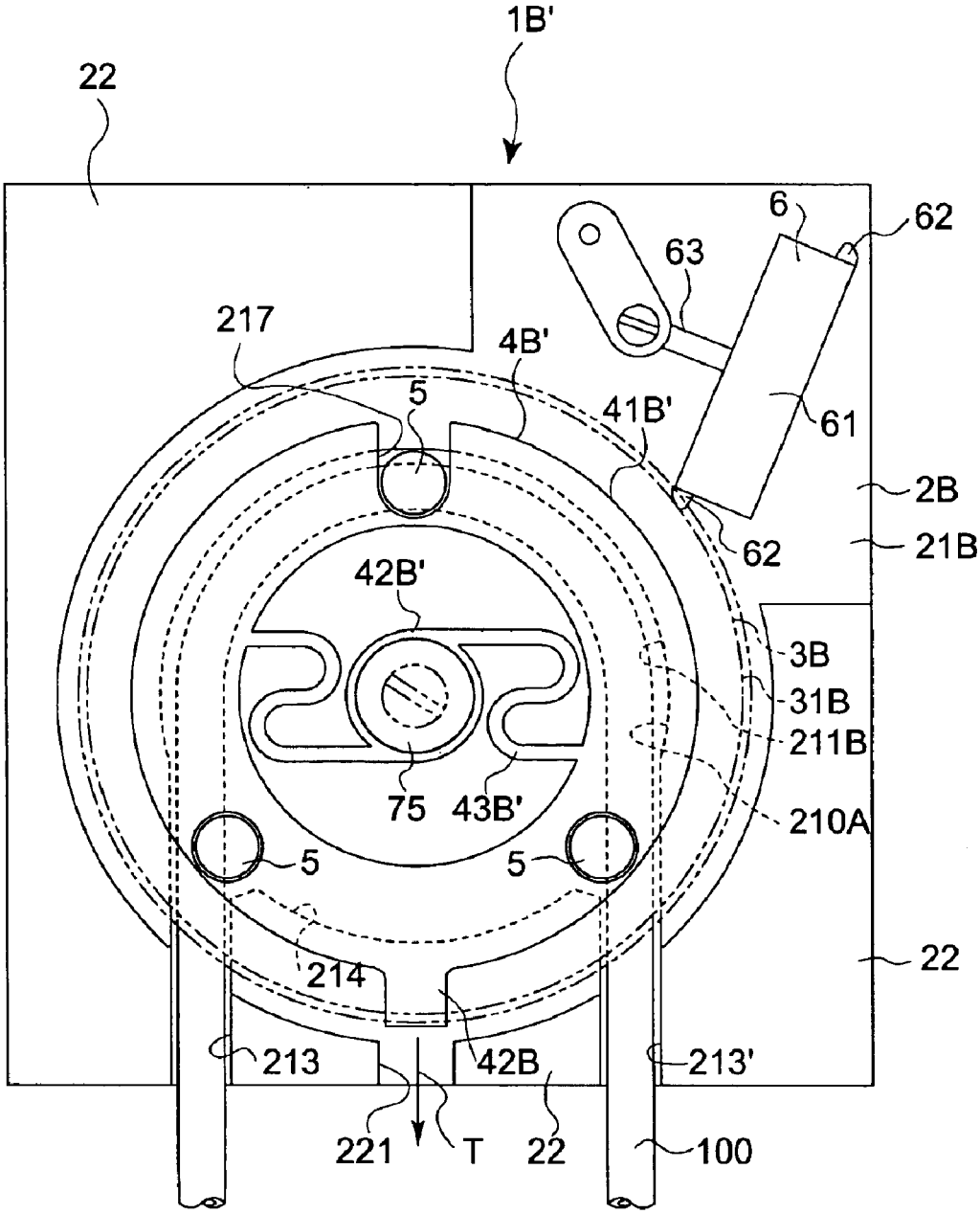
FIG. 41 is a plan view of a modification of a liquid discharger of the present invention.

As shown in FIG. 40, a contact surface defining a tube guide groove that contacts the tube 100 can be made flat. However, in that case, spaces may be left at both end portions of the tube 100 in the widthwise direction thereof because only the central portion of the tube 100 in the widthwise direction is pressed and squashed. Therefore, it is difficult to substantially completely squash the opening of the tube 100 by pressing it. Since the remaining spaces are approximately constant in size, it is possible to discharge liquid with a certain precision although the precision of the discharge rate is reduced compared to the precisions of the discharge rates of the liquid dischargers of the first to fourteenth embodiments. Therefore, this structure may be used when a very high precision is not required.

In each of the above-described embodiments, the tube guide grooves 211A to 211F do not need to be formed in the corresponding bases 2A to 21L as long as the tube 100 can be disposed without the tube guide grooves 211A to 211F. Including the case shown in FIG. 40, however, it is better to form the tube guide grooves 211A to 211F because it provides the advantage that the tube 100 can be easily set in its predetermined position.

Although in the second embodiment, the retainer 4B has the elliptical shaft hole 41B, the present invention is not limited thereto, so that a structure such as that shown in FIG. 4I may be used. A retainer 4B' of a liquid discharger 1B' has its inner peripheral side punched out, and includes a ring 41B' including a ball holding section and a central portion 42B' for receiving a shaft section 7 through a ball bearing 75. The central portion 42B' and the ring 41B' are connected by a spring 43B'. In that case, when the retainer 4B' is pulled in the direction of arrow T, the spring 43B' is deformed, so that the position of the ring 41B' of the retainer 4B' can be shifted. By this, the pressing-and-squashing operation of a ball 5 on a tube 100 can be cancelled.

It is desirable that the retainer 4B' be, for example, a plastic or a stainless-steel plate.

Although in the liquid discharger 1B of the second embodiment the pressing-and-squashing operation of the balls 5 on the tube 100 is cancelled by pulling the handle 42B of the retainer 4B and displacing the balls 5 from the top surface of the tube 100, the pressing-and-squashing operation of the balls 5 on the tube 100 may be cancelled by loosening the screw at the shaft section 7 and raising the rotor 3B that is pushing the balls 5. However, when such a structure is used, the screw needs to be tightened when the user is using the liquid discharger 1B. It is difficult to expect the user to tighten the screw properly. For this reason, the height of the rotor 3B varies, so that the pressure used to push the balls 5 changes. Therefore, the problem that the discharge rate of the liquid changes may arise. However, when a structure such as that of the second embodiment is used, the pressing-and-squashing operation of the balls 5 on the tube 100 is cancelled without the height of the rotor 3B being changed, so that the liquid discharger 1B can be made handy.

Although, in the present invention, the liquid discharger may be of any size, it is desirable that, for example, the diameter of the large-diameter portion 721 of the flange 72 of the shaft section 7 be 8 mm, the diameter of the circle of the inner periphery of each of the circular grooves 210A to 210J be 9 mm, the diameter of the circle of the outer periphery of each of the circular grooves 210A to 210J be 9 mm, the diameter of each of the retainers 4A to 4J be 14 mm, the outside diameter of the tube 100 be 1 mm, the inside diameter (opening diameter) of the tube 100 be 0.5 mm (therefore, the thickness T of the tube 100 is equal to 0.25 mm), and the diameters of the balls 5 to 5F' be of the order of 1.6 mm.

The number of balls is not limited to those in the above-described embodiments, so that any number of balls may be used. In the fourth and fifth embodiments, however, two or more balls need to be provided.

Although, in the fourth embodiment, the recess 312D and the ball guide groove 315D are formed, two ball guide grooves may be formed without forming the recess 312D. However, in that case, when the rotor 3D is rotated in the reverse direction, a member for moving the ball 5A from the front-end to the back-end of the ball guide groove in the direction of rotation thereof needs to be separately provided. In addition, when two ball guide grooves are formed, the processing amount of the rotor 3D is increased, thereby resulting in the problem that it is troublesome to form the rotor 3D. In contrast to this, in the fourth embodiment, the recess 312D is formed, so that it is not necessary to separately provide a member for returning the ball 5A to its initial position, thereby making it possible to reduce the number of component parts. In addition, since the recess 312D is formed, the processing amount is small, so that it is not troublesome to form the rotor 3D.

As in the fifth embodiment, two ball guide grooves 48E may be formed.

Although, in the sixth to tenth embodiments, a lead-in ball is retained by the outer peripheral edges of the retainers 4F, 4G, 4H, and 4I by the corresponding urging means 25, 25G, and 25H, the present invention is not limited thereto, so that there may be used a structure in which at the same time that the ball holding sections 43F, 45G, 47H, and 43I of the corresponding retainers 4F, 4G, 4H, and 4I reach their corresponding ball lead-in ranges 235 and, 235G, the lead-in ball 5A is pushed in order to lead it into the corresponding ball holding sections 43F, 45G, 47H, and 43I.

Although, in the sixth embodiment, the lead-in ball disposition groove 24F includes a slope 242, the slope 242 does not necessarily need to be formed when there is no or a slight difference in level between the flat portion 241 where the lead-in ball 5A is initially disposed and the top portion of the tube 100 in the ball lead-in range 235.

Although, in the sixth and seventh embodiments, the distance from the bottom surface of the rotor 3F to the top portion of the tube 100 in the corresponding ball lead-in ranges 235 and 235G is set greater than the height of the lead-in ball 5F due to the corresponding tube guide grooves 211F and 211G, the present invention is not limited thereto. Accordingly, as long as the lead-in ball 5F can be led into the ball holding sections 43F and 45G of the corresponding retainers 4F and 4G, the distance from the bottom surface of the rotor 3F to the top portion of the tube can be any value. However, when the distance is less than the height of the lead-in ball 5F, it is necessary to increase the spring forces of the corresponding urging means 25 and 25G for biasing the lead-in ball 5F.

In the sixth embodiment, catch sections 44F and 44F' are provided. The shapes and structures thereof are not limited to those shown in FIG. 12, so that one can properly decide what shapes and structures to use considering the size of the lead-in ball 5F, the rotating speed of the retainer 4F, the materials used, and the like.

In the sixth embodiment, a guide protrusion 26 having a guide surface 261 is provided. One can properly decide the angle of the guide surface 261 with respect to the paths of the ball holding sections 43F and 43F' based on the rotating speed of the retainer 4F, the frictional resistance between the surface of the lead-in ball 5F and the guide surface 261, and the like.

Although, in the sixth embodiment, the detecting means 28F is constructed using the catch sections 44F and 44F' of the retainer serving as shape-change portions, the present invention is not limited thereto, so that, as in the seventh embodiment, cutaway portions 46G and 46G' may be formed as change shape portions. The point is that anything may be used as long as the shape of the retainer 4F is changed in relation to the arcuate outer peripheral edge of the retainer 4F.

Although, in the tenth embodiment, the ball lead-in groove 237 has an inclined surface Z and an inclined surface Y, a flat surface may be formed instead of the inclined surfaces, so that it may be one having a cross sectional central portion simply formed as a protrusion (cross sectional protruding shape). Even in that case, when the lead-in ball moves in the forward direction, it passes the back-side surface, and, when the lead-in ball moves in the reverse direction, it passes the outer-peripheral-side surface of the base body. Therefore, it is possible to smoothly move the ball onto the tube and to return the ball to its initial position.

In addition, the cross sectional central portion does not need to be formed as a protrusion. Even in that case, when the retainer 4J rotates in the forward direction, the lead-in ball is guided to the back side of the ball holding section 44J by the cutaway portion that forms the ball holding section 44J and the ball guide surface 243J. Therefore, the lead-in ball 5F can be reliably held. On the other hand, when the retainer 4J rotates in the reverse direction, the lead-in ball 5F can be returned to its initial position by the first initial position guide surface 219I and the second initial position guide surface 431J of the ball holding section 43J.

As in the sixth embodiment, in the tenth embodiment, a guide protrusion 26 may be formed in order to, by a guide surface 261, guide the lead-in ball 5F to the ball holding section 43J. When such a structure is used, the lead-in ball 5F can be more reliably led into the ball holding section 43J.

Although, in each of the embodiments, the coefficient of friction between the ball and the tube is less than the coefficient of friction between the tube guide groove and the tube, the coefficients of friction may be of the same order or the coefficient of friction between the tube guide groove and the tube may be made smaller. In these cases, by providing a stopper as in the twelfth to fourteenth embodiments, it is possible to prevent the tube from moving out of the tube guide groove.

Although, in each of the embodiments, power is transmitted to the outer peripheral edge of each of the rotors 3A to 3F, the present invention is not limited thereto, so that there may be used a structure in which power is transmitted to the shaft of the rotor.

Although, in the first to sixth embodiments and the eighth to fourteenth embodiments, the rotors are directly rotated by the oscillating bodies 61 of the corresponding driving mechanisms 6 and 6D, the present invention is not limited thereto, so that, depending on the capacities of the drive sources and the load of the liquid dischargers, a transfer mechanism 15, formed of a train of wheels, may be provided as in the seventh embodiment.

In each of the above-described embodiments, a ball bearing 75 is provided at the shaft section 7, but the present invention is not limited to this structure. A bearing may be formed by using a highly lubricant bush. When such a structure is used, it is possible to reduce variations in the pushing force of the rotor caused by backlash of the bearing itself in the vertical direction.

Figure 42:
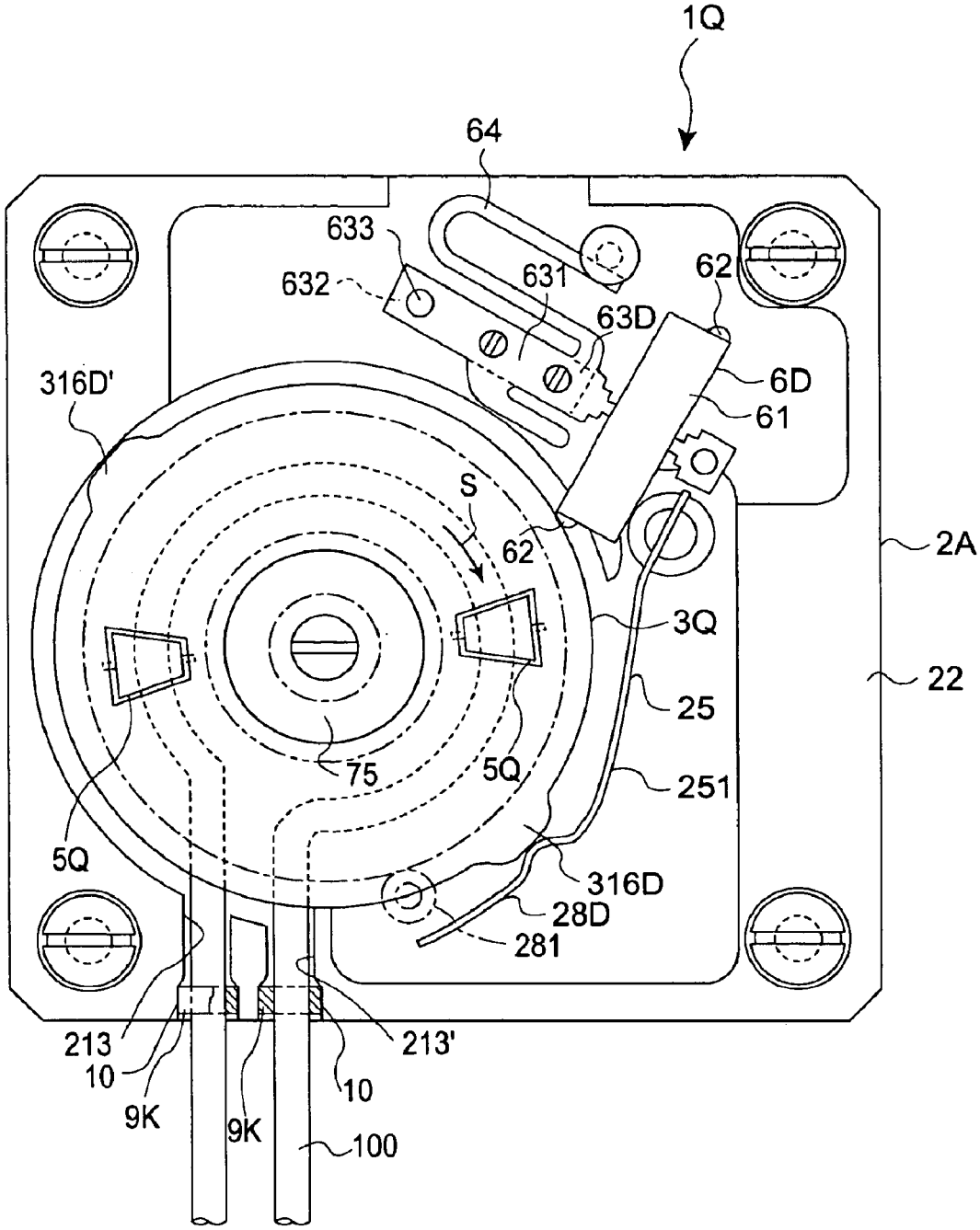
FIG. 42 is a plan view of a modification of a liquid discharger of the present invention.

Although, in the eleventh to fourteenth embodiments, the tube 100 is pressed and squashed using the balls 5F and 5F', the tube 100 may be pressed and squashed using a conical roller 5Q as in a liquid discharger 1Q shown in FIG. 42. In that case, compared to the case where balls are used, a larger frictional force is exerted upon the tube 100. However, since the tube 100 is secured by the stoppers 9K, it is possible to prevent shifting of the tube 100 and changes in the inside diameter of the tube occurring when the tube 100 is pulled. In the liquid discharger 1Q, in order to detect rotation, protrusions 316D and 316D'may be formed in a rotor 3Q as in the rotor 3D.

The application of these liquid dischargers is not limited to the above-described apparatuses 500 to 900. It may also be used in, for example, medical droppers or other drug injectors, or small portable devices used when injecting very small amounts for a long period of time.

Advantages

The present invention provides a first advantage in that it can provide a liquid discharger which can be made more durable, can be made smaller in size, and can be easily assembled.

The present invention provides, in addition to the first advantage, a second advantage in that it can provide a liquid discharger which makes it possible to reduce errors occurring in the discharge rate.

Further, the present invention provides a third advantage in that it can provide a liquid discharger which makes it possible to increase work efficiency.

Still further, the present invention provides an advantage in that it can provide an apparatus including any one of the above-described liquid dischargers.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A liquid discharger including a base for placing a resilient tube thereat, the liquid discharger comprising:

at least two balls that roll on the tube while pressing and squashing separate portions of the tube;

a retainer movable along the tube, said retainer having ball holding sections for holding said balls as the balls rotate along the tube;

a driving mechanism for rolling the balls;

a tube guide groove formed in the base for placing the tube therein, wherein the tube guide groove has a cross-sectional shape conforming to the shape of the tube for providing a tube-contacting surface;

wherein the cross-sectional shape of the tube-contacting surface defining the tube guide groove is one of an arc-shape that concentrically conforms to the shape of the ball, or a shape that linearly approximates said arc-shape;

when a radius of the arc-shape is R, a radius of the ball is r, and a thickness of the tube is T, the following Numerical Expression 1 is satisfied:

$$R-2T \leqq r < R-T.$$

2. A liquid discharger according to claim 1, wherein a central portion of the tube-contacting surface is recessed.

3. A liquid discharger according to claim 1, wherein a coefficient of friction between the balls and the tube is smaller than a coefficient of friction between the tube guide groove and the tube.

4. A liquid discharger according to claim 1, further comprising a pusher member disposed opposite to the tube with the balls being disposed therebetween, wherein the balls roll while contacting the pusher member, so that the balls are pushed by the pusher member in order to press and squash said portion of the tube.

5. A liquid discharger according to claim 1:

wherein said base includes an initial starting-position offset from the tube for holding at least one of the balls in a resting state;

wherein said holding sections are effective for holding and rolling the balls so that the ball can roll on the tube;

said liquid discharger further comprising:

a ball-leading section for leading said at least one of the balls from the initial starting-position to one of said ball holding sections for initiation of a non-resting state; and a ball-leading-away section for returning at least one of the balls from one of said ball holding sections to the initial starting-position for initiating said resting state.

6. A liquid discharger according to claim 5 wherein said two balls are a first ball and a second ball, said liquid discharger further comprising:

a pusher member rotatably disposed with respect to the base for pushing each of the first and second balls towards the tube;

wherein a tube-side surface of the pusher member includes a ball mounting section for mounting the first ball thereto so that the first ball can roll, and includes a ball guide groove for movably disposing the second ball thereat;

wherein, when the second ball is at a forward-rotation-direction front-side end defining the ball guide groove, the forward-rotation-direction front-side end defining the ball guide groove is disposed close to the ball mounting section so that the second ball can be disposed at an initial position thereof along with the first ball disposed at the ball mounting section; and wherein a forward-rotation-direction back-side end defining the ball guide groove is the ball holding section.

7. A liquid discharger according to claim 5:

wherein said two balls are a first ball and a second ball;

wherein said ball holding sections of the retainer include a ball mounting section for mounting the first ball thereto so that the first ball can roll, and include a ball guide groove for movably disposing the second ball thereat;

wherein, when the second ball is at a forward-rotation-direction front-side end defining the ball guide groove, the forward-rotation-direction front-side end defining the ball guide groove is disposed close to the ball mounting section so that the second ball can be disposed at an initial position thereof along with the first ball disposed at the ball mounting section; and wherein a forward-rotation-direction back-side end defining the ball guide groove is the ball holding section.

8. A liquid discharger according to claim 5, wherein:

the initial starting-position is misaligned with a trajectory path of the ball holding sections;

at least one of said balls is a lead-in ball disposed at the initial start-position, and the ball-leading section leads the lead-in ball from the initial position to a corresponding ball holding section.

9. A liquid discharger according to claim 8, wherein;

the retainer is a flat plate member that is provided substantially parallel to the base and has an outer peripheral edge that extends between the tube and the initial start-position of the lead-in ball;

the corresponding ball holding section is a cut-away portion of the retainer extending from the retainer's outer peripheral edge to a location above the tube;

the lead-in ball at the initial start-position has a movement path to the corresponding ball holding section that crosses a movement-direction of the retainer;

the lead-in ball at the corresponding ball holding section is held by the corresponding ball holding section in the direction of movement of the retainer; and the leading-away section, formed at the corresponding ball holding section, has an initial position guide surface for guiding the lead-in ball to the initial start-position thereof when the retainer moves in a reverse direction.

10. A liquid discharger according to claim 8, wherein the base further includes a ball lead-in groove for guiding the lead-in ball disposed at the initial start-position to a location above the tube disposed in the tube guide groove, and wherein a central portion of a cross section of a bottom surface of the ball lead-in groove protrudes towards a pusher member, wherein said pusher member is effective for pushing the balls against the tube in order to press and squash said portion of the tube.

11. A liquid discharger according to claim 8, wherein:

the retainer is a flat plate member that is provided substantially parallel to the base and has an outer peripheral edge that extends between the tube and the initial position of the lead-in ball;

the corresponding ball holding section is a cut-away a portion of the retainer extending from its outer peripheral edge to a location above the tube;

the lead-in ball at the initial position has a movement path to the corresponding ball holding section that crosses a direction of movement of the retainer;

the lead-in ball at the corresponding ball holding section is held by the corresponding ball holding section in the direction of movement of the retainer; and the ball-leading section includes an urging section, disposed at the base, for biasing the lead-in ball at the initial start-position towards the outer peripheral edge of the retainer.

12. A liquid discharger according to claim 8, wherein the ball-leading section protrudes from the retainer on the side of the corresponding ball holding section opposite to the direction of movement of the retainer; and the liquid discharger further includes a transporting section for transporting the lead-in ball by catching the lead-in ball by passing the initial start-position of the lead-in ball as the retainer moves.

13. A liquid discharger according to claim 8, wherein the ball-leading section includes a guiding section that protrudes towards the retainer in a direction of movement of the corresponding ball holding section from the initial start-position of the lead-in ball on the base; and wherein the guiding section has a guide surface for guiding the lead-in ball towards the path of the corresponding ball holding section by having the lead-in ball, which moves on the base along with the retainer, come into contact with the guide surface.

14. A liquid discharger according to claim 13, wherein the ball-leading-away section includes an initial position guide surface for guiding the lead-in ball to the initial position, said initial position guide surface being formed at a part of the base opposite to the guide surface, and the initial start-position of the lead-in ball being disposed therebetween.

15. An apparatus comprising the liquid discharger of claim 1.

16. A liquid discharger including a base for placing a resilient tube thereat, the liquid discharger comprising:

at least two balls that roll on the tube while pressing and squashing separate portions of the tube;

a retainer movable along the tube, said retainer having ball holding sections for holding said balls as the balls rotate along the tube;

a tube guide groove formed in the base for placing the tube therein, wherein the tube guide groove has a cross-sectional arc-shape generally conforming to the shape of the balls;

pusher member disposed opposite to the tube with the balls being disposed therebetween, wherein the balls roll while contacting the pusher member, so that the balls are pushed by the pusher member in order to press and squash said portion of the tube;

a stopper member on said base for contacting said pusher member and placing a lower limit on how close the balls may be pushed toward the base of said groove.

17. The liquid discharger of claim 16, wherein said stopper member protrudes along said guide groove.

18. The liquid discharger of claim 16, wherein said pusher member has a recess over each ball, said tube places a resilient force on said balls for biasing said balls away from said guide groove, and the ceiling of said recess places a limit on how far said balls may be biased away from said guide groove.

* * * * *